US011125439B2

(12) United States Patent
Sprowl et al.

(10) Patent No.: US 11,125,439 B2
(45) Date of Patent: Sep. 21, 2021

(54) HOT SURFACE IGNITERS FOR COOKTOPS

(71) Applicant: SCP Holdings, LLC, Auburn, IN (US)

(72) Inventors: Bruce C. Sprowl, Auburn, IN (US); Jack A. Shindle, Leo, IN (US); Robert Davignon, Terre Haute, IN (US); Brian C. Dougherty, Terre Haute, IN (US); Sudhir Brahmandam, Naperville, IL (US)

(73) Assignee: SCP Holdings, an assumed business name of Nitride Igniters, LLC, Auburn, IN (US)

( * ) Notice: Subject to any disclaimer, the term of this patent is extended or adjusted under 35 U.S.C. 154(b) by 232 days.

(21) Appl. No.: 16/366,147

(22) Filed: Mar. 27, 2019

(65) Prior Publication Data

US 2019/0301742 A1 Oct. 3, 2019

Related U.S. Application Data

(60) Provisional application No. 62/781,588, filed on Dec. 18, 2018, provisional application No. 62/648,574, filed on Mar. 27, 2018.

(51) Int. Cl.
*F24C 3/10* (2006.01)
*F23N 5/24* (2006.01)
(Continued)

(52) U.S. Cl.
CPC ..... *F24C 3/103* (2013.01); *F23N 5/24* (2013.01); *F23Q 7/10* (2013.01); *F23Q 7/12* (2013.01);
(Continued)

(58) Field of Classification Search
CPC ..... F24C 3/103
(Continued)

(56) References Cited

U.S. PATENT DOCUMENTS 3,426,953 A 2/1969 Metzger et al.
3,597,139 A 8/1971 Elders
(Continued)

FOREIGN PATENT DOCUMENTS

GB 1094522 12/1967
JP 2-251014 A 10/1990
(Continued)

OTHER PUBLICATIONS

International Search Report and Written Opinion for PCT/US2019/024344 dated Aug. 2, 2019.
(Continued)

*Primary Examiner* — Vivek K Shirsat
(74) *Attorney, Agent, or Firm* — Hansen IP Law PLLC

(57) ABSTRACT

Hot surface igniter assemblies used in cooktops are shown and described. The hot surface igniters include a silicon nitride ceramic body with an embedded, resistive, heat-generating circuit. When energized, the circuit generates temperatures in excess of 2000° F. in under 4 seconds to ignite cooking gas such as natural gas. To prevent damage to the igniter during use or cleaning, an insulator assembly is provided which protects the distal end of the igniter ceramic body from damage while still exposing it to the cooking gas flow from the burner. In addition, a number of different terminal connection schemes for connecting the igniters to a power source are shown and described.

13 Claims, 47 Drawing Sheets

(51) Int. Cl.

| | |
|---|---|
| ***F23Q 7/12*** | (2006.01) |
| ***F23Q 7/10*** | (2006.01) |
| ***F24C 3/08*** | (2006.01) |
| ***F24C 3/12*** | (2006.01) |
| ***F24C 15/10*** | (2006.01) |
| ***F23D 14/06*** | (2006.01) |

(52) U.S. Cl.
CPC ..... *F24C 3/085* (2013.01); *F24C 3/126* (2013.01); *F24C 15/108* (2013.01); *F23D 14/06* (2013.01)

(58) Field of Classification Search
USPC ..... 126/39 E, 39 R; 431/6, 263; 219/267
See application file for complete search history.

(56) References Cited

U.S. PATENT DOCUMENTS 3,806,308 A 4/1974 Cahoe et al.
3,823,345 A 7/1974 Mitts et al.
3,840,768 A 10/1974 White et al.
3,906,341 A 9/1975 Getz et al.
3,906,342 A 9/1975 Pfouts
4,029,936 A 6/1977 Schweitzer
4,205,363 A 5/1980 Boos et al.
4,405,299 A 9/1983 Serber
4,486,651 A 12/1984 Atsumi et al.
4,493,402 A 1/1985 Hattori
4,560,343 A 12/1985 Bohan, Jr.
4,587,941 A 5/1986 Mishina et al.
4,634,837 A 1/1987 Ito et al.
4,641,043 A 2/1987 Adams et al.
4,789,330 A 12/1988 Ballard et al.
4,804,823 A 2/1989 Okuda et al.
4,815,524 A 3/1989 Dempsey et al.
4,850,852 A 7/1989 Ballard et al.
4,883,947 A 11/1989 Murase et al.
4,891,004 A 1/1990 Ballard et al.
4,912,305 A 3/1990 Tatemasu et al.
4,925,386 A 5/1990 Donnelly et al.
4,951,870 A 8/1990 Ballard et al.
4,978,293 A 12/1990 Ryno
5,002,038 A 3/1991 Riehl
5,003,161 A 3/1991 Geary
5,035,607 A 7/1991 Peterson
5,076,494 A 12/1991 Ripka
5,112,217 A 5/1992 Ripka et al.
5,133,656 A 7/1992 Peterson
5,233,166 A 8/1993 Maeda et al.
5,249,096 A 9/1993 Williams
5,264,681 A 11/1993 Nozaki et al.
5,324,194 A 6/1994 Bruce et al.
5,379,853 A 1/1995 Lockwood et al.
5,435,717 A 7/1995 Bohan et al.
5,458,011 A 10/1995 Thompson
5,492,469 A 2/1996 Oda et al.
5,514,630 A 5/1996 Willkens et al.
5,522,541 A 6/1996 Zia et al.
5,544,645 A 8/1996 Armijo et al.
5,560,851 A 10/1996 Thimm et al.
5,624,252 A 8/1997 Charles, Sr. et al.
5,725,368 A 3/1998 Arensmeier
5,731,594 A 3/1998 Kuroda et al.
5,750,958 A * 5/1998 Okuda ..... F23Q 7/001 123/145 A
5,767,026 A 6/1998 Kondoh et al.
5,785,911 A 7/1998 Willkens et al.
5,786,565 A 7/1998 Willkens et al.
5,791,890 A 8/1998 Maughan
5,801,361 A 9/1998 Willkens et al.
5,804,092 A 9/1998 Axelson et al.
5,813,394 A 9/1998 Clifford
5,820,789 A 10/1998 Willkens et al.
5,865,612 A 2/1999 Hill et al.
5,892,201 A 4/1999 Croucher et al.
5,916,467 A 6/1999 Shimada
6,002,107 A 12/1999 Willkens et al.
6,028,292 A 2/2000 Willkens et al.
6,030,205 A 2/2000 Maughan
6,084,220 A 7/2000 Suematsu et al.
6,089,219 A 7/2000 Kodera et al.
6,168,418 B1 1/2001 Levinson
6,216,683 B1 4/2001 Maughan
6,217,312 B1 4/2001 Levinson et al.
6,278,087 B1 8/2001 Willkens et al.
6,359,261 B1 3/2002 Watanabe et al.
6,474,492 B1 11/2002 Willkens et al.
6,479,949 B1 11/2002 Nerone et al.
6,548,787 B2 4/2003 Natsuhara et al.
6,562,745 B2 5/2003 Willkens et al.
6,563,089 B2 5/2003 Watanabe et al.
6,572,363 B1 6/2003 Virgil, Jr. et al.
6,582,629 B1 * 6/2003 Lin ..... F23Q 7/22 252/516
6,621,052 B2 9/2003 Watanabe et al.
6,657,166 B2 12/2003 Funaki et al.
6,728,600 B1 4/2004 Contaldo et al.
6,777,650 B1 8/2004 Hamel
6,777,653 B2 8/2004 Burkhart
6,929,874 B2 8/2005 Hiramatsu et al.
6,933,471 B2 8/2005 Hamel et al.
6,935,328 B2 8/2005 Haynes et al.
6,967,312 B2 11/2005 Hiramatsu et al.
7,204,688 B2 4/2007 Han
7,255,100 B2 8/2007 Repper et al.
7,291,009 B2 11/2007 Kamal et al.
7,329,837 B2 2/2008 Willkens
7,358,466 B1 4/2008 Meyers et al.
7,469,840 B2 12/2008 Donnelly et al.
7,538,297 B2 5/2009 Anderson et al.
7,559,293 B2 7/2009 Gordon et al.
7,638,297 B2 12/2009 Anderson et al.
7,647,762 B2 1/2010 Uselton
7,671,305 B2 3/2010 Chodacki et al.
7,675,005 B2 3/2010 Annavarapu et al.
7,772,525 B2 8/2010 Annavarapu et al.
7,772,780 B2 8/2010 Pokharna et al.
7,785,482 B2 8/2010 Subramanian et al.
7,786,409 B2 8/2010 Hamel et al.
7,900,589 B2 3/2011 Gordon et al.
7,947,933 B2 3/2011 Nagasako et al.
7,935,912 B2 5/2011 Arima et al.
7,982,166 B2 7/2011 Kukino et al.
8,167,610 B2 5/2012 Raleigh et al.
8,193,469 B2 6/2012 Willkens
8,302,593 B2 11/2012 Cadima
8,324,535 B2 12/2012 Maruyama
8,371,844 B2 2/2013 Querejeta et al.
8,413,648 B2 4/2013 Querejeta et al.
8,591,222 B2 11/2013 Sherrow
8,616,194 B2 12/2013 Sherrow et al.
8,634,179 B2 1/2014 Rubinshtein
8,757,137 B2 6/2014 Cadima
8,851,884 B2 10/2014 Querejeta et al.
8,682,492 B2 11/2014 Querejeta et al.
8,878,104 B2 11/2014 Shaffer et al.
8,899,223 B2 12/2014 Cadima
8,925,541 B2 1/2015 Thompson
8,985,999 B2 3/2015 Sherrow et al.
8,992,211 B2 3/2015 Kociecki et al.
9,068,752 B2 6/2015 Shaffer et al.
9,157,638 B2 10/2015 Ponziani et al.
9,188,343 B2 11/2015 Cadima et al.
9,200,847 B2 12/2015 Thompson
9,261,292 B2 2/2016 Sherrow
9,316,411 B2 4/2016 Sherrow et al.
9,574,774 B2 2/2017 Kobayashi
9,746,182 B2 8/2017 Blalock et al.
9,841,194 B2 12/2017 Paller
9,951,959 B2 4/2018 De Brosse et al.
10,036,555 B2 7/2018 Cadima et al.
10,119,701 B2 11/2018 Chase
10,156,378 B2 12/2018 Alsaleem
2002/0045142 A1 4/2002 Repper et al.

(56) References Cited

U.S. PATENT DOCUMENTS

2002/0073985 A1 6/2002 Leukhardt, III et al.
2003/0160220 A1 8/2003 Lin et al.
2004/0060924 A1 4/2004 Burkhart
2004/0209209 A1 10/2004 Chodacki et al.
2005/0053884 A1 3/2005 Schmiedlin et al.
2005/0089809 A9 4/2005 Repper et al.
2005/0198917 A1 9/2005 Hokkirigawa et al.
2006/0201925 A1 9/2006 Yu et al.
2006/0213897 A1 9/2006 Annavarapu et al.
2006/0219691 A1* 10/2006 Hamel ..... F23Q 7/22 219/267
2007/0007278 A1 1/2007 Chodacki et al.
2007/0154858 A1 7/2007 Cadima
2007/0295708 A1 12/2007 Yu et al.
2007/0295709 A1 12/2007 Willkens
2008/0099465 A1 5/2008 Meyers et al.
2008/0216772 A1 9/2008 Gordon et al.
2008/0302776 A1 12/2008 Arima et al.
2008/0314890 A1 12/2008 Willkens
2009/0206069 A1 6/2009 Hamel
2009/0173729 A1 7/2009 Annavarapu et al.
2009/0179023 A1 7/2009 Annavarapu et al.
2009/0179027 A1 7/2009 Vartabedian et al.
2009/0317755 A1 12/2009 Kociecki et al.
2010/0108658 A1 5/2010 Chodacki et al.
2010/0116182 A1 5/2010 Chodacki et al.
2010/0141231 A1 6/2010 Duchene
2010/0213188 A1 8/2010 Nishihara et al.
2010/0310998 A1 12/2010 Raleigh et al.
2011/0031231 A1 2/2011 Arima et al.
2011/0086319 A1 4/2011 Chodacki et al.
2011/0104622 A1 5/2011 Sherrow
2011/0207065 A1 8/2011 Shaffer et al.
2011/0233190 A1 9/2011 Kukino et al.
2011/0269080 A1* 11/2011 Shukert ..... F23Q 7/12 431/6
2012/0080023 A1 4/2012 Thompson
2012/0085832 A1 4/2012 Thompson
2012/0088199 A1 4/2012 Yantis et al.
2012/0125910 A1 5/2012 Shaffer et al.
2012/0180774 A1 7/2012 Reifel et al.
2012/0183910 A1 7/2012 Jaaz et al.
2012/0199109 A1 8/2012 Thompson
2012/0247444 A1 10/2012 Sherrow et al.
2012/0282560 A1 11/2012 Cadima
2013/0061844 A1 3/2013 Cadima
2013/0081611 A1* 4/2013 Cadima ..... F24C 3/103 126/39 E
2013/0157075 A1 6/2013 Maruyama
2013/0224671 A1 8/2013 Carey
2013/0252185 A1 9/2013 Shaw et al.
2014/0018677 A1 1/2014 Sharonov
2014/0020669 A1 1/2014 Sherrow et al.
2014/0034038 A1 2/2014 Sherrow et al.
2014/0074730 A1 3/2014 Arensmeier et al.
2014/0127570 A1 5/2014 Dandrea
2014/0186779 A1 7/2014 Chodacki et al.
2014/0196712 A1 7/2014 Cadima et al.
2014/0202443 A1 7/2014 Sherrow et al.
2014/0261386 A1 9/2014 Bringe et al.
2015/0010872 A1 1/2015 Schindler et al.
2015/0260411 A1 9/2015 Querejeta
2015/0276222 A1 10/2015 Kobayashi
2015/0323394 A1 11/2015 Alsaleem
2015/0323423 A1 11/2015 Alsaleem
2015/0330861 A1 11/2015 Alsaleem
2015/0338088 A1 11/2015 Chase
2015/0345821 A1 12/2015 Alsaleem
2015/0354834 A1 12/2015 Barone
2016/0003559 A1 1/2016 Bradbury et al.
2016/0109125 A1 4/2016 Willkens et al.
2016/0313049 A1 10/2016 Totaro
2016/0345767 A1 12/2016 Cadima
2016/0370015 A1 12/2016 Paller
2017/0127478 A1 5/2017 Okamura
2018/0031274 A1 2/2018 Wilson et al.
2018/0045418 A1 2/2018 Cook et al.
2018/0306491 A1 10/2018 Saunders et al.
2019/0139805 A1 5/2019 Muneishi

FOREIGN PATENT DOCUMENTS

WO 01029483 A1 4/2001
WO 2004083728 A1 9/2004

OTHER PUBLICATIONS

International Search Report and Written Opinion for PCT/US2019/024301 dated Aug. 2, 2019.
English translation of JP 2-251014 from Lexis Nexis Total Patent One.

* cited by examiner

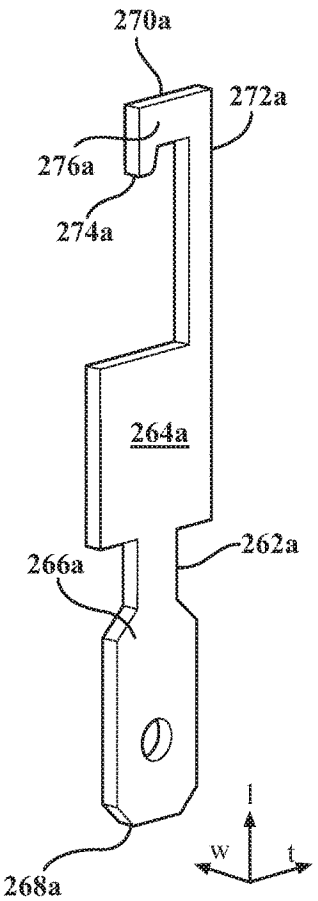
FIG. 9E
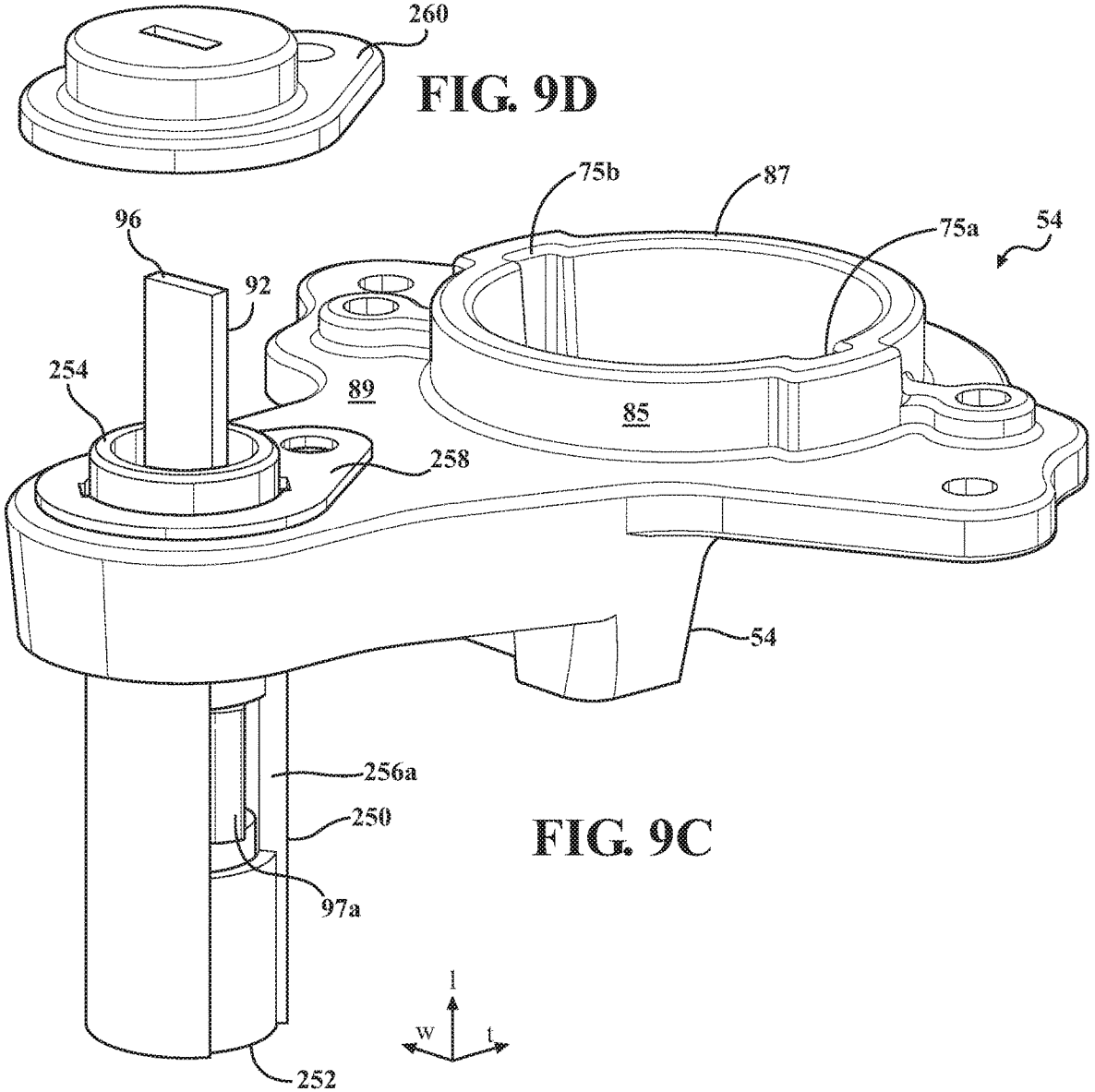
FIG. 9D
FIG. 9C

HOT SURFACE IGNITERS FOR COOKTOPS

CROSS-REFERENCE TO RELATED APPLICATIONS

This application claims the benefit of U.S. Provisional Patent Application No. 62/648,574, filed on Mar. 27, 2018 and U.S. Provisional Patent Application No. 62/781,588, filed on Dec. 18, 2018, the entirety of each of which is hereby incorporated by reference.

FIELD

This disclosure relates to gas cooktops with burners that include hot surface igniter assemblies.

BACKGROUND

Gas cooktops include a set of burners, each of which receives and ignites cooking gas. The burner typically includes an orifice holder, which holds the orifice through which gas enters the burner, a crown, and a crown cap. The crown typically includes a plurality of flutes arranged around its circumference through which combusting gas is directed in a radially outward direction. Gas enters the crown via a central gas port in the crown. A crown cap sits atop the port to redirect gas flowing upward through the port through the flutes in a radially outward direction.

Typical burners also include a spark igniter to ignite the cooking gas. Certain spark igniters consist of a small, spring loaded hammer which hits a piezoelectric crystal when activated. The contact between the hammer and crystal causes a deformation and a large potential difference. The potential difference creates an electric discharge and a spark that ignites the gas. More recently, a small transformer is provided in the ignition circuit and steps up the 120V input voltage up to 10 orders of magnitude or greater to create the large potential difference that generates the electric discharge.

Spark igniters each typically spark with a potential difference of 10,000-12,000 volts. All of the igniters for each burner on a cooktop ignite simultaneously, regardless of which burner gas is being directed to. As a result, each spark ignition event involves a collective potential difference pulse equal to the number of burners times the 10-12 kV potential per igniter. This large potential difference pulse generates an electromotive force that can cause damage to the electronic components and lead to control board failures. In addition, customers often complain that the audible clicking sound of spark igniters is annoying and the delay in gas ignition is frightening.

Hot surface igniters are a possible alternative to spark igniters. Hot surface igniters are used to ignite combustion gases in a variety of appliances, including furnaces and clothing dryers. Some hot surface igniters, such as silicon carbide igniters, include a semi-conductive ceramic body with terminal ends across which a potential difference is applied. Current flowing through the ceramic body causes the body to heat up and increase in temperature, providing a source of ignition for the combustion gases.

Other types of hot surface igniters, such as silicon nitride igniters, include a ceramic body with an embedded circuit across which a potential difference is applied. Current flowing in the embedded circuit causes the ceramic body to heat up and increase in temperature, providing a source of ignition for combustion gases. However, if installed in the location of conventional spark igniters, hot surface igniters can be vulnerable to breakage during manufacturing assembling, cleaning or other burner maintenance activities. In addition, providing hot surface igniters that can achieve a desirable ignition temperature in a suitably short time has proven to be challenging. It is also desirable to provide a means to readily replace the hot surface igniter once it has reached the end of its useful life.

BRIEF DESCRIPTION OF THE DRAWINGS

FIG. 9C is a side elevation view of a thirteenth example of a burner assembly showing a hot surface igniter assembly installed in an orifice plate in which the igniter is inserted a selected distance into an insulator to selectively electrically communicate with a power source;

FIG. 9D is a cap used to protect the igniter of FIG. 9C;

FIG. 9E is an electrical connector used with the burner assembly of FIG. 9C;

In the various embodiments, like numerals refer to like components.

DETAILED DESCRIPTION

Figure 1A:
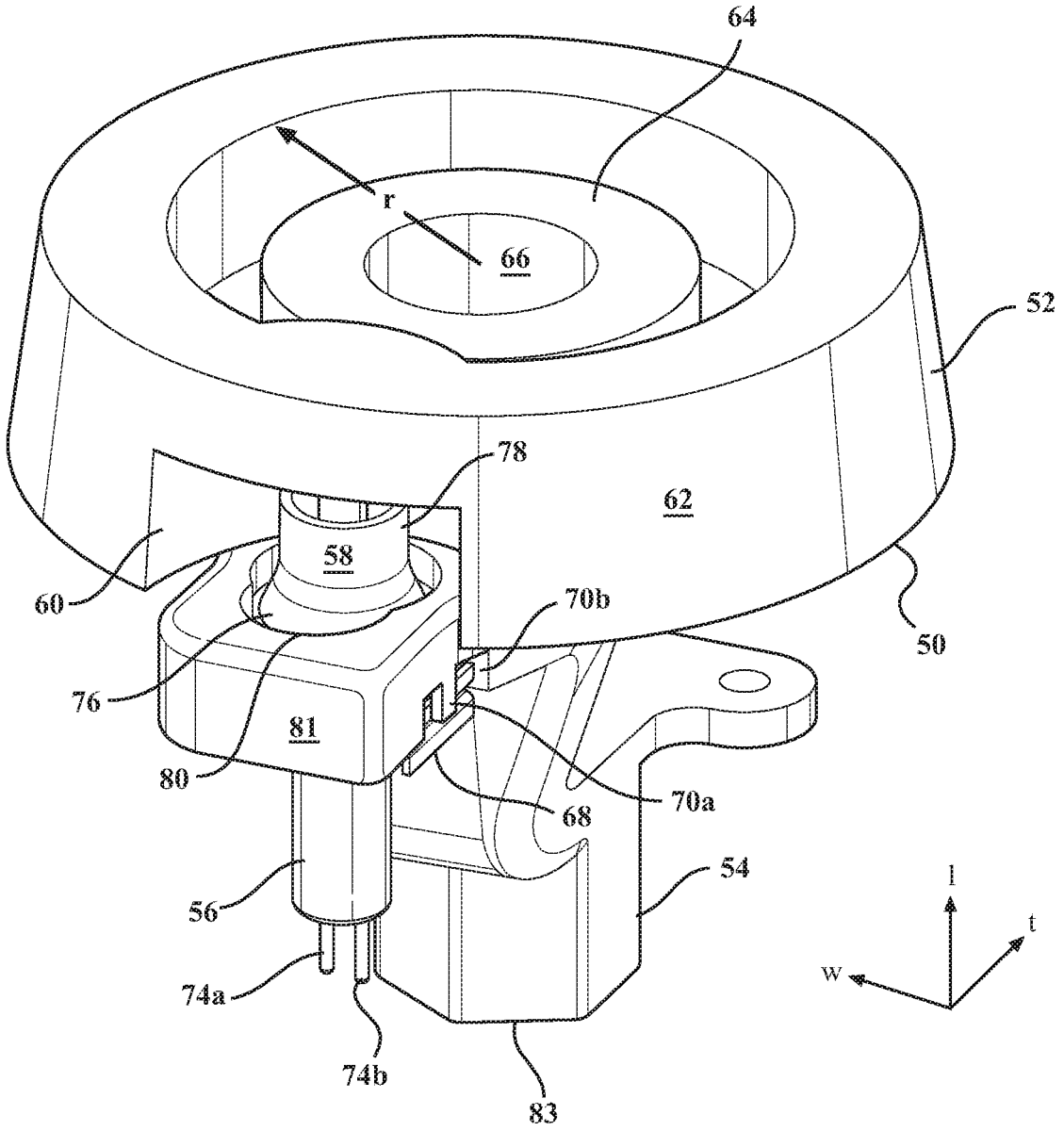
FIG. 1A is a perspective view of an assembled configuration of a first example of a burner assembly comprising a hot surface igniter using a single slit collar assembly to protect the igniter.

Described below are examples of cooktop burner assemblies comprising hot surface igniters. The hot surface igniter comprises a ceramic body having an embedded conductive ink circuit. A portion of the conductive ink circuit comprises a resistive heat generating section that generates heat when connected to a power source.

In certain examples, the hot surface igniter assembly comprises a hot surface igniter comprising a ceramic body having a proximal end and a distal end spaced apart from one another along a length axis and also having a width defining a width axis and a thickness defining a thickness axis. The igniter is generally in the shape of rectangular cube and includes two major facets, two minor facets, a top and a bottom. The major facets are defined by the first (length) and second (width) longest dimensions of the ceramic igniter body. The minor facets are defined by the first (length) and third (thickness) longest dimensions of the igniter body. The igniter bodies also include a top surface and a bottom surface which are defined by the second (width) and third (thickness) longest dimensions of the igniter body.

The igniter body preferably comprises first and second ceramic tiles comprising silicon nitride. The conductive ink circuit is disposed between the tiles and generates heat when energized. The ceramic tiles are electrically insulating but sufficiently thermally conductive to reach the temperature necessary to ignite cooking gas such as natural gas or propane. In certain examples, the ceramic tiles comprise silicon nitride, ytterbium oxide, and molybdenum disilicide. In the same or other examples, the conductive ink circuit comprises tungsten carbide, and in certain specific implementations, the conductive ink additionally comprises ytterbium oxide, silicon nitride, and silicon carbide.

In certain examples of cooktop applications, when subjected to a potential difference of 120V AC, the hot surface igniters described herein reach a surface temperature of no less than 2050° F., preferably no less than 2080° F., and more preferably no less than 2100° F. in no more than four seconds after the potential difference is applied. More preferably, the hot surface igniters reach a surface temperature of no less than 2050° F., preferably no less than 2080° F., and more preferably no less than 2100° F. in no more than about three seconds after the potential difference is applied. Even more preferably, the hot surface igniters described herein reach a surface temperature of no less than 2050° F., preferably no less than 2080° F., and more preferably no less than 2100° F. in a period of time no less than about two seconds after the potential difference is applied. In one specific example, the hot surface igniters described herein reach a surface temperature of about 2138° F. in two seconds after the 120V AC potential difference is applied. In the same or additional examples, the thickness of the igniter body is not more than about 0.04 inches, preferably not more than about 0.03 inches, and still more preferably not more than about 0.02 inches. As a result of the thin profile, in several of the examples that follow, an insulator assembly is provided which partially encloses the distal portion of the igniter body while still providing an opening that is preferably as wide as the igniter body to allow cooking gas to readily flow to the igniter. In accordance with such examples, the partial enclosure of the igniter assembly preferably extends above the distal end of the igniter along the igniter length axis l. In certain examples, an insulator that partially houses the igniter is itself configured to provide the partial enclosure. In other examples, a separate protective device is attached to a distal end of the insulator to partially enclose the distal end of the igniter body. In other examples, the igniter assembly is not configured to partially enclose a distal end of the igniter. Instead, the burner crown includes a protective shield that partially blocks access to the crown recess in which the hot surface igniter is located. In further examples, the hot surface igniter assembly is not configured to partially enclose the distal portion of the igniter, and the igniter is located in a burner crown recess to protect the igniter from user damage.

Referring to FIGS. 1A-1F a first example of a burner assembly 50 comprising a hot surface igniter 90 is shown and described. The burner assembly 50 comprises a crown 52 having an outer wall 62 and an inner wall 64. Inner wall 64 includes a central opening 66 through which cooking gas enters the crown 52. A burner cap (not shown) sits over central opening 55 to divert gas through flutes (not shown but formed in outer wall 62. Examples of burner crown flutes are shown in FIGS. 7F and 7G. An ignitor gas port 104 (FIG. 1C) is provided to supply gas to hot surface igniter assembly 51 (reference numeral not included in figures). Hot surface igniter assembly 51 comprises hot surface igniter 90 and an insulator assembly 53 (reference numeral not shown in figures). Insulator assembly 53 comprises insulator 56 and single slit collar 58.

Figure 5A:
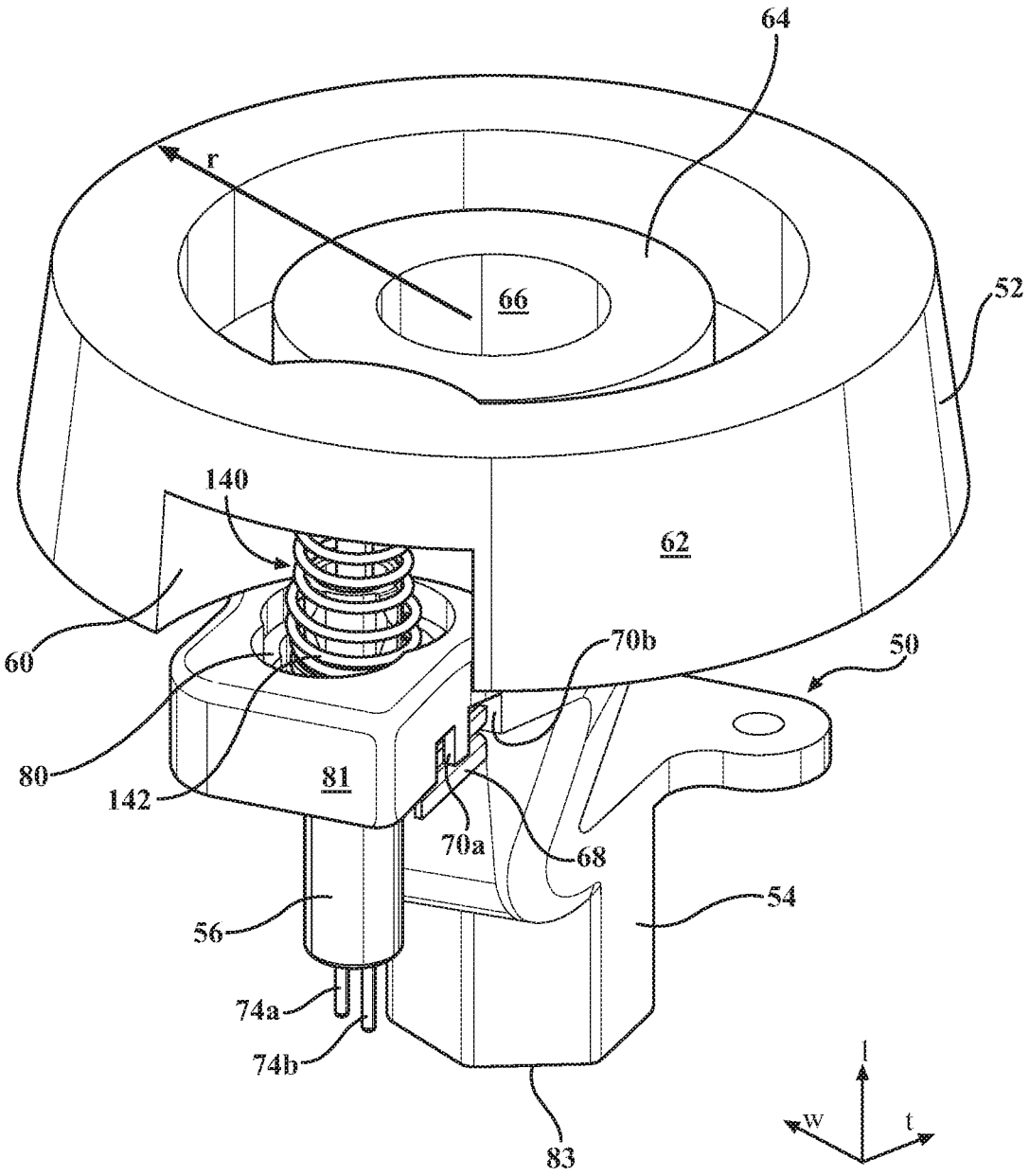
FIG. 5A is a perspective view of an assembled configuration of a fifth example of burner assembly comprising a hot surface igniter using a spring cage to protect the igniter.
Figure 5B:
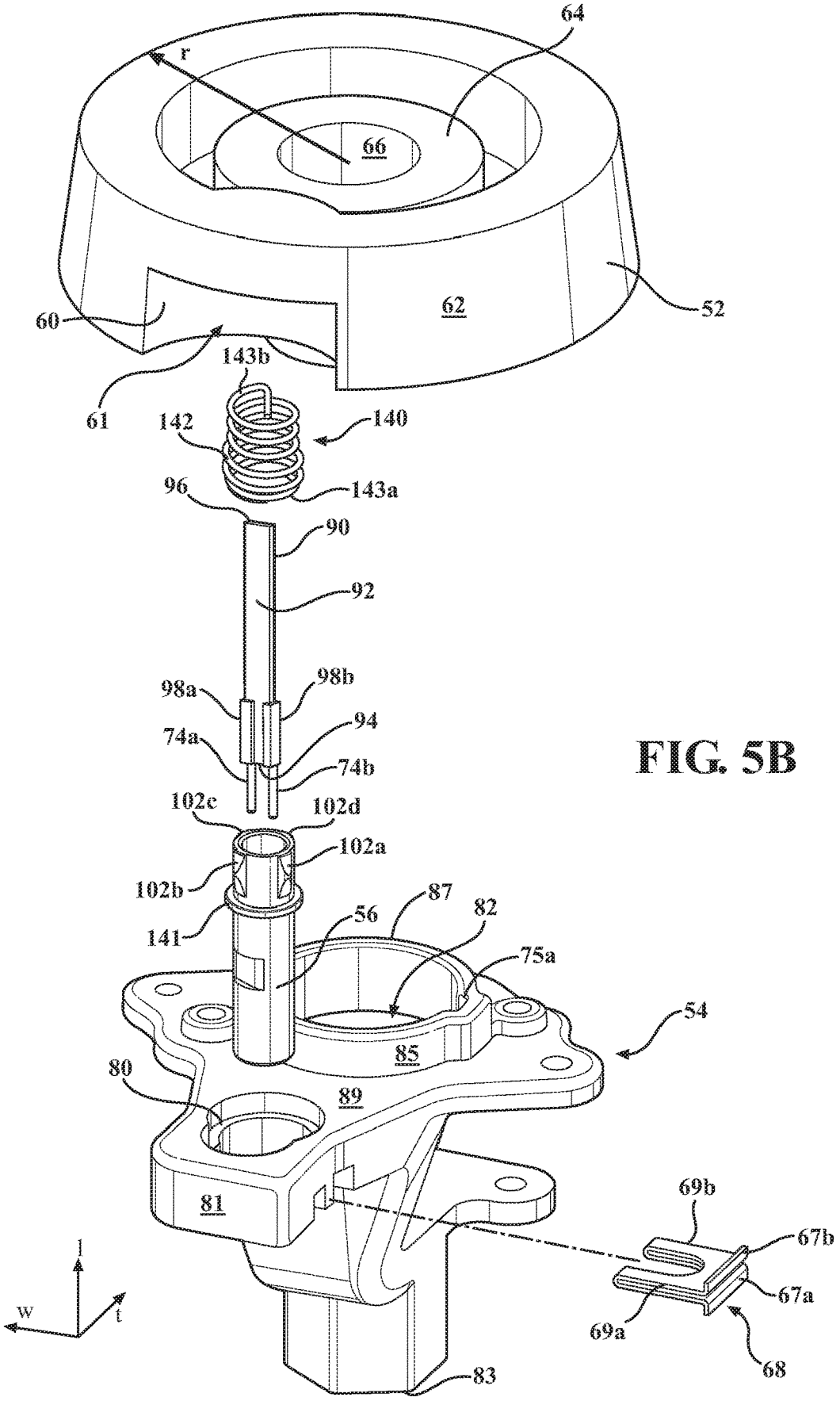
FIG. 5B is an exploded view of the burner assembly of FIG. 5A.
Figure 5C:
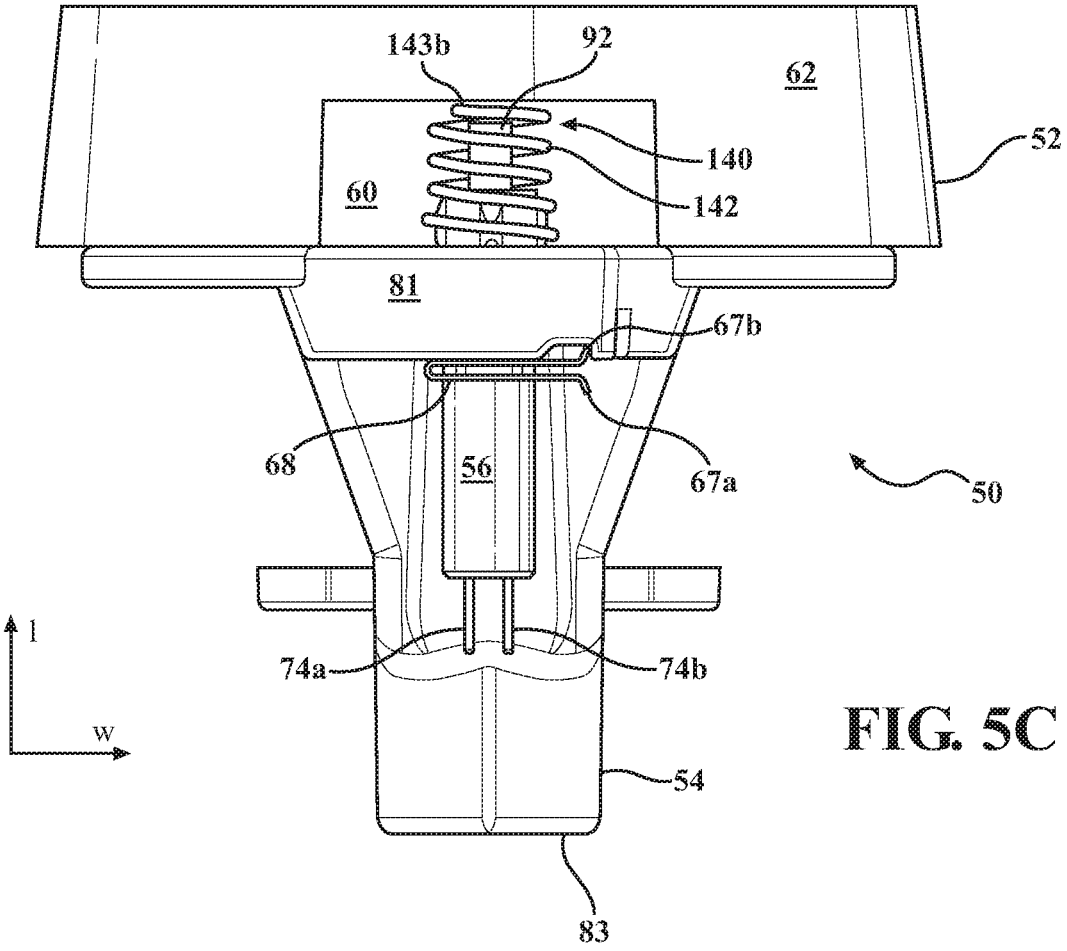
FIG. 5C is a side elevation view of the burner assembly of FIG. 5A.
Figure 5F:
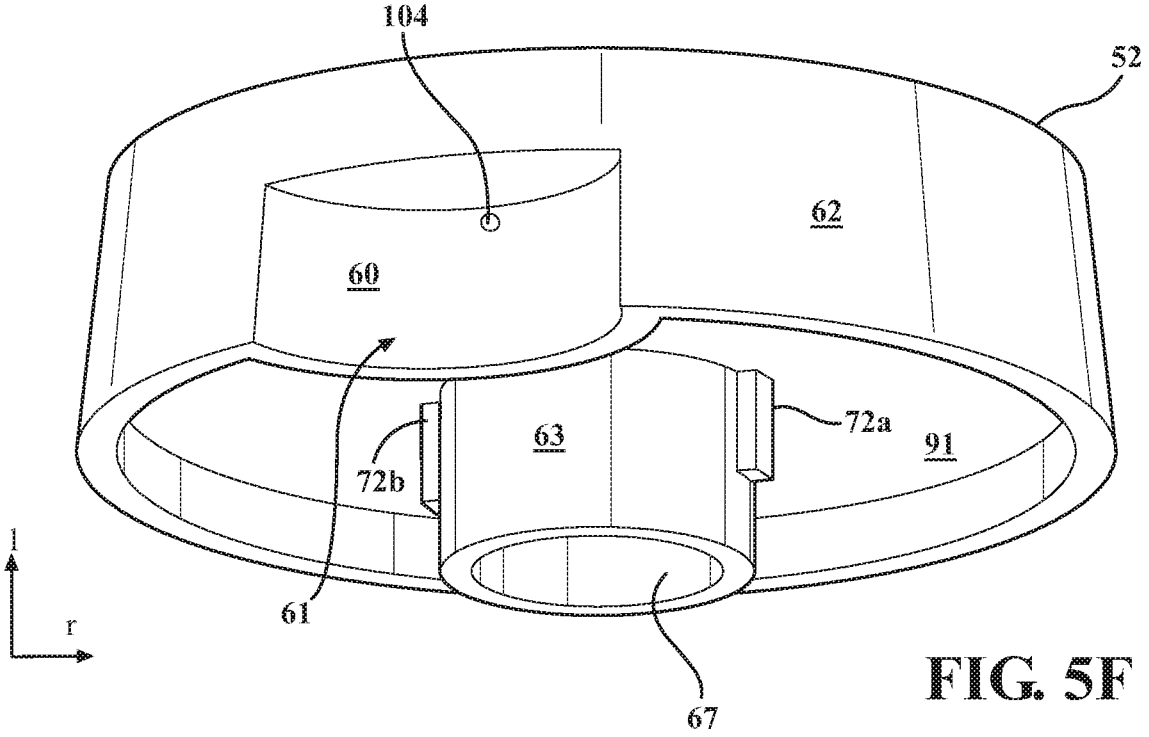
FIG. 5F is a bottom perspective view of the crown of the burner assembly of FIG. 5A.
Figure 5D:
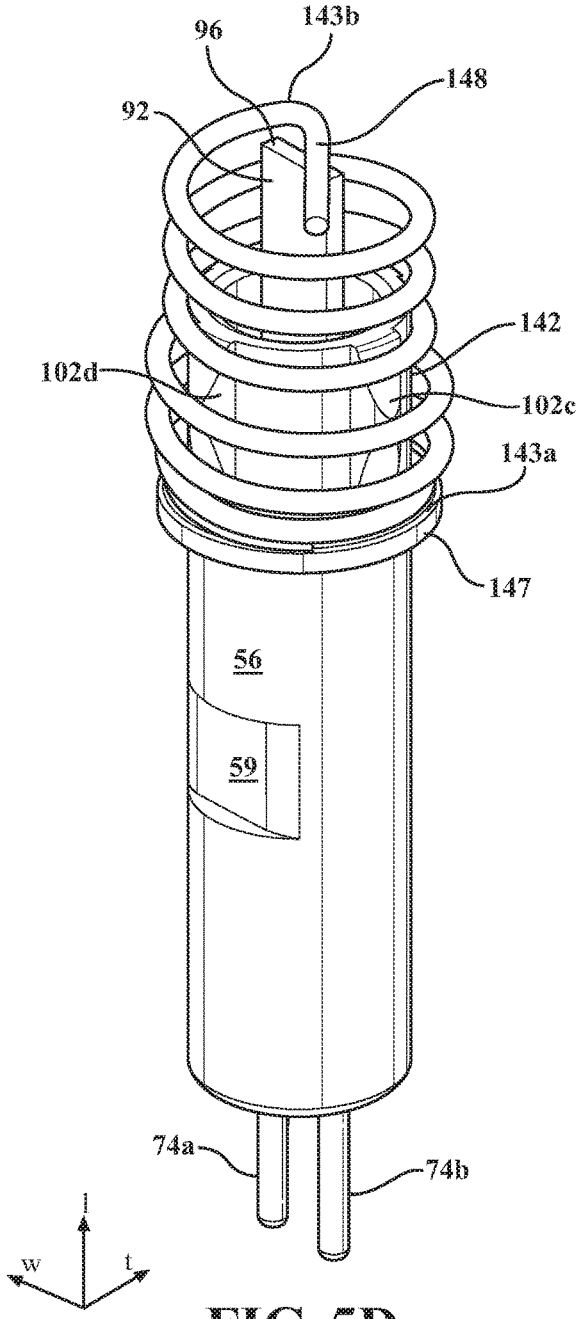
FIG. 5D is a side perspective view of the hot surface igniter assembly of FIG. 5A.
Figure 5E:
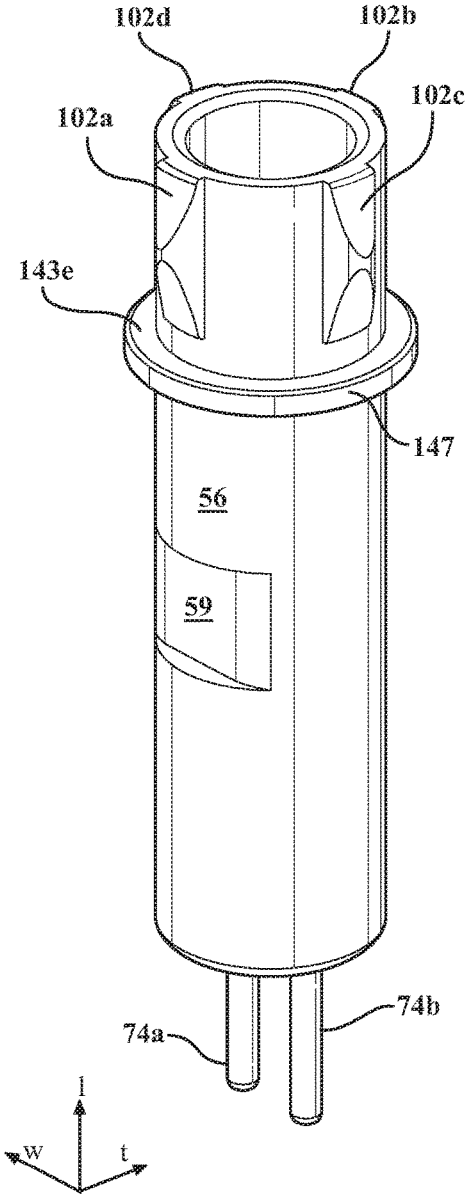
FIG. 5E is side perspective view of the insulator of FIG. 5A.

Crown 52 is shown in greater detail in FIG. 5F. The underside of crown 52 includes a cylindrical axially extending flange 63 with a port 67 that is in fluid communication with a source of cooking gas. Crown 52 is installed on an orifice holder 54 (FIG. 1B).

The outer wall 62 of crown 52 is includes a concave section 60 that defines a recess 61 sized to receive the portion of the hot surface igniter assembly extending above the orifice holder igniter mounting bracket 81.

Hot surface igniter 90 comprises a ceramic body 92 having a proximal end 94 (FIG. 1B) and a distal end 96 spaced apart along an igniter length axis l. Ceramic body 92 also has a width axis w and a thickness axis t. The length l axis corresponds to the longest dimension of the ceramic body 92. The width w axis corresponds to the second longest dimension of ceramic body 92, and the thickness t axis corresponds to the third longest (or shortest) dimension of ceramic body 92. Although not depicted in the figures, ceramic body 92 comprises two ceramic tiles with an embedded conductive ink circuit of the type described previously. The ceramic tiles preferably comprise silicon nitride, and more preferably comprise silicon nitride, ytterbium oxide, and molybdenum disilicide. The igniter 90 also includes connectors 74*a* and 74*b* which project away from ceramic body 92 in the proximal direction along the igniter length axis l. External leads 98*a* and 98*b* are attached to ceramic body 92 and are connected to the conductive ink circuit (not shown) and the connectors 74*a* and 74*b*, respectively. More details of an exemplary igniter 90 and conductive ink pattern will be described with reference to FIGS. 13C and D. However, in certain examples of burner assemblies, in order to meet the igniter's time to temperature requirement, the igniter body 92 must be thinner than many conventional igniters along the thickness axis t. The thinner profile makes the igniter more fragile and susceptible to breakage. Accordingly, in several of the burner assemblies described below, an insulator assembly is provided which encloses the igniter along the igniter body's length while still providing an opening for cooking gas to access a major facet of the igniter.

Insulator 56 is a generally cylindrical body with an interior cavity 57 (FIG. 1B) having a proximal end 111*a* and a distal end 111*b* (FIG. 1E) spaced apart along the length of the insulator 56 and (when installed) along the igniter length axis l. Insulator 56 preferably comprises a thermally and electrically insulating material. Preferred materials include ceramics such as alumina, steatite, and cordierite. Igniter 90 is partially disposed in the interior cavity 57 such that the connectors 74*a* and 74*b* project through openings (not shown) in the bottom of insulator 56 for connection to a suitable power source. The insulator 56 encloses part of the ceramic body 92 along the length axis l. A distal portion of the ceramic body (preferably comprising the resistive heating portion of the conductive ink circuit) extends distally from the distal end 111*b* of the insulator so that it is in open fluid communication with air and the cooking gas.

Orifice holder 54 is a rigid structure made of a suitable metal and includes an upper crown engagement surface 89 and a central opening 82 that is aligned with the gas orifice (not shown) to allow cooking gas to enter central opening 66 of crown 52. Axially upward extending flange 85 defines central opening 82 and includes an upper surface 87 that abuttingly engages downward facing surface 91 of crown 52. Axially upward extending flange 85 of orifice holder 54 includes radial projections 72*a* and 72*b* which each have a length along the igniter length axis. Projection 72*a* and 72*b* slide into and engage grooves 75*a* and 75*b* formed on axially downward extending flange 63 of the crown 52. Central opening 66 of crown 52 is positioned over and is co-axial with orifice holder central opening 82 to thereby define a path for cooking gas flow to enter the interior of crown 52. An insulator bore 80 (FIG. 1B) is provided in an insulator mounting bracket 81 of the orifice holder 54 and receives the insulator 56 in a manner that secures insulator 56 to orifice holder 54. In certain applications in which the hot surface igniter 90 is being used to replace a spark igniter in an existing burner assembly 50, the maximum clearance C1 below the mounting bracket 81 is no more than about 2 inches, preferably no more than about 1.8 inches, and still more preferably no more than about 1.5 inches.

Figure 1B:
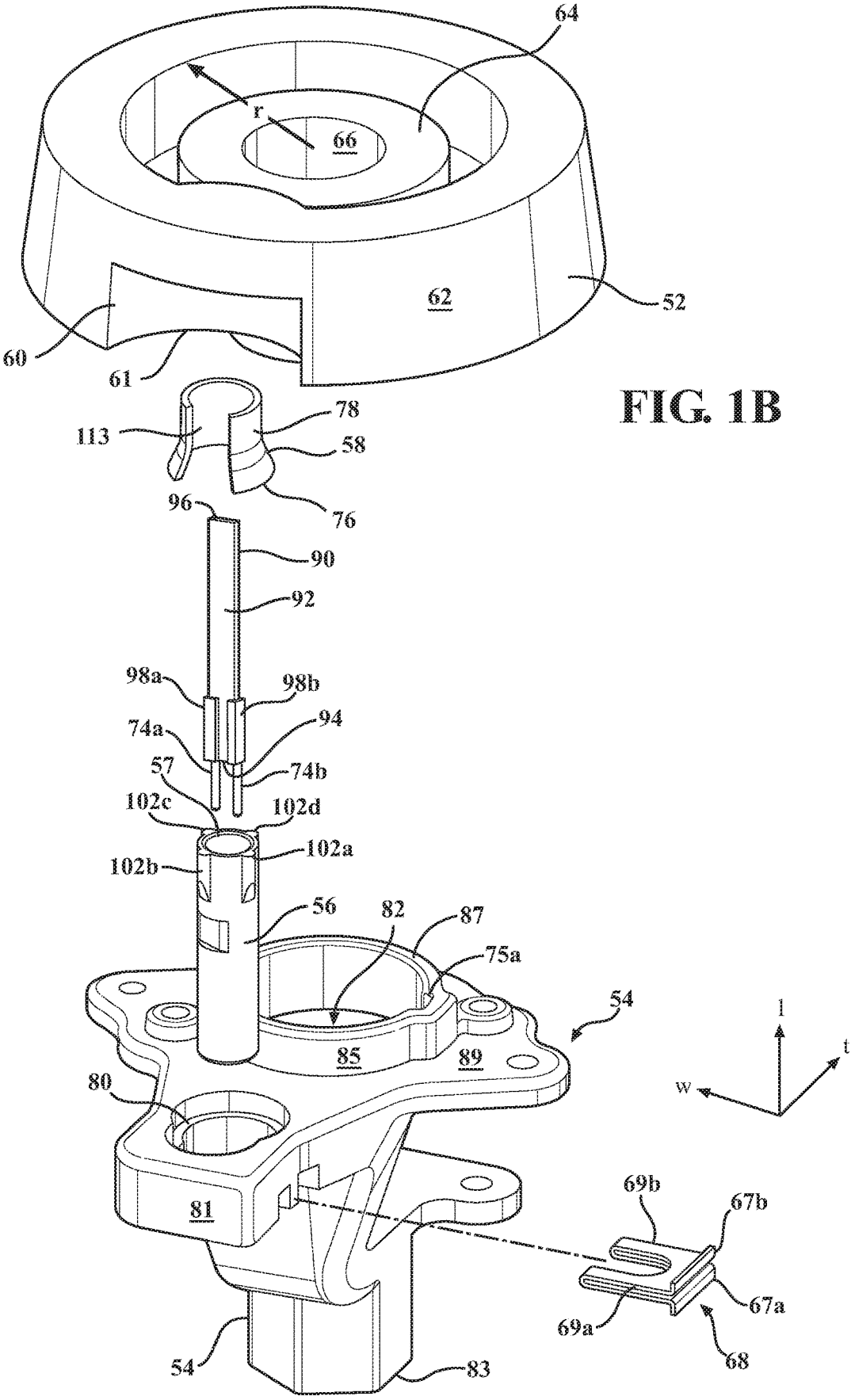
FIG. 1B is an exploded view of the burner assembly of FIG. 1A.
Figure 1C:
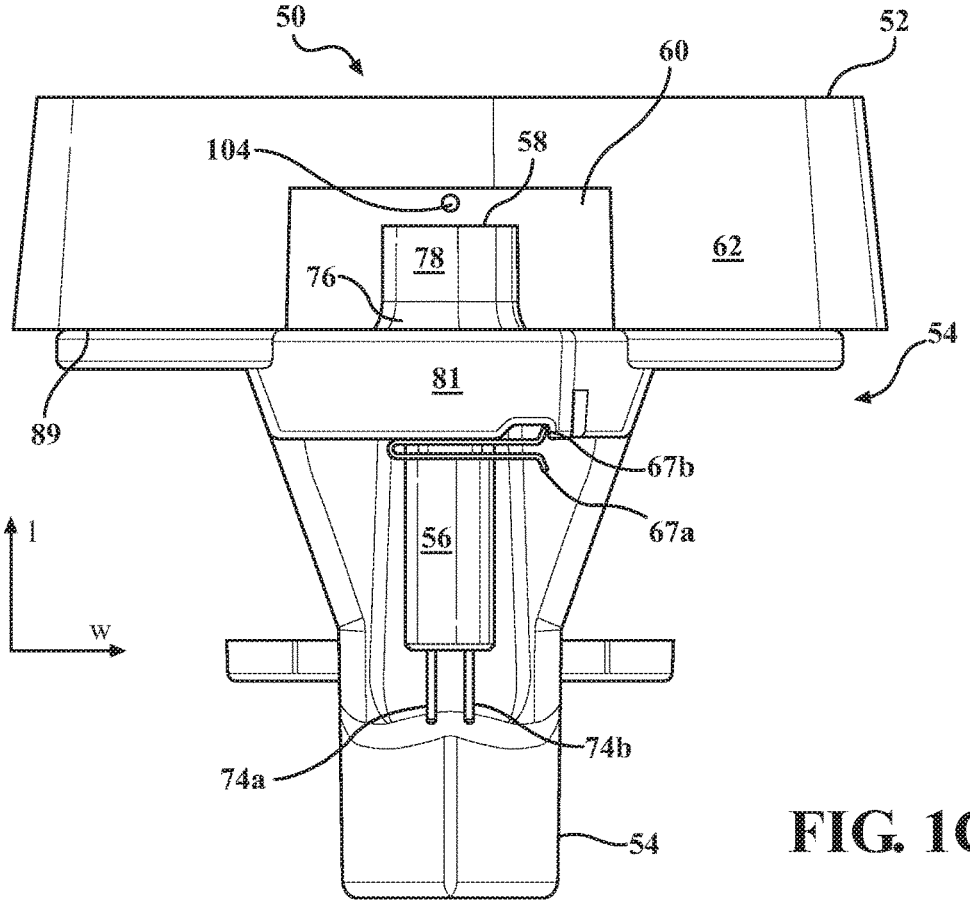
FIG. 1C is a side elevation view of the burner assembly of FIG. 1A.

As shown in FIGS. 1A and 1C, in certain examples the orifice holder 54 includes parallel channels 70*a* and 70*b* which receive a retaining clip 68 and removably secure it to orifice holder 54. The retaining clip 68 includes first and second sides 69*a* and 69*b* that define a generally "U" shaped structure. The sides 69*a* and 69*b* mate with corresponding "flats" 59*a* and 59*b* (only 59*a* is visible in FIG. 1F) on insulator 56 to hold the insulator 56 to orifice holder 54. Stops 67*a* and 67*b* are also provided on retaining clip 68 to limit its insertion into channels 70*a* and 70*b* along the igniter width w axis.

Figure 1D:
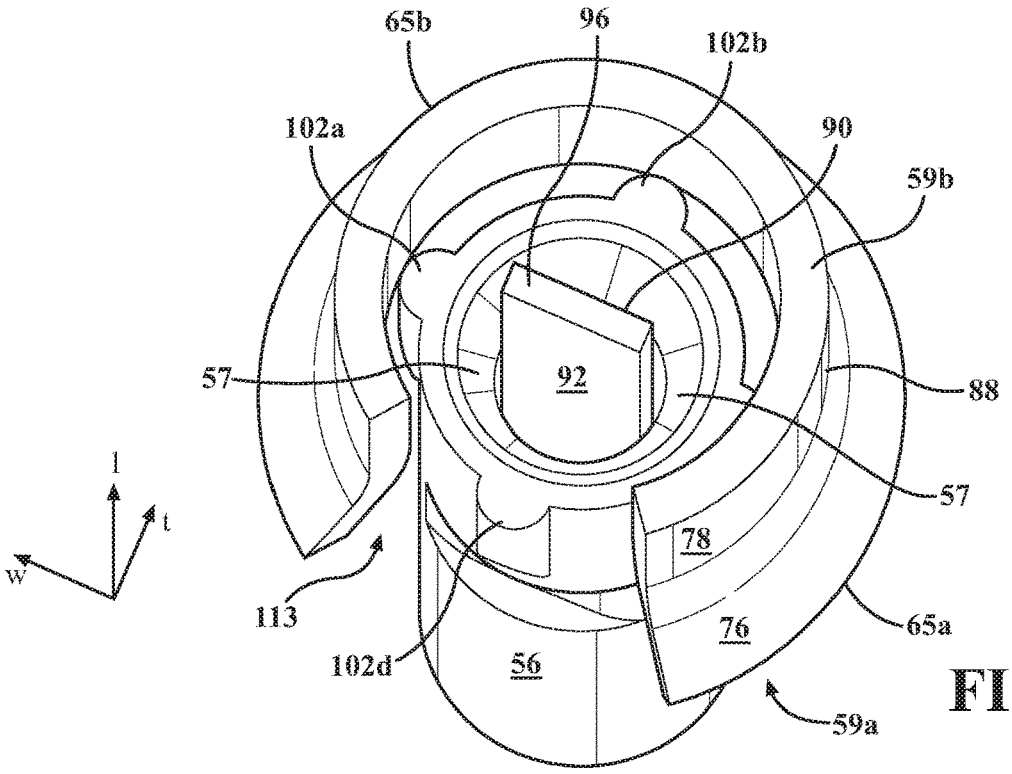
FIG. 1D is a top perspective view of the hot surface igniter assembly of FIG. 1A.
Figure 1E:
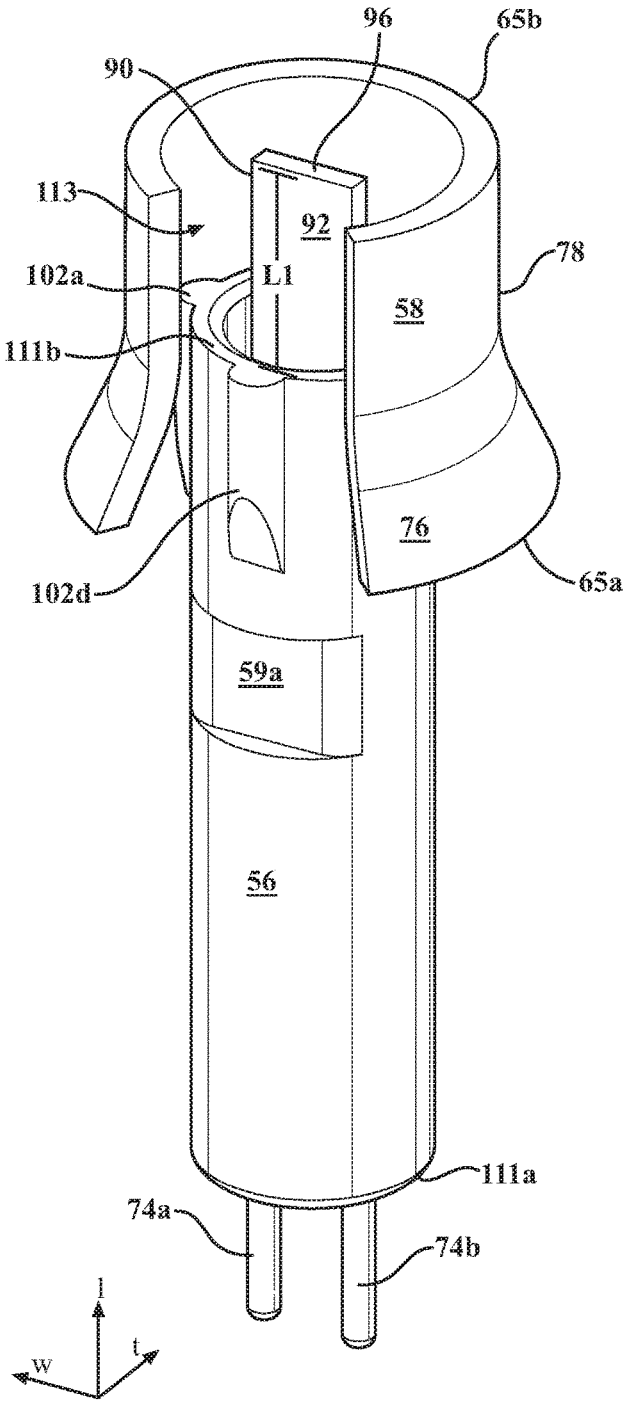
FIG. 1E is a side perspective view of the hot surface igniter assembly of FIG. 1A.

As best seen in FIGS. 1D and 1E, the insulator assembly 53 also includes a protective enclosure that protects the distal end of igniter ceramic body 92 while still allowing the igniter body 92 to receive air and cooking gas for ignition. In the example of FIGS. 1A-1E, the protective enclosure is a single slit collar 58. Single slit collar 58 partially encloses the distal end of the igniter ceramic body 92 along the igniter length axis l to prevent it from being damaged by cleaning, maintenance, etc. while at the same time providing a pathway for gas and air to reach the resistive heating section of the igniter body 92. Single slit collar 58 includes proximal end 65*a* and a distal end 65*b* spaced apart along the igniter length axis l. Single slit collar 58 comprises partially cylindrical distal section 78 and an adjacent frustoconical proximal section 76. Opening 113 extends along the length of the single slit collar 58 to allow gas and air to readily access a major facet of igniter ceramic body 92. Single slit collar 58 and the other exemplary distal end enclosures described below are preferably formed from a refractory material such as stainless steel or Inconel. One benefit of using a metal distal end enclosure is that it may facilitate re-ignition of the igniter gas by keeping the gas proximate the igniter 90 hotter than a non-metallic enclosure.

Figure 1F:
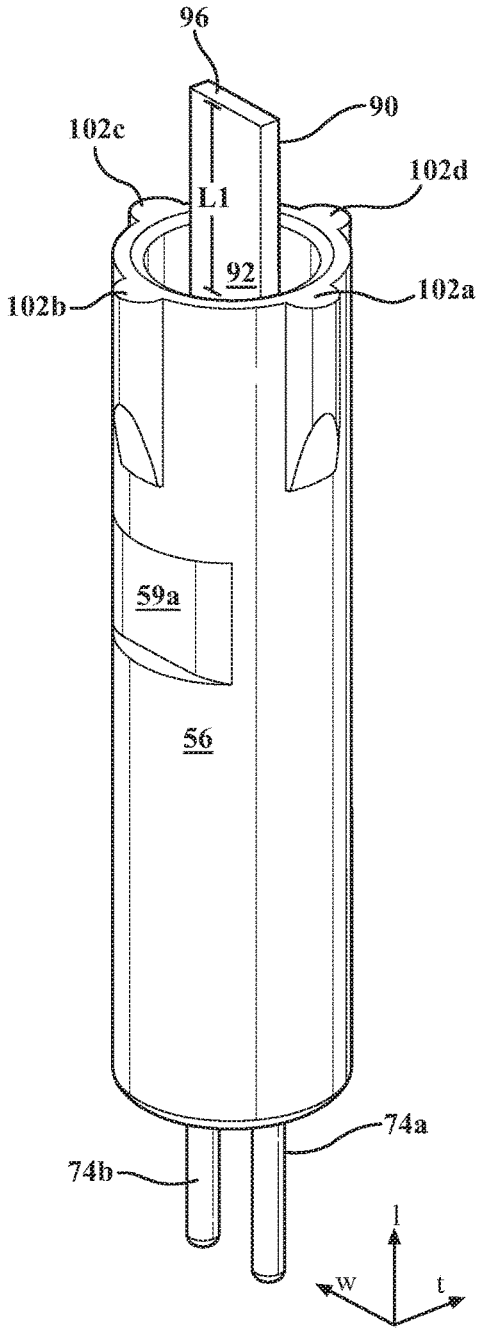
FIG. 1F is a side perspective view of the hot surface igniter assembly of FIG. 1A with the single slit collar removed.

As shown in FIGS. 1E and 1F, in certain examples of cooktop burner assemblies herein, the igniter body 92 has an "out of block length" (L1), which is a distance that the distal end 96 of igniter body 92 extends above the distal end 111*b* of the insulator 56. In certain examples, L1 is no more than about 0.5 inches, preferably no more than about 0.4 inches, and still more preferably not more than about 0.3 inches. In accordance with such examples, the igniter body 92 is preferably from about 1 inch to about 1.5 inches along, more preferably from about 1.2 to about 1.4 inches, and still more preferably about 1.3 inches in length along the length axis l. In the same or other examples, the igniter body 92 has a width that is preferably from about 0.1 to about 0.24 inches, more preferably from about 0.12 to about 0.2 inches, and still more preferably from about 0.18 to about 0.19 inches.

The flats 59*a* and 59*b* are flat on the inner and outer surfaces of insulator 56. The sides 69*a* and 69*b* of the retaining clip are oriented so that their lengths are perpendicular to the diameter of the insulator 56 at the location of flats 59*a* and 59*b* along the insulator 56 length. As a result, the igniter 90 can only be inserted so that a major facet of the igniter body 92 is facing igniter gas port 104, thereby ensuring the maximum surface area of the igniter body 92 is available for gas flowing from port 104. The flats 59*a* and 59*b* create a region where the diameter of the insulator 56 is less than the width of the igniter body 92, thereby preventing installation in any other orientation except one in which a major facet of the igniter body 92 is facing igniter gas port 104 on crown 52.

Referring to FIG. 1D, insulator 56 includes a plurality of nodes 102*a*-102*d* arranged around the circumference of insulator 56 and projecting radially outward from cavity 57. The nodes 102*a*-102*d* are sized for press-fit engagement with the cylindrical section 78 of single slit collar 58, avoiding the need for mechanical fasteners. As shown in FIG. 1E, the single slit collar 58 is preferably press fit to nodes 102*a*-102*c* so that a major facet of the igniter 90 is aligned with opening 113 and readily accessible by the cooking gas flowing from port 104. As illustrated in FIGS. 6A-6D, in certain examples, the insulator 56 may also be integrally formed with a protective enclosure instead of separately forming the enclosure and attaching it to the insulator 56.

In certain examples, the igniter 90 is fixedly secured within the cavity 57 of the insulator 56 such as by using a ceramic potting cement. However, the insulator 56/igniter 90 combination can be removed and replaced from the burner assembly 50 by sliding out the retaining clip 68, disconnecting the connectors 74*a* and 74*b* from a power source and inserting a replacement insulator 56/igniter 90 combination.

Figure 2A:
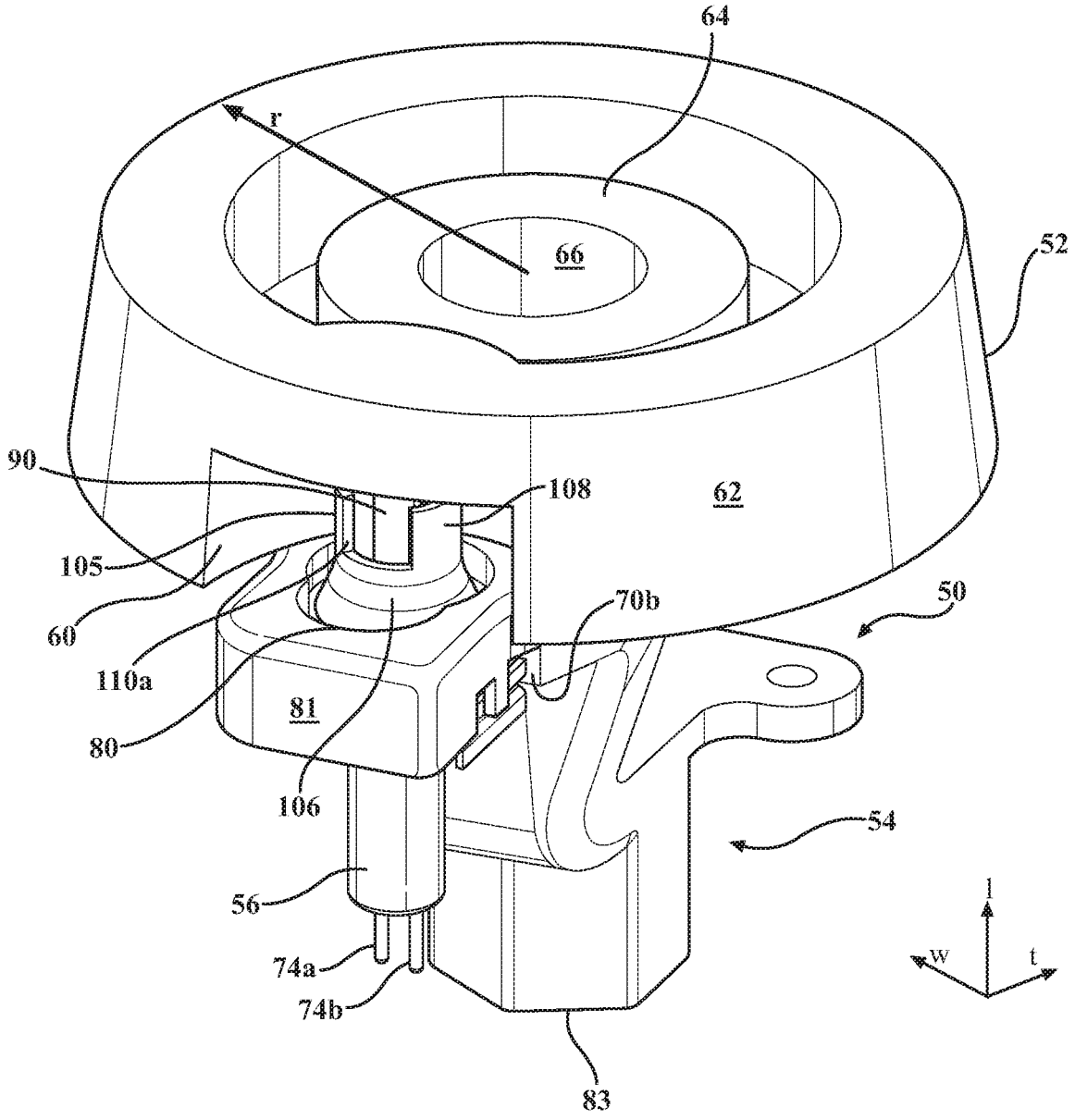
FIG. 2A is a perspective view of an assembled configuration of a second example of a burner assembly comprising a hot surface igniter using a double slit collar to protect the igniter.
Figure 2B:
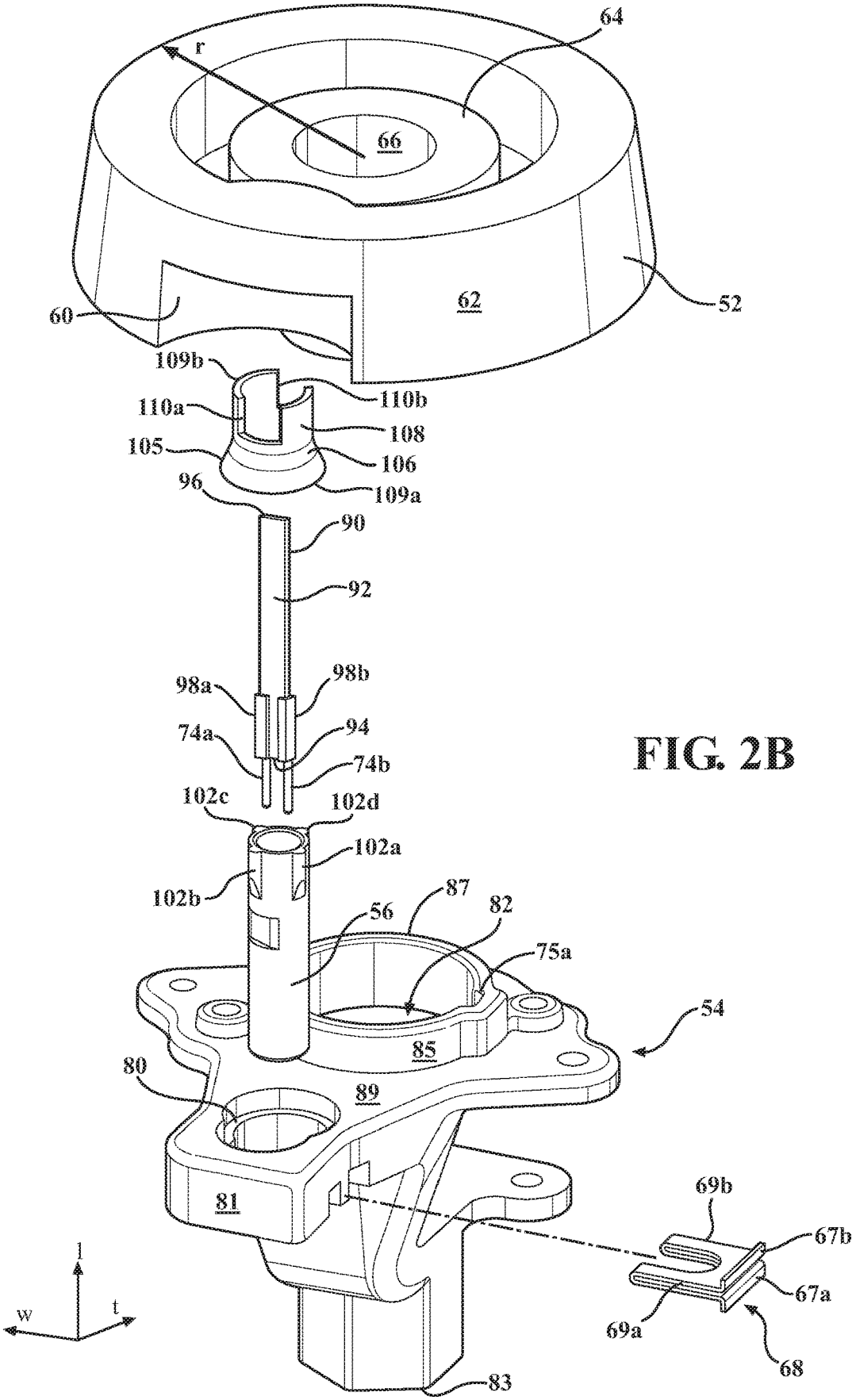
FIG. 2B is an exploded view of the burner assembly of FIG. 2A.
Figure 2C:
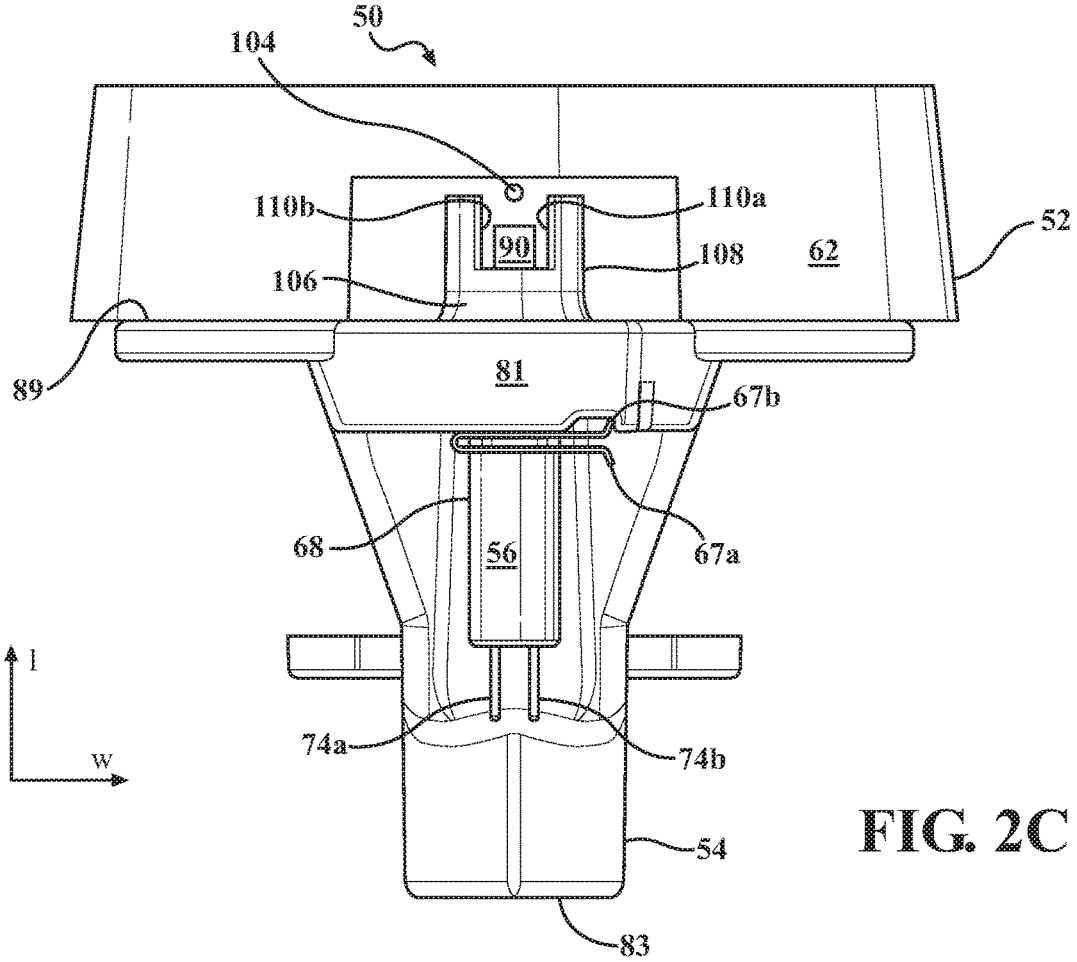
FIG. 2C is a side elevation view of the burner assembly of FIG. 2A.
Figure 2D:
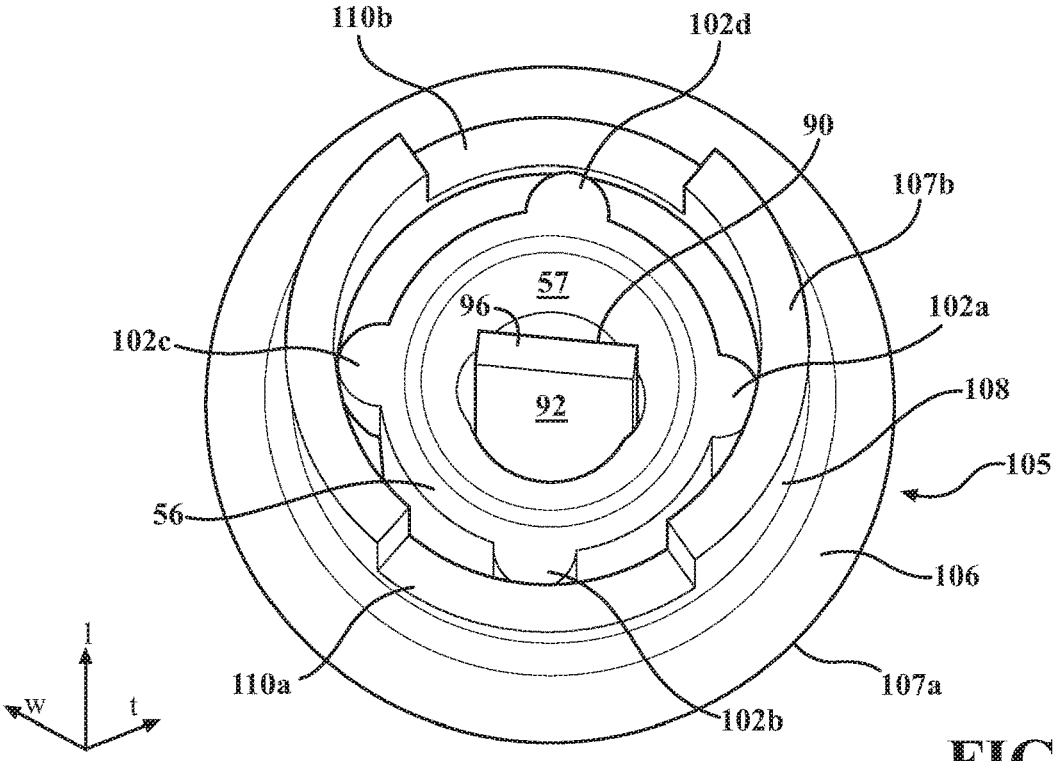
FIG. 2D is a top perspective view of the hot surface igniter assembly of FIG. 2A.
Figure 2E:
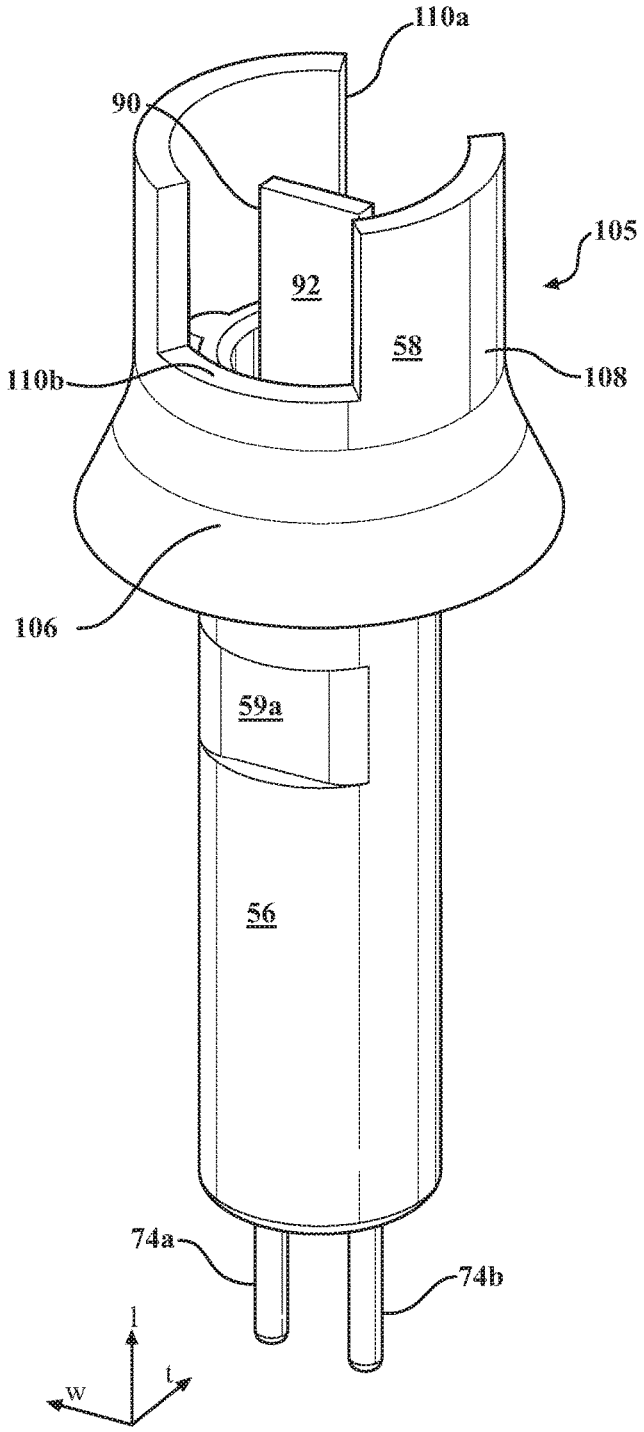
FIG. 2E is a side perspective view of the hot surface igniter assembly of FIG. 2A.
Figure 2F:
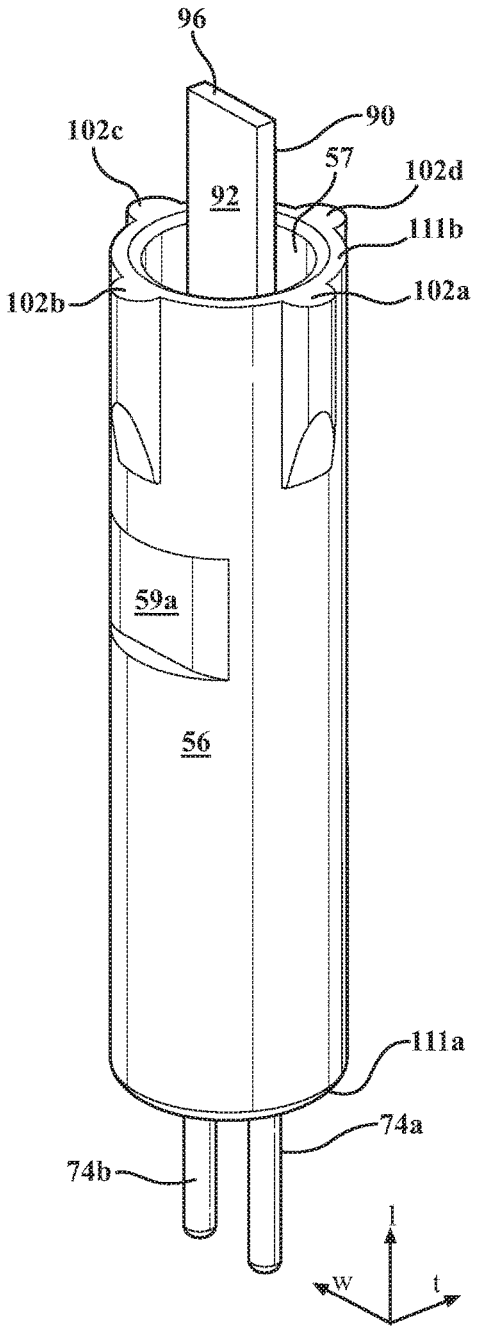
FIG. 2F is a side perspective view of the hot surface igniter assembly of FIG. 2A with the double slit collar removed.
Figure 3A:
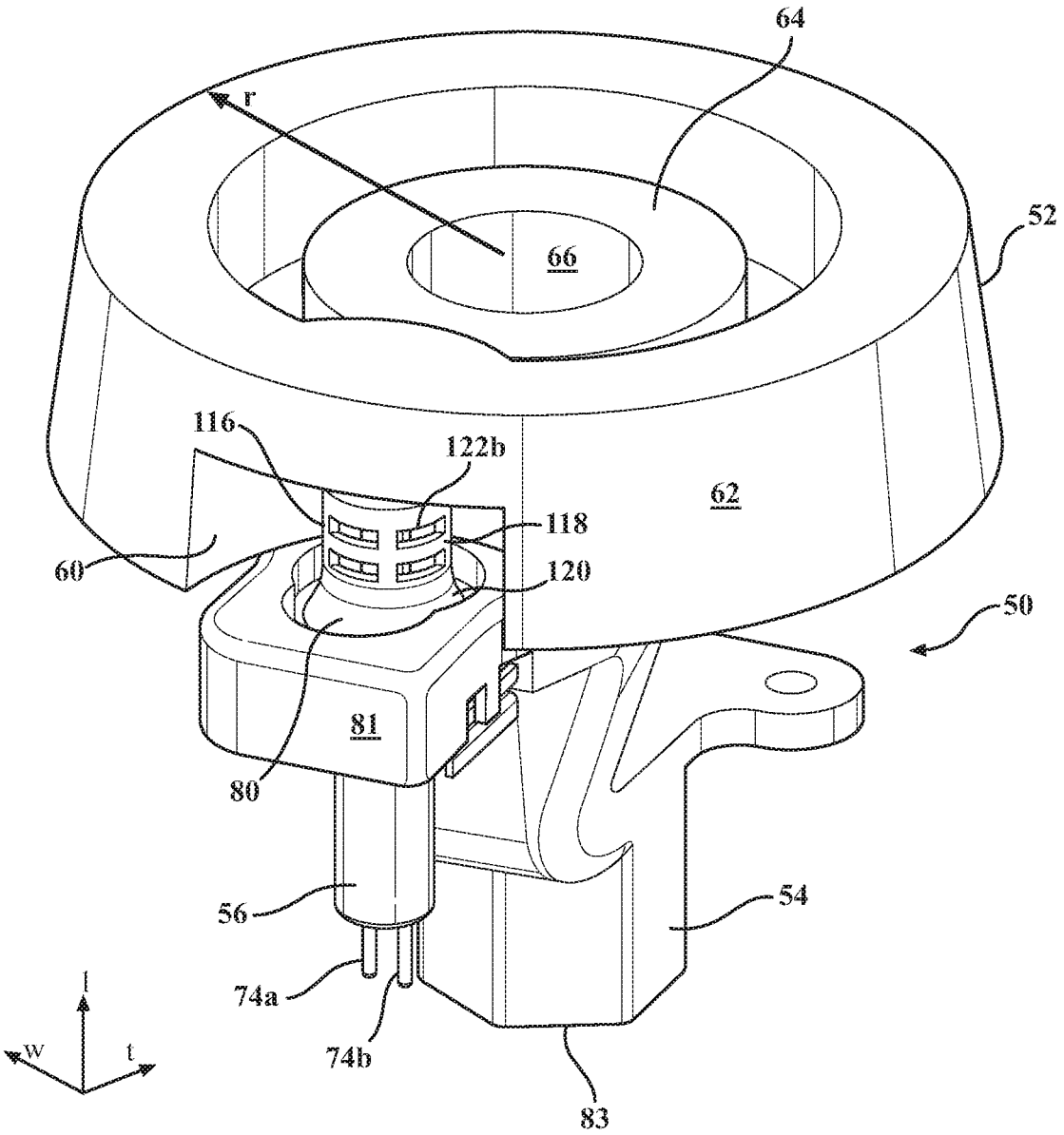
FIG. 3A is a perspective view of an assembled configuration of a third example of a burner assembly comprising a hot surface igniter using a collar cap to protect the igniter.
Figure 3B:
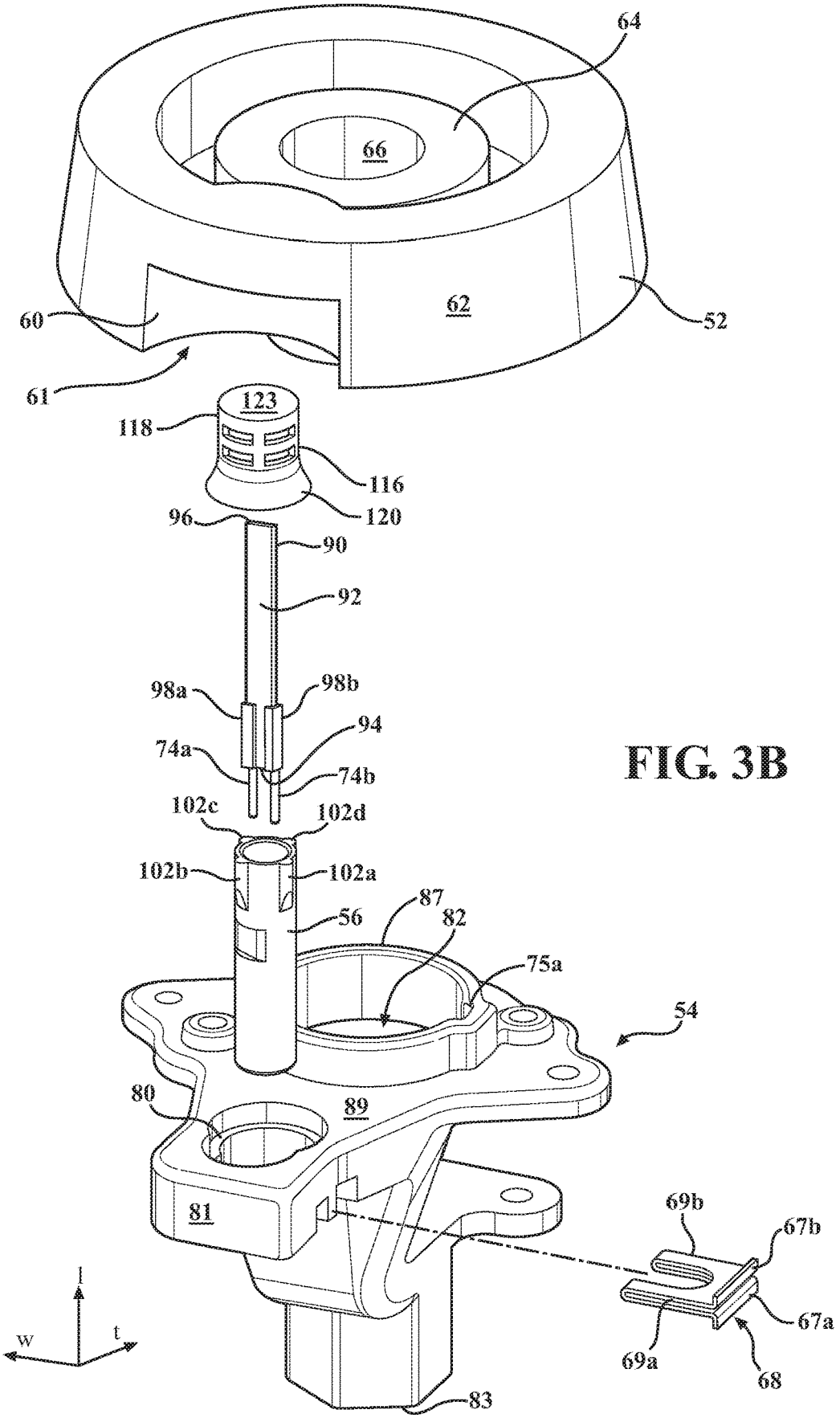
FIG. 3B is an exploded view of the burner assembly of FIG. 3A.
Figure 3C:
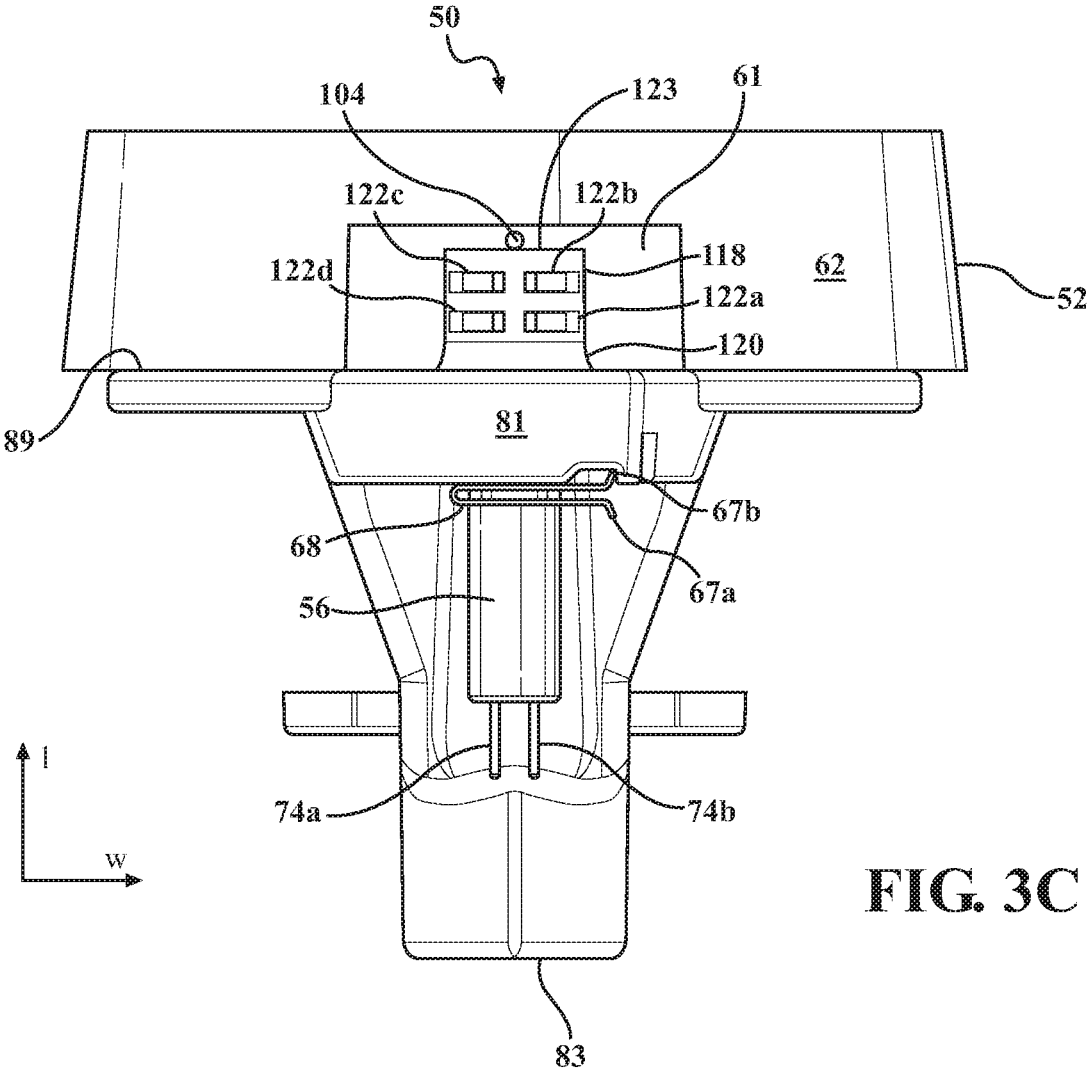
FIG. 3C is a side elevation view of the burner assembly of FIG. 3A.
Figure 3D:
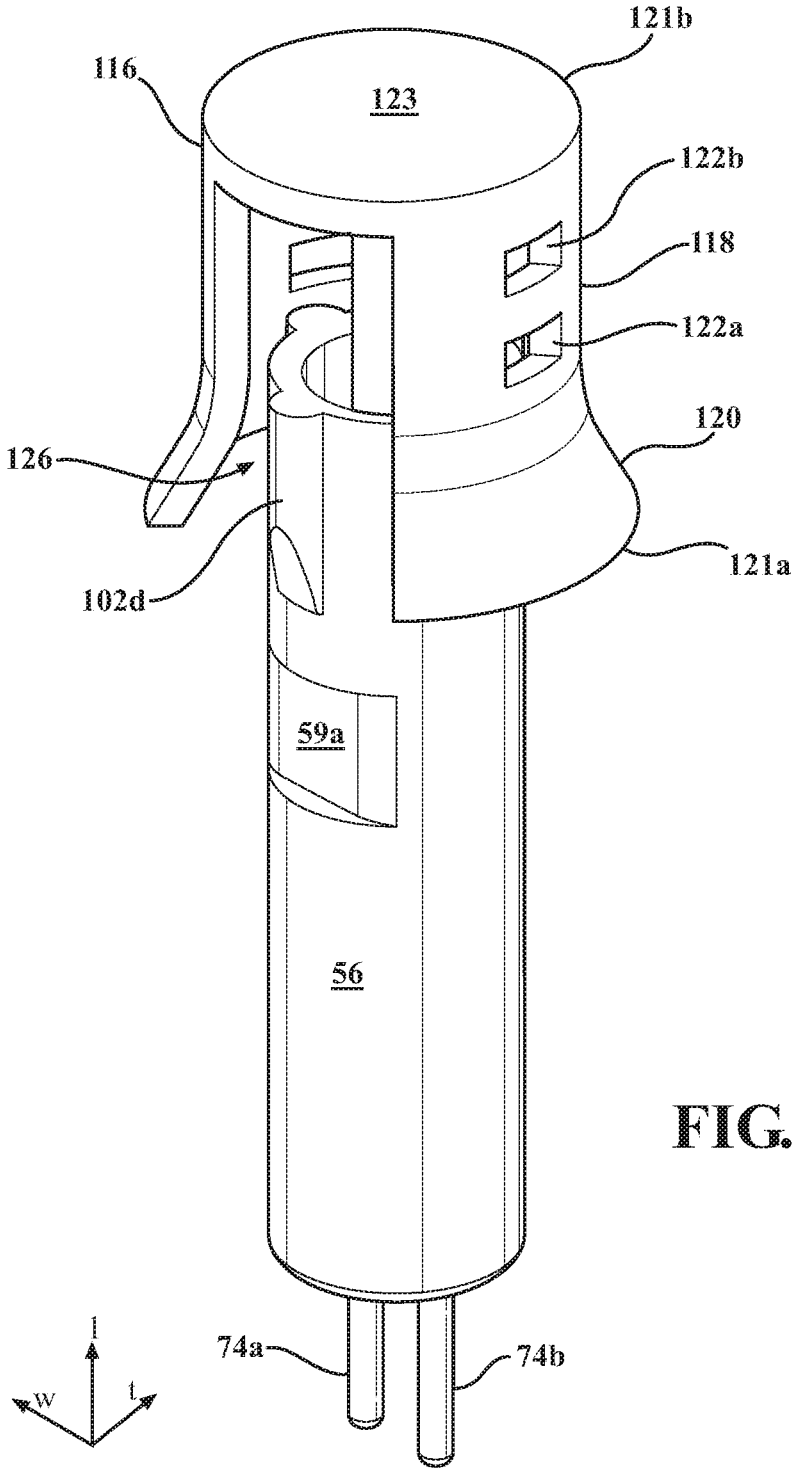
FIG. 3D is a side perspective view of the hot surface igniter assembly of FIG. 3A.

Referring to FIGS. 2A-2F another example of a burner assembly 50 comprising a hot surface igniter 90 is depicted. The igniter 90, crown 52, and orifice holder 54 are the same as in FIGS. 1A-1F. In this example, however, the single slit collar 58 has been replaced with a double slit collar 105. The double slit collar 105 includes a frustoconical proximal section 106 and a distal cylindrical section 108 (FIG. 2E). The distal cylindrical section 108 is cut-out at two diametrically opposing sections 109*a*, 109*b* to create opposing openings 110*a* and 110*b*. The double slit collar 105 is press fit over the nodes 102*a*-102*c* as in the case of the example of FIGS. 1A-1F with the major facets of the igniter body 92 facing a respective one of the openings 110*a* and 110*b*. Again the orientation of the igniter body 92, the insulator flats 59*a* and 59*b* and the retaining clip 68 ensure that one of the major facets of the igniter body 92 is facing the igniter gas port 104.

Referring to FIGS. 3A-3D another example of a burner assembly 50 comprising a hot surface igniter 90 is depicted. The example is the same as the previous examples except that instead of a single or split collar, the insulator assembly includes a collar cap 116 enclosing the distal end of the igniter body 92. Unlike the single slit collar 58 and double slit collar 105, the collar cap 116 is closed at the top 123. The collar cap 116 includes a proximal end 121*a* and distal and 121*b* (FIG. 31) spaced apart along the igniter length axis l. The collar cap 116 comprises a frustoconical proximal section 120 and an adjacent partial cylindrical section 118. A plurality of windows 122*a*, 122*b*, etc. are provided in pairs that are spaced apart circumferentially around the collar cap 116, with each pair member (such as 122*a* and 122*b*) being spaced apart along the igniter length axis l. The split frustoconical section 120 and distal section 118 define an opening 126 aligned with the width of one of the major facets of the igniter 92 body. As with the previous examples, opening 126 is preferably at least as wide as the igniter body 92 to allow cooking gas to readily reach the igniter body 92. The collar cap 116 is press fit to the nodes 102*a*-102*c* of the insulator 56 as with the previous examples.

Figure 4A:
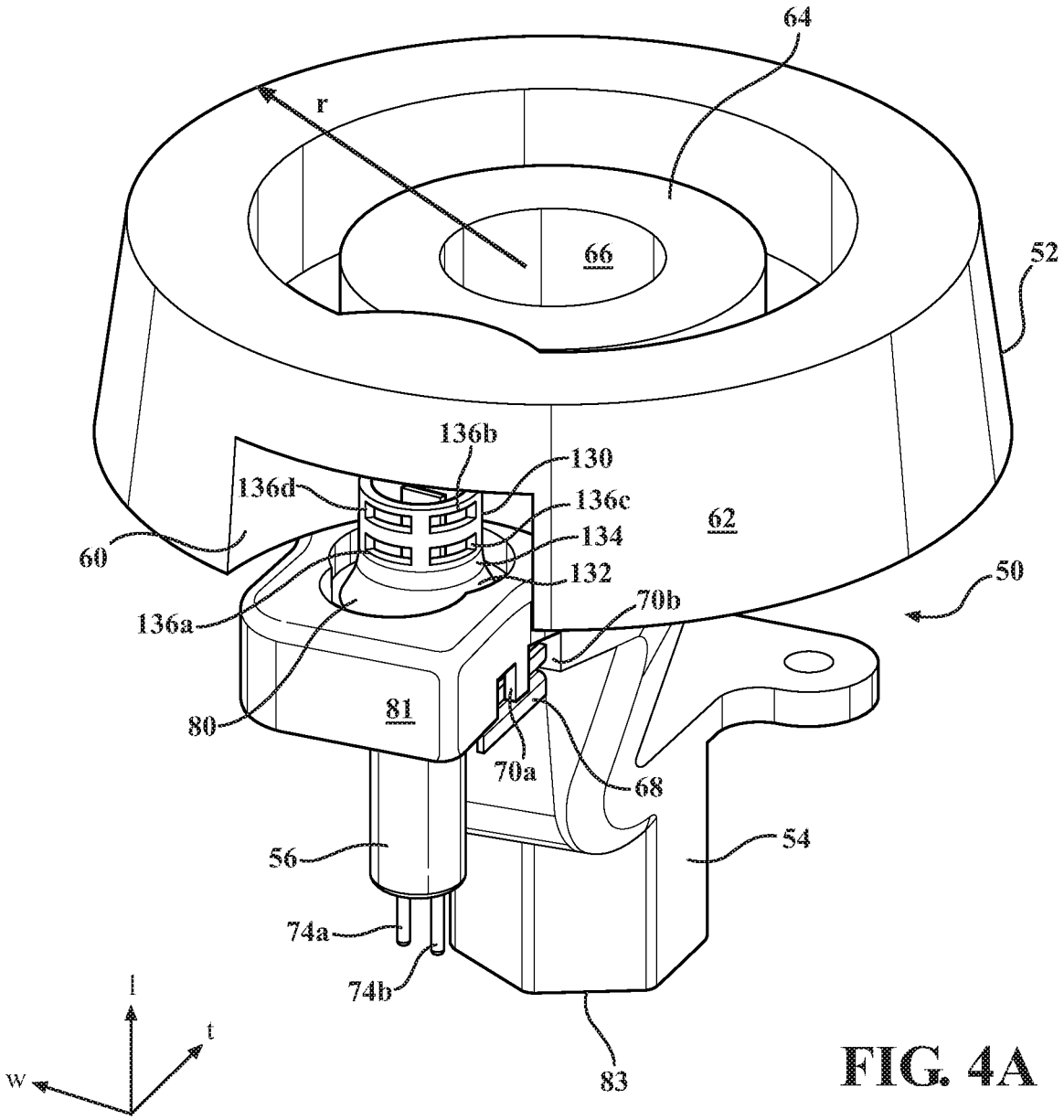
FIG. 4A is a perspective view of an assembled configuration of a fourth example of a burner assembly comprising a hot surface igniter using a collar cage to protect the igniter.
Figure 4B:
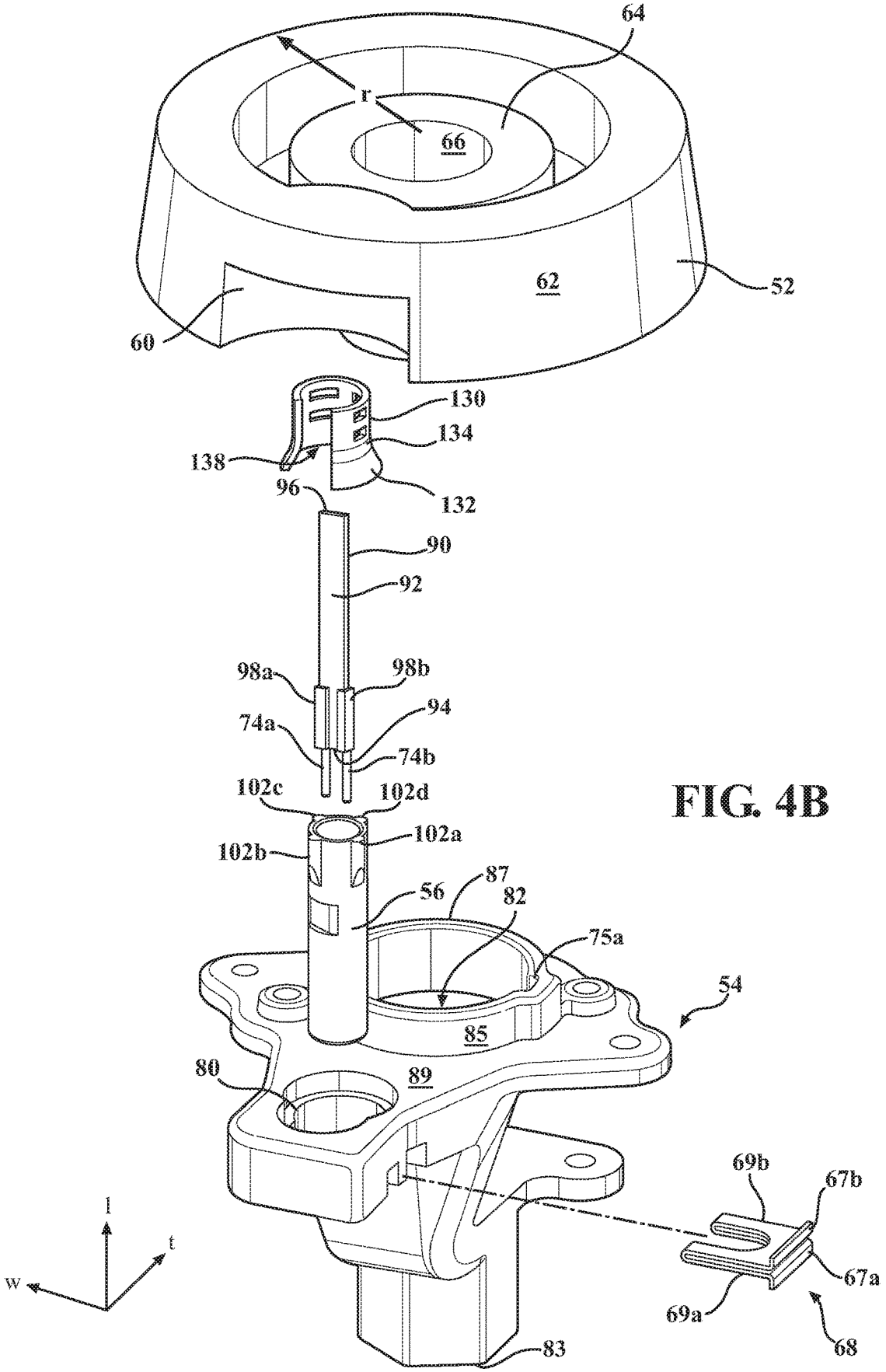
FIG. 4B is an exploded view of the burner assembly of FIG. 4A.
Figure 4C:
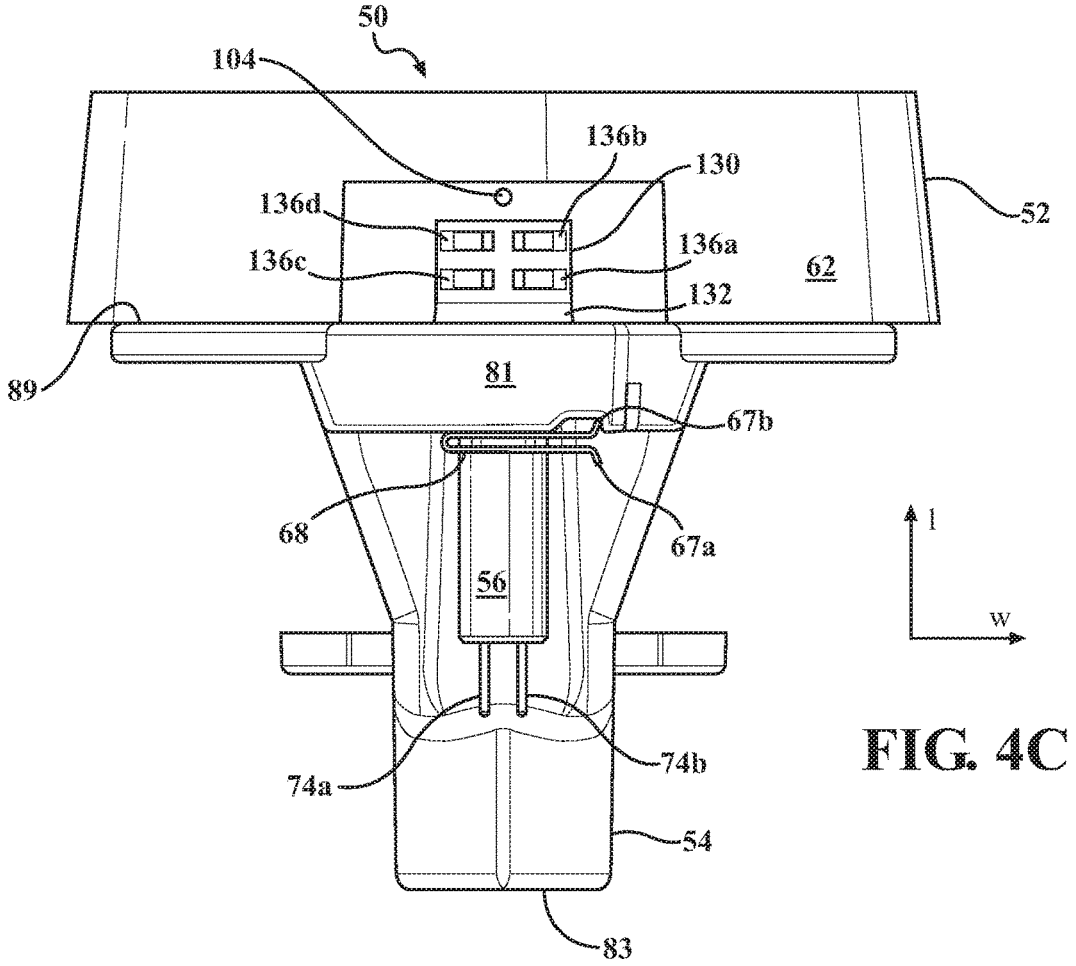
FIG. 4C is a side elevation view of the burner assembly of FIG. 4A.
Figure 4D:
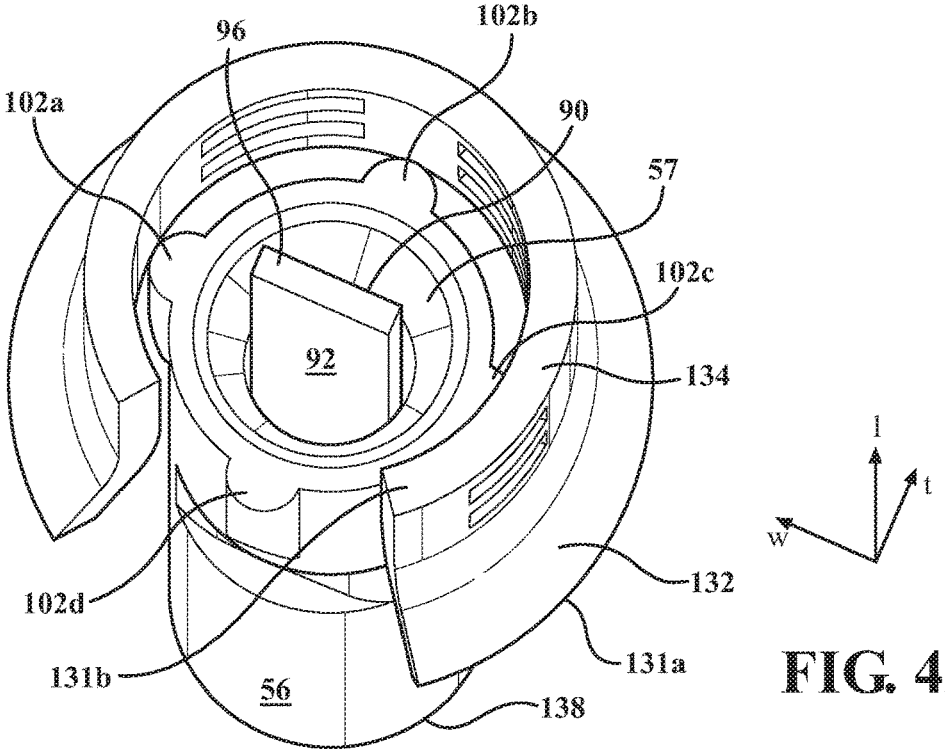
FIG. 4D is a top perspective view of the hot surface igniter assembly of FIG. 4A.
Figure 4E:
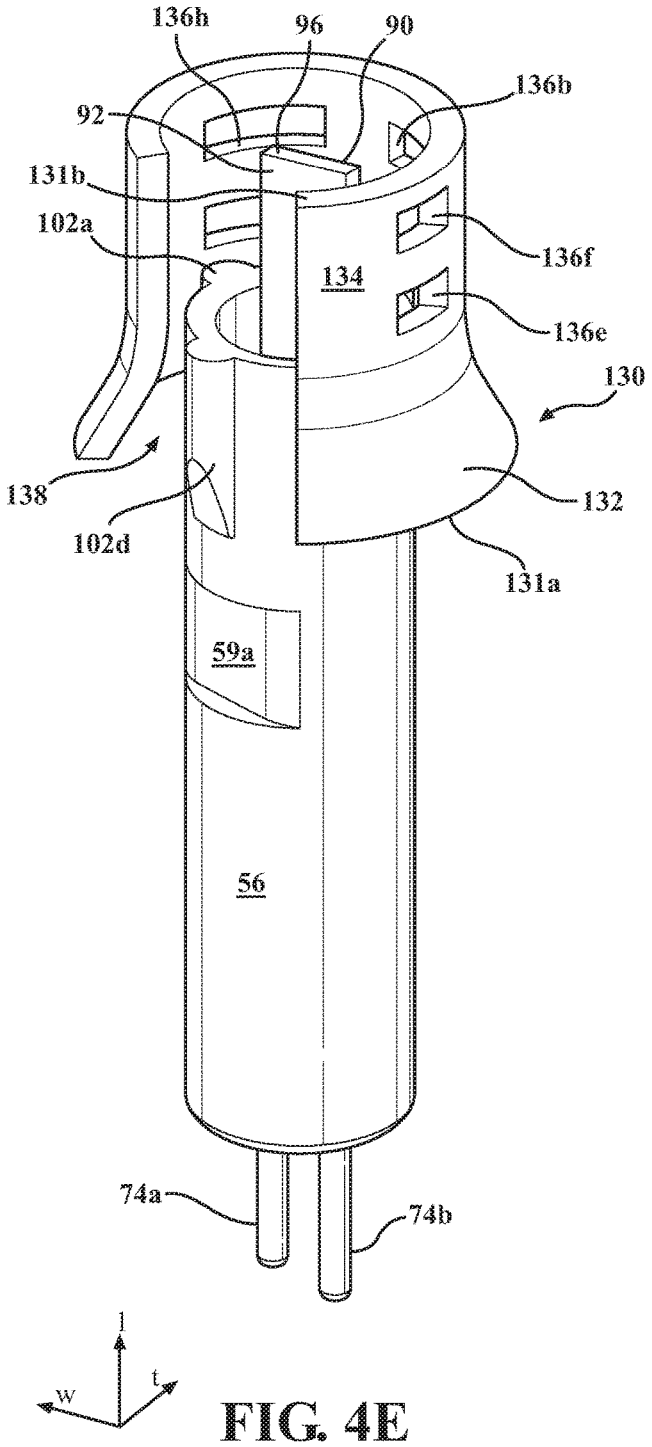
FIG. 4E is a side perspective view of the hot surface igniter assembly of FIG. 4A.
Figure 4F:
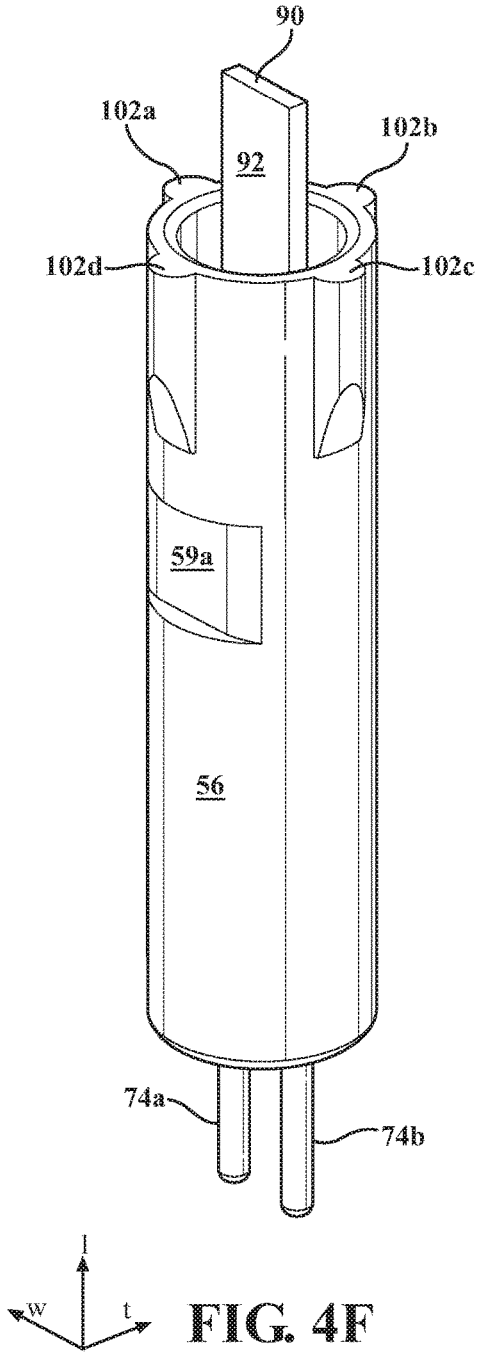
FIG. 4F is a side perspective view of the hot surface igniter assembly of FIG. 4A with the collar cage removed.

FIGS. 4A-4E depict another example of a burner assembly 50 similar to those of FIGS. 1A-3D. However, a collar cage 130 is used to partially enclose the distal end of the igniter body 92 instead of the previous devices. The collar cage 130 is similar to the collar cap 116 of the previous example except it is open at the top. As best seen in FIG. 4E, collar cage 130 includes a proximal frustoconical section 132 and an adjacent cylindrical section 134. The frustoconical section 132 and cylindrical section 134 are each split to define an opening 138 extending from the proximal end 131*a* to the distal end 131*b* of the collar cage 130. A plurality of windows 136*a*-136*h* are provided in pairs arranged circumferentially around the distal cylindrical section 134 (only 136*b*, 136*e*, 136*f*, and 136*h*) are shown. The collar cage 130 is press fit to nodes 102*a*-102*c* so that opening 138 is aligned with a major facet of igniter body 92 as described in the previous examples.

Referring to FIGS. 5A-5F, another example of a burner assembly 50 comprising a hot surface igniter 90 is depicted. The example is similar to the previous ones except that instead of a single slit collar 58, double slit collar 105, collar cap 116, or collar cage 130, the insulator assembly includes a spring cage 140 to protect the distal 96 of igniter body 92. Insulator 56 is slightly modified to include a flange 147 (FIG. 5E) against which the proximal end 143*a* of spring cage 140 is seated. The spring cage 140 is helical and defines a plurality of adjacent open spaces 142 (FIG. 5D) arranged along the igniter length axis l. The spring cage distal end 143*b* extends distally from the distal end 96 of igniter body 92. In addition, a radial bar 148 (FIG. 5D), or flat cap (not shown) extends across the diameter of the spring distally from the top surface 96 of the igniter to protect the top surface 96 from damage. The spring cage 140 is not split, but the open areas between spring coils along the length axis/allow cooking gas to reach the major facet of the igniter body 92 facing the crown igniter gas port 104.

Figure 6A:
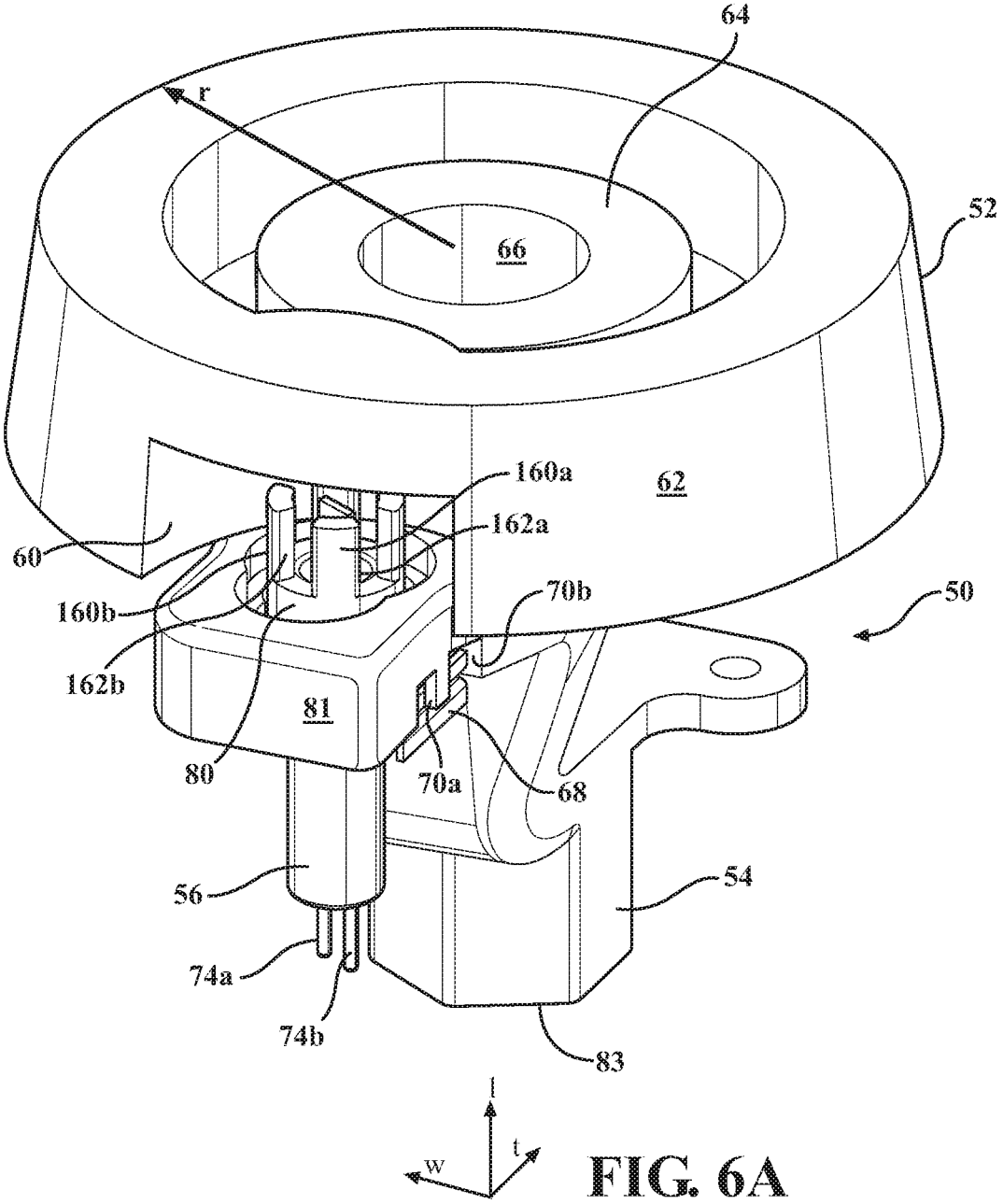
FIG. 6A is a perspective view of an assembled configuration of a sixth example of a burner assembly in which an insulator is configured like a four post chessboard rook figure to protect the igniter.
Figure 6B:
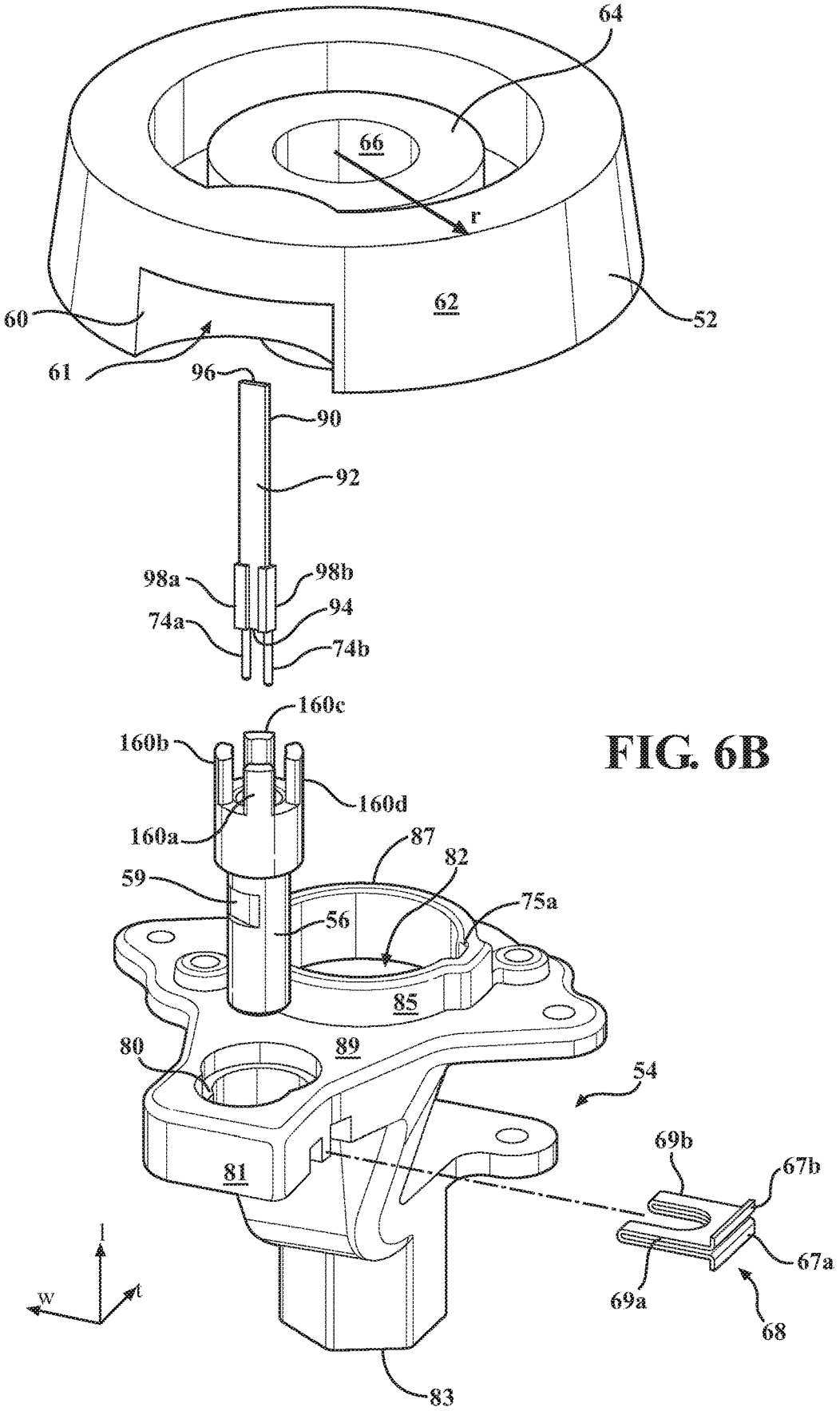
FIG. 6B is an exploded view of the burner assembly of FIG. 6A.
Figure 6C:
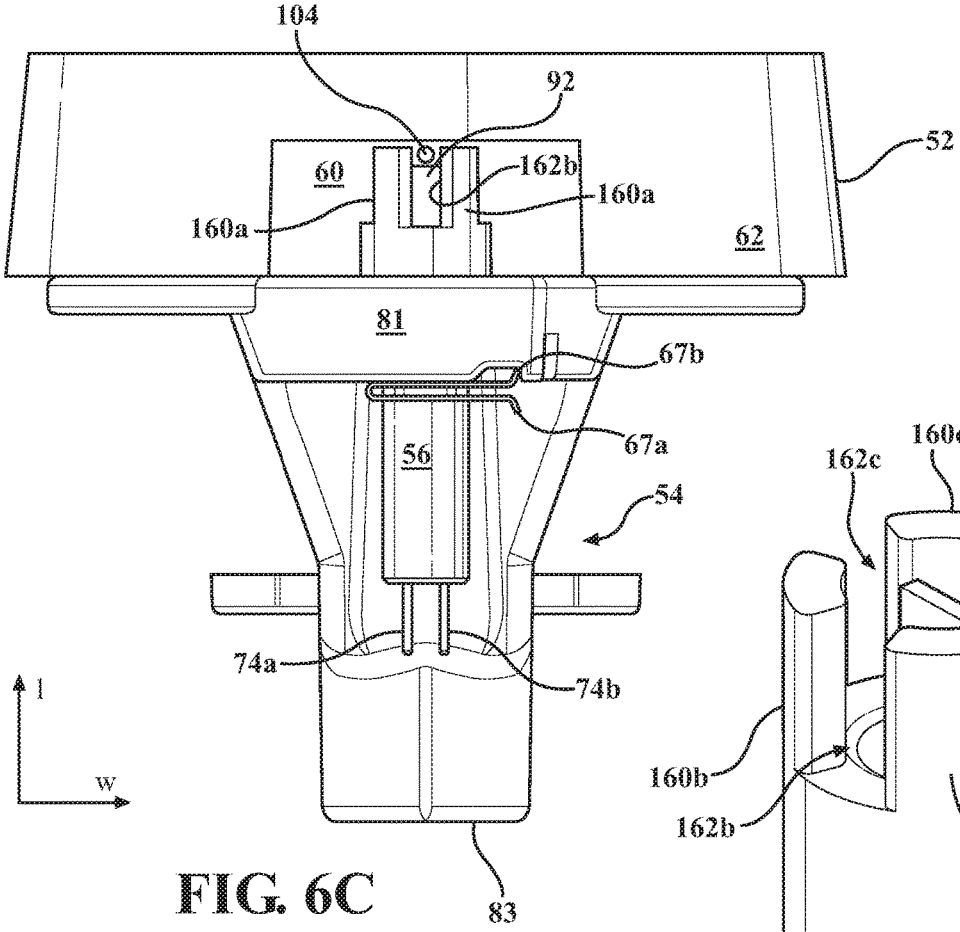
FIG. 6C is a side elevational view of the burner assembly of FIG. 6A.
Figure 6D:
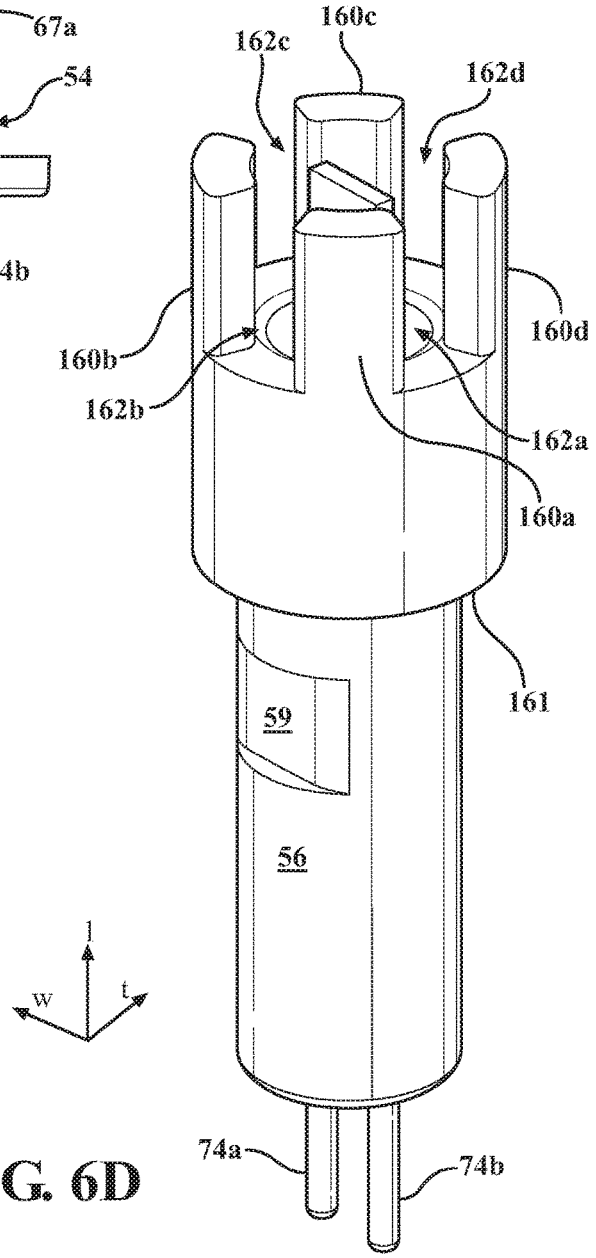
FIG. 6D is a top perspective view of the hot surface igniter assembly of FIG. 6A.

Referring to FIGS. 6A-6D, another example of a burner assembly 50 comprising a hot surface igniter 90 is depicted. Unlike the previous examples, in this one the insulator 56 is itself configured to protect the distal end 96 of the igniter body 92 while still providing access to cooking gas. As best seen in FIG. 6D, the insulator 56 looks like the rook piece from a chess game, with a plurality of axially extending projections 160*a*-160*d* arranged circumferentially and spaced apart from one another to create a plurality of openings 162*a*-162*d* that are arranged in the same way. The distal section of the insulator 56 is radially larger than the proximal section creating a bottom face 161 (FIG. 6D) that seats against a step in the counterbored hole 80 in the igniter mounting bracket 81 of orifice holder 54. The flats 59*a* and 59*b* engage retaining clip 68 to ensure that one of the major facets of the igniter body 92 is aligned with either opening 162*b* or 162*d* (FIG. 6D) and also with the igniter gas port 104 in crown 52.

Figure 7A:
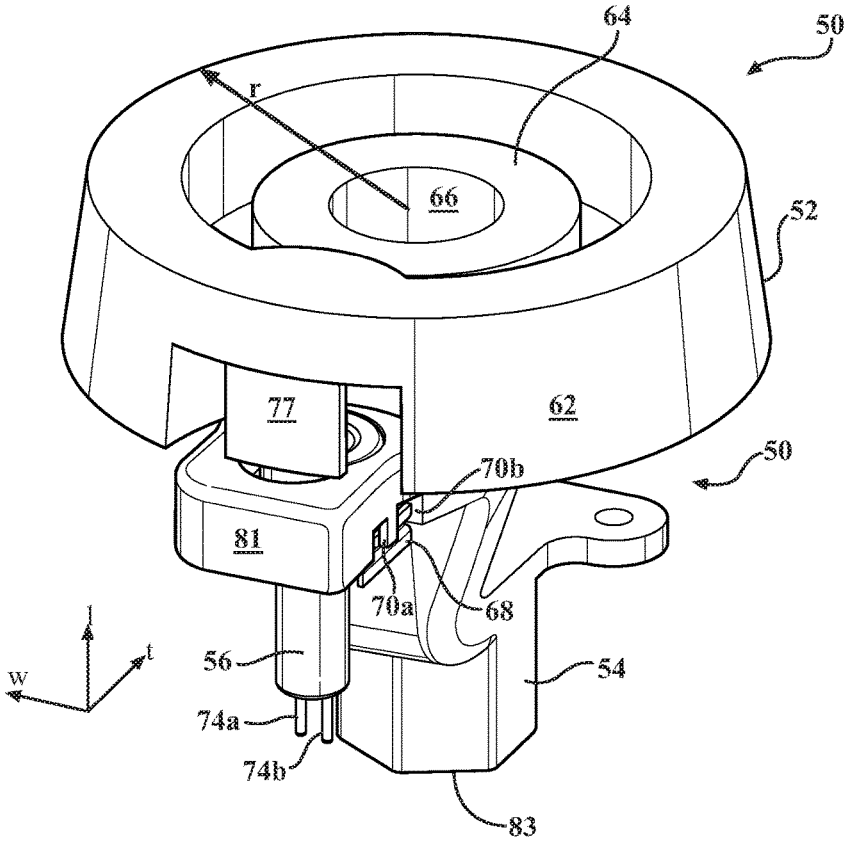
FIG. 7A is a perspective view of an assembled configuration of a seventh example of a burner assembly comprising a hot surface igniter in which the crown includes a shield to protect the igniter.
Figure 7B:
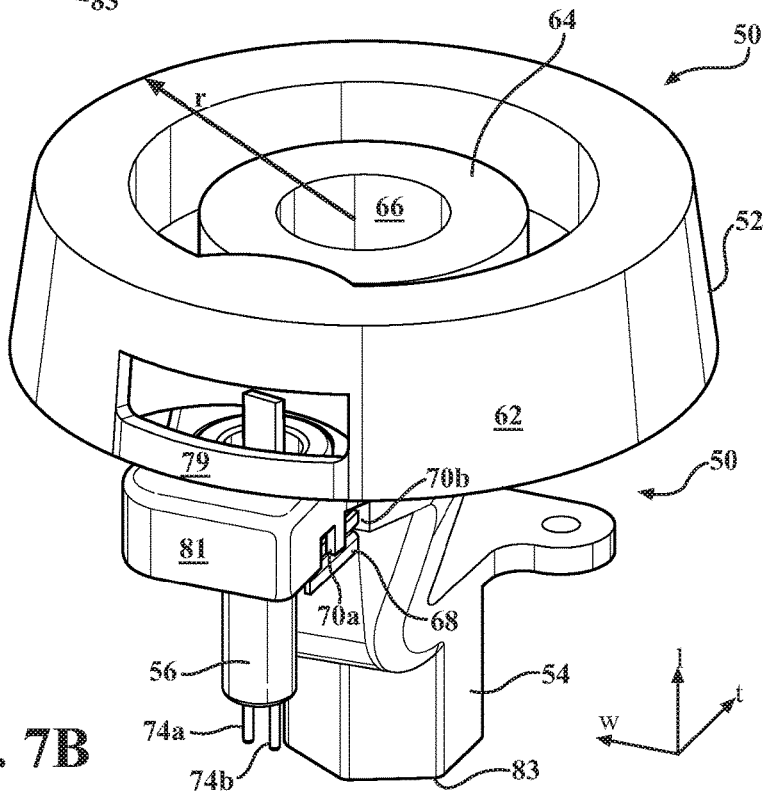
FIG. 7B is a perspective view of an assembled configuration of an eighth example of a burner assembly comprising a hot surface igniter in which the crown includes a shield to protect the igniter.
Figure 7C:
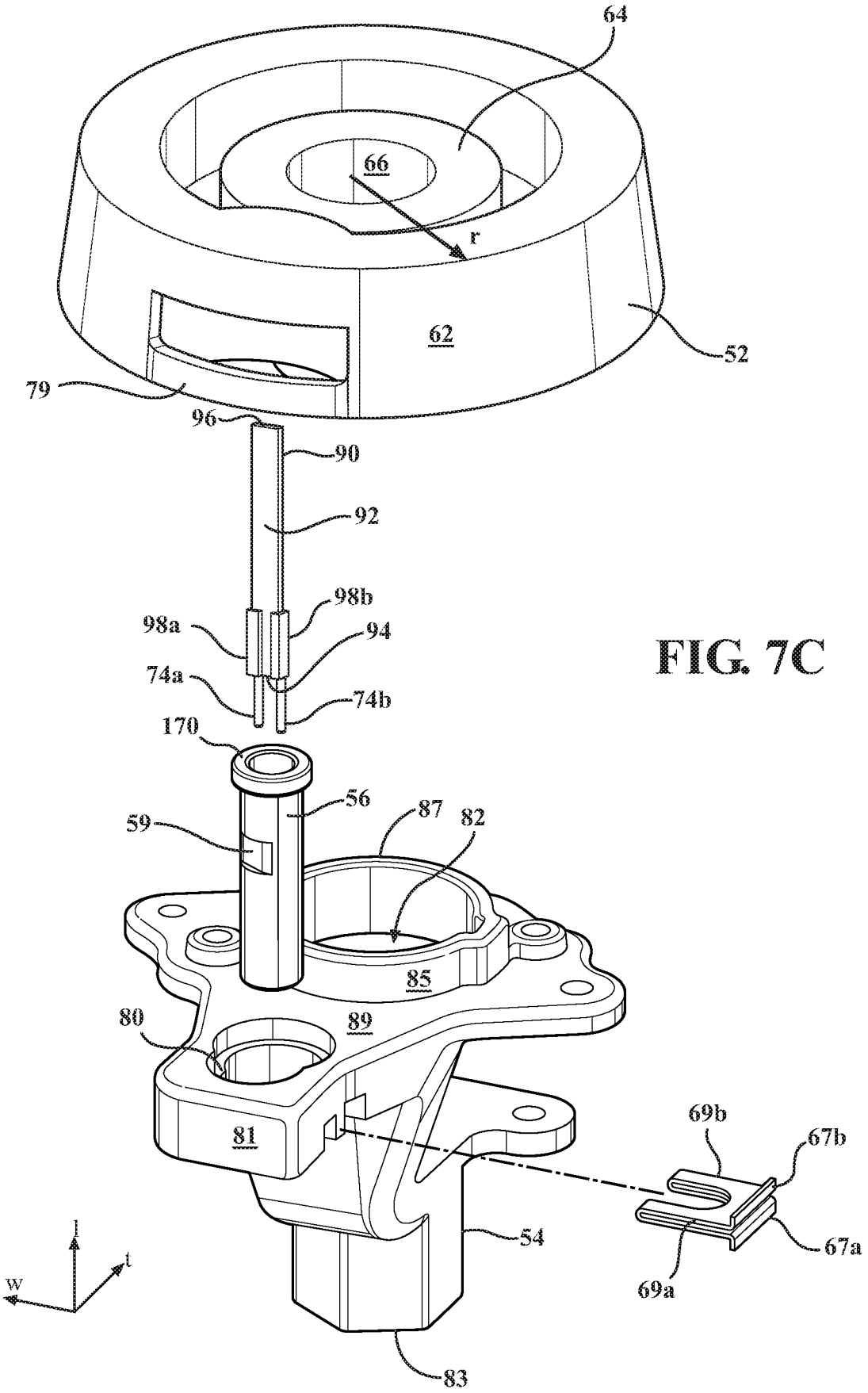
FIG. 7C is an exploded view of the burner assembly of FIG. 7B.
Figure 7D:
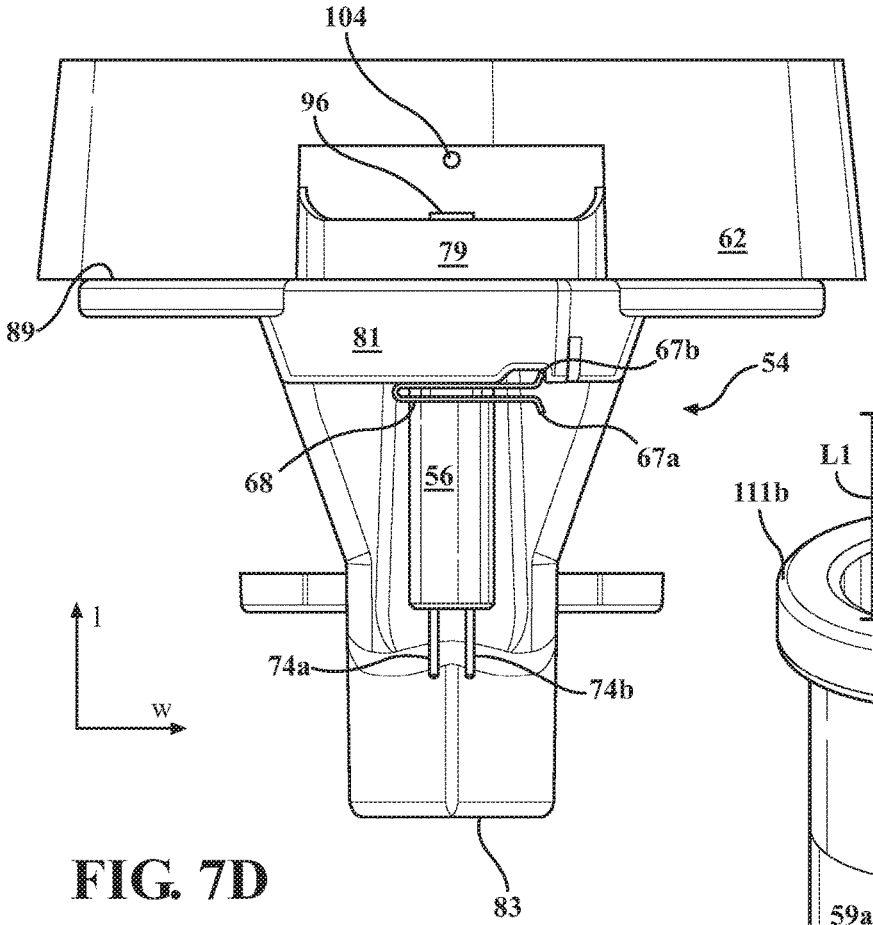
FIG. 7D is a side elevation view of the burner assembly of FIG. 7B.
Figure 7E:
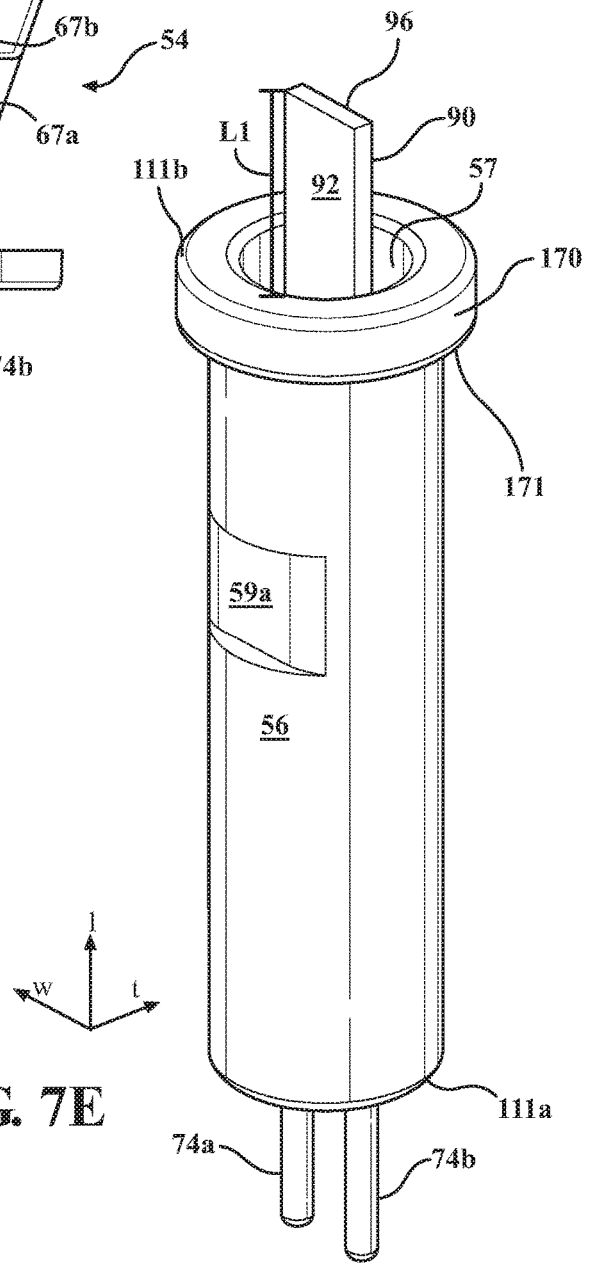
FIG. 7E is a side perspective view of the hot surface igniter assembly of FIGS. 7A and 7B.
Figure 7F:
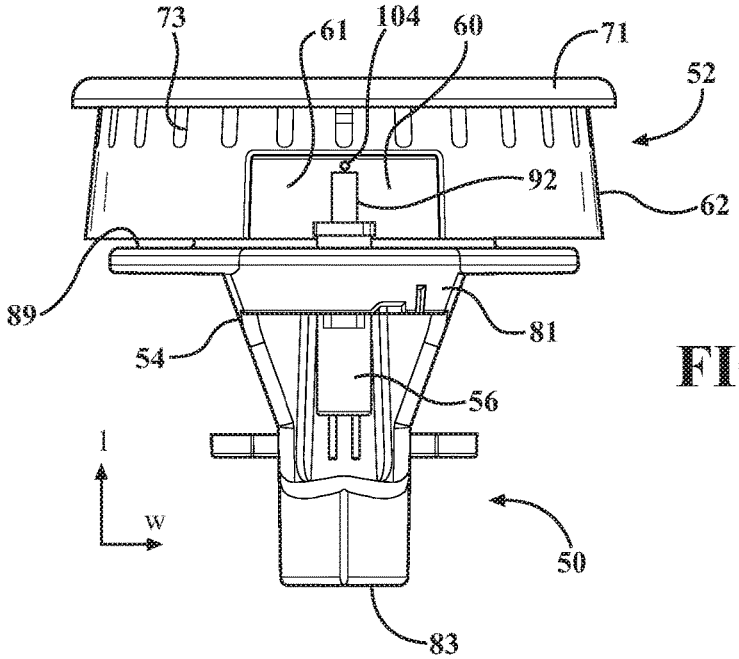
FIG. 7F is a side elevational view of an assembled configuration of a ninth example of a burner assembly comprising a hot surface igniter in which a hot surface igniter assembly is located in a burner crown recess to protect the igniter.
Figure 7G:
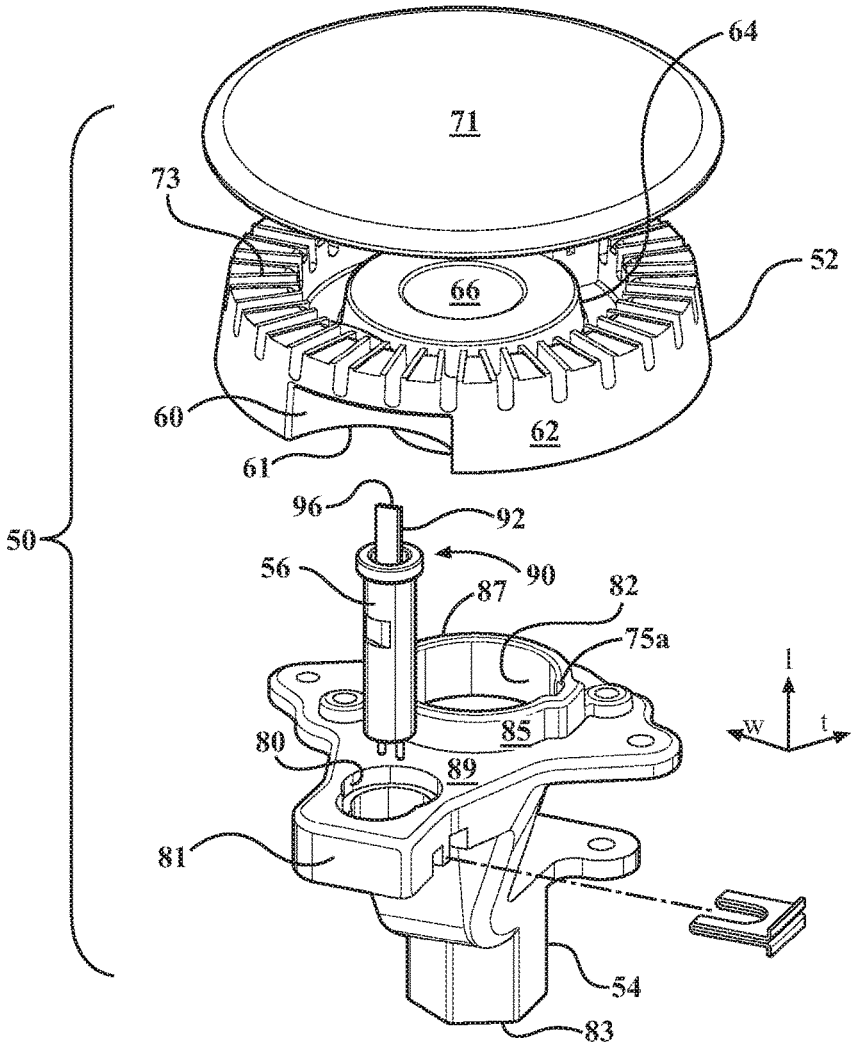
FIG. 7G is an exploded view of the burner assembly of FIG. 7F.

Referring to FIGS. 7A and 7B, burner assemblies are shown in which the crown 52 is configured to protect the distal end 96 of the igniter body 92. Referring to FIG. 7A, crown 52 includes a shield 77 blocking the portion of crown recess 61 (FIG. 5E) behind which the igniter distal end 96 sits. In FIG. 7A, the shield 77 extends along the entire length of the recess 61 along the igniter length axis l. In FIG. 7B, shield 79 is provided and extends along the entire circumferential length of the recess 61 but is open along a distal section of the recess 61 along the igniter length axis. FIGS. 7C-7E show further details of the burner assembly 50 of FIG. 7B, which is similar to the previous embodiments except for crown shield 79 and the distal section of insulator 56. As best seen in FIG. 7E, because there is no separate protective enclosure, the insulator nodes 102*a*-102*d* needed for press fit engagement of such enclosures are not required. Instead, a distal end flange 170 (FIG. 7E) extends radially outward and provides a bottom face 171 that seats against a step in counterbored hole 80 in orifice holder 54.

In certain examples, a shield is not required to block access to the crown recess 61. Referring to FIGS. 7F and 7G, burner assembly 50 comprises a crown 52 with a plurality of circumferential flutes 73 (only one is identified with a reference numeral). The flutes act as orifices through which cooking gas exits to mix with air and combust. Crown 52 includes a radially outer wall 62 and a radially inner wall 64. A cap 71 sits atop crown 52 and diverts cooking gas outward in the radial direction through flutes 73.

Radially outer wall 62 includes a concave section 60 that defines recess 61. The igniter assembly comprising insulator 56 and igniter 90 is partially located in recess 61, preferably, such that the igniter ceramic body 92 is radially inward of crown radially outer wall 62 so that users do not inadvertently contact the igniter body 92. The hot surface igniter 90 and insulator 56 are seated within the orifice holder 54 counterbored hole 80 in the same manner as in FIGS. 7A-7E.

In certain examples, the crown recess 61, and the protective enclosures around the distal end of the igniter (e.g., the four-posts 160*a*-*e* integrally formed with insulator 56, the single slit collar 58, the double slit collar 105, collar cap 116, the collar cage 130, the spring cage 140, and the shield 77) cause the pooling of combustion gas entering recess 61 from gas igniter port 104 and contribute to the faster formation of a combustible mixture, i.e., a mixture of cooking gas and air that is between the upper and lower explosive limits for the selected gas. Also, in preferred examples, the igniter gas port 104 has a direct an unimpeded path to the igniter such that one could draw a vector at port 104 and have it intersect the igniter 90. In certain examples, a vector perpendicular to a surface of the igniter 90 would intersect the igniter gas port 104.

In accordance with certain examples of burner assemblies herein, the burner assembly 50 is configured so that the hot surface igniter assembly can be selectively and wirelessly connected to a power source by inserting the igniter 90 into an insulator. Referring to FIGS. 8A-8G a first example of such a burner assembly 50 is depicted. The assembled configuration of burner assembly 50 is shown in FIG. 8E. The igniter 90 is as depicted previously except that the proximally extending connectors 74*a* and 74*b* are not provided. Insulator 180 is provided and is a generally cylindrical structure with a cavity 187 (FIG. 8B) sized to receive the igniter 90. Insulator 180 has a proximal end 182*a* and distal end 182*b* spaced apart along the igniter length axis l such that a distal portion of the igniter body 92 extends distally of the distal end 182*b* of the insulator 180 along the igniter length axis l. The proximal section of the insulator 180 includes openings 184*a* and 184*b* (not shown) which are diametrically spaced apart from one another. The openings 184*a* and 184 provide access to the interior cavity 187 of the insulator 180. Two connectors 188*a* and 188*b* (FIG. 8E) are formed from an electrically conductive material and are attached to the insulator 180 diametrically opposite one another. Connector 188*a* includes a distal section that is partially cylindrical and which includes an opening 194*a*. A flexible tab 196*a* extends into the opening 194*a* and projects in the radially inward direction of insulator 180 (and along the igniter width axis w). The proximal section of connector 188*a* is terminal 190*a* that extends proximally of the proximal insulator end 182*a* along the igniter length axis l. Connector 188*b* is mirror image of connector 188*a*. Prior to the insertion of igniter 90 in cavity 187, the tabs 196*a* and 196*b* extend radially into cavity 187. As best seen in FIG. 8F, insertion of igniter 90 in the proximal direction along the igniter length axis l causes the external igniter leads 98*a* and 98*b* (FIG. 8C) to engage and make electrical contact with tabs 196*a* and 196*b* such that the igniter 90 is supplied with power when the terminals 190*a* and 190*b* are in electrical communication with a source of power. This structure avoids the need for separate connectors 74*a* and 74*b* extending from the igniter body 92.

Figure 8A:
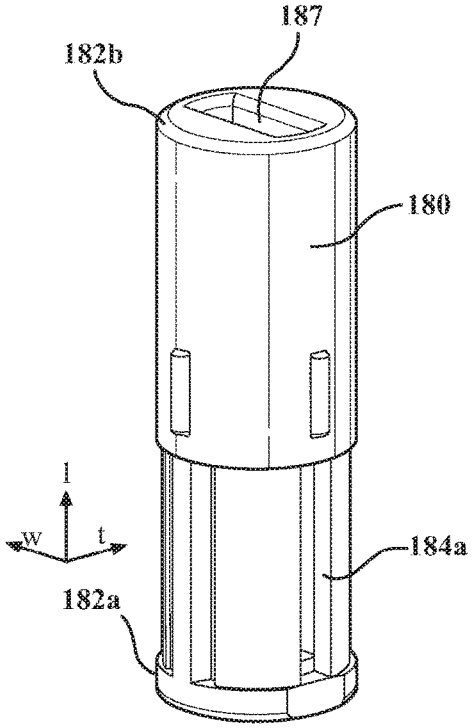
FIG. 8A is a side elevation view of an insulator used in the burner assembly of FIG. 8E.
Figure 8B:
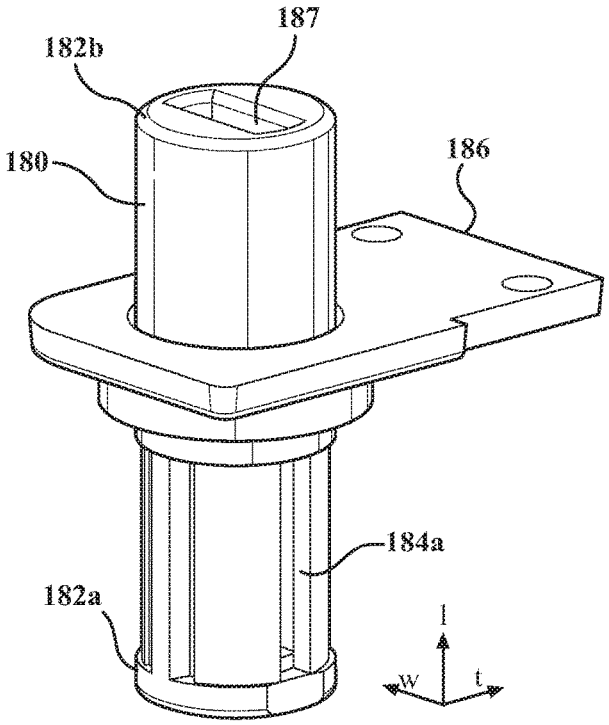
FIG. 8B is a side elevation view of the insulator and attachment plate of the burner assembly of FIG. 8E.
Figure 8C:
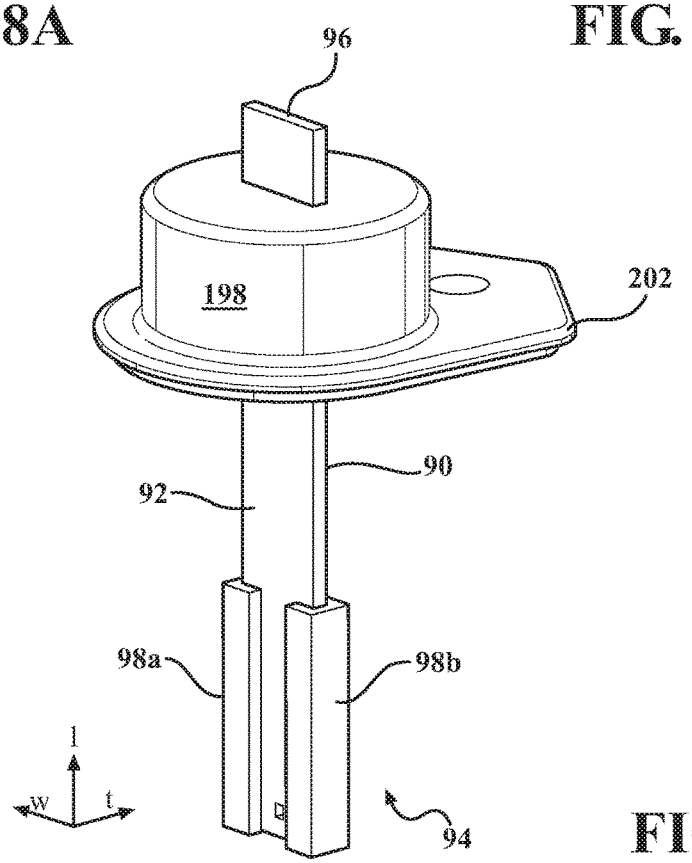
FIG. 8C is the hot surface igniter and cap of the burner assembly of FIG. 8E.
Figure 8D:
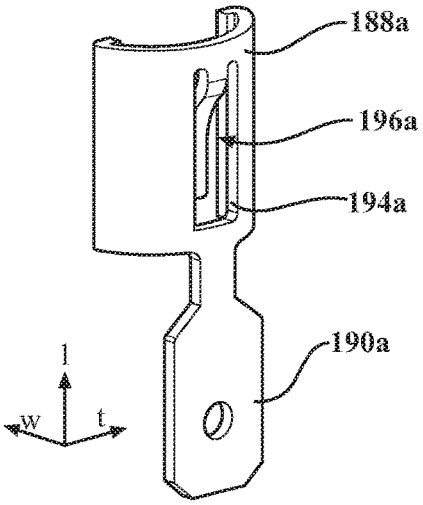
FIG. 8D is a perspective of the hot surface igniter electrical connector of the burner assembly of FIG. 8E.
Figure 8E:
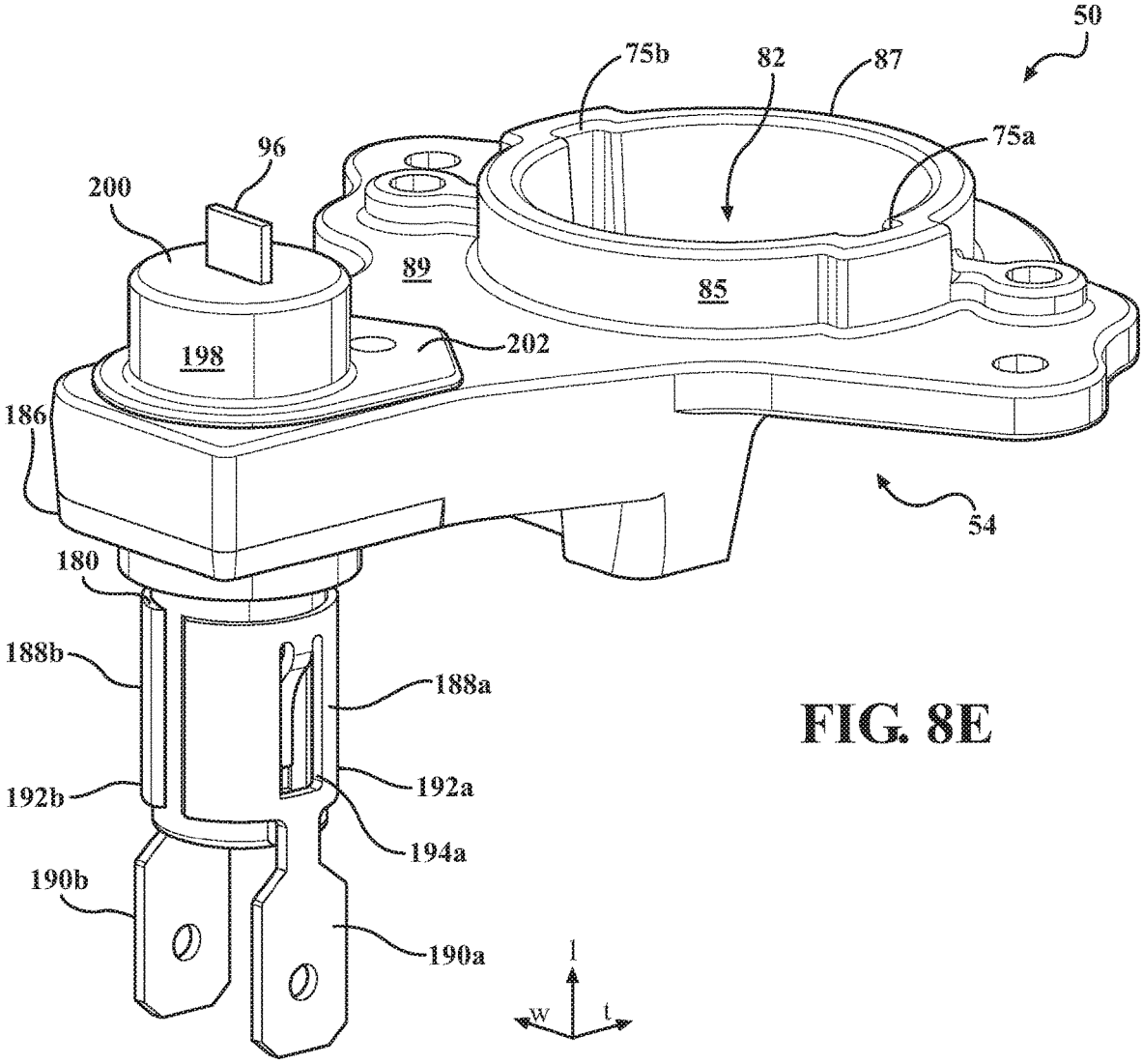
FIG. 8E is a perspective view of an assembled configuration of a tenth example of a burner assembly comprising a hot surface igniter with a protective cap in which the igniter is removably connected to an wireless electrical connector.
Figure 8F:
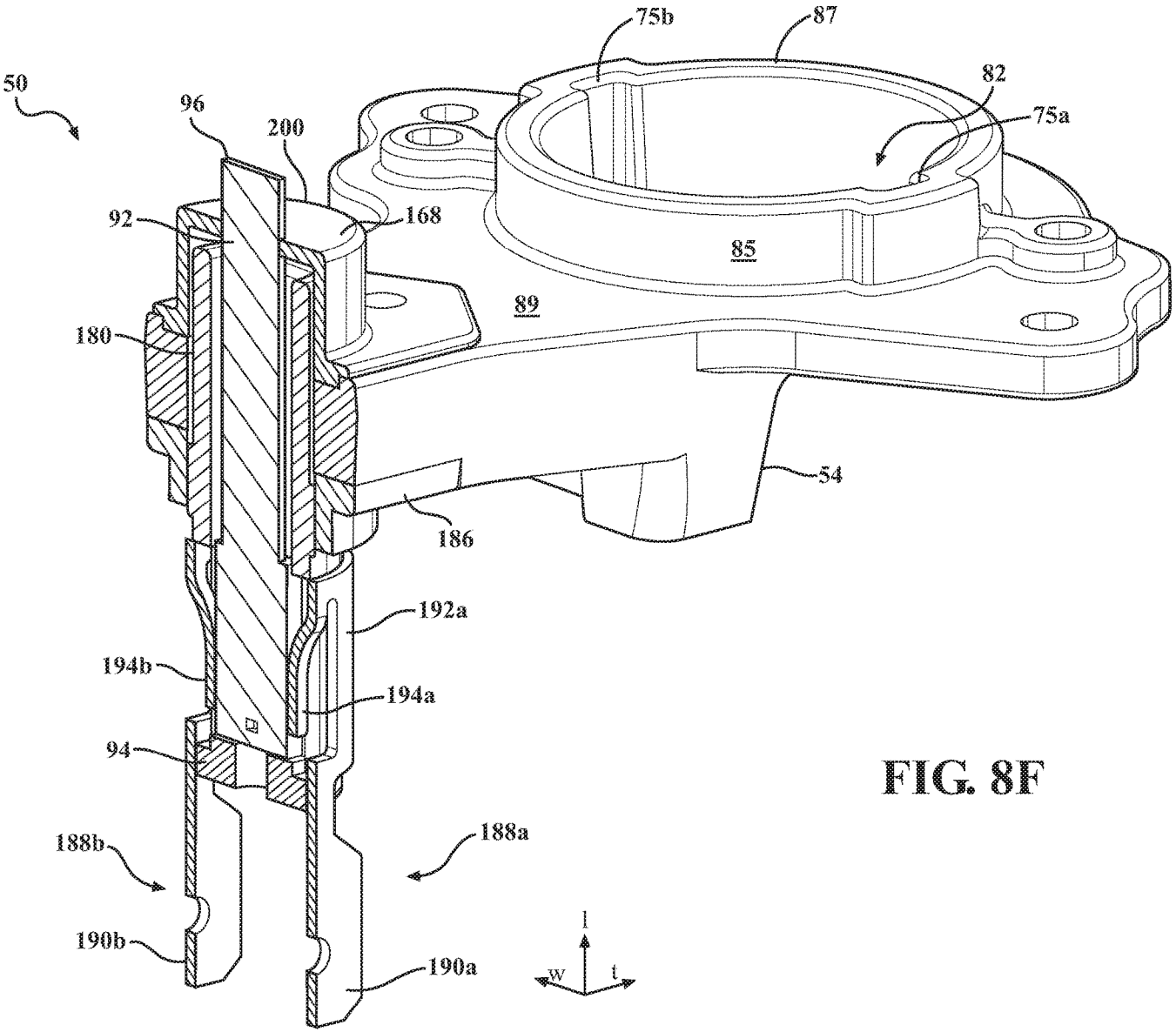
FIG. 8F is a perspective cross-sectional view of the burner assembly of FIG. 8E viewed along the igniter's thickness axis t.
Figure 8G:
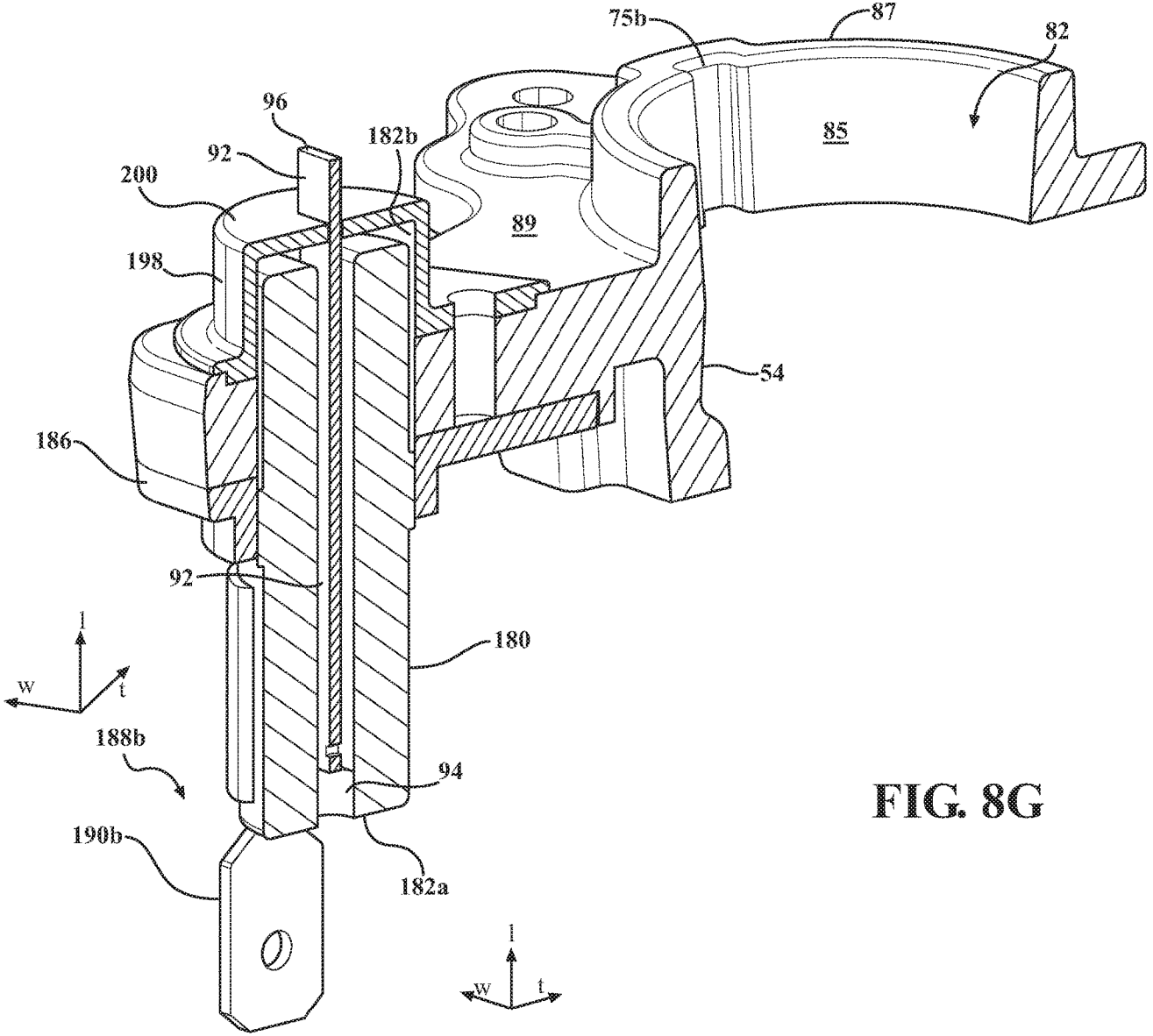
FIG. 8G is a perspective cross-sectional view of the burner assembly of FIG. 8E viewed along the igniter's width axis w.
Figure 8H:
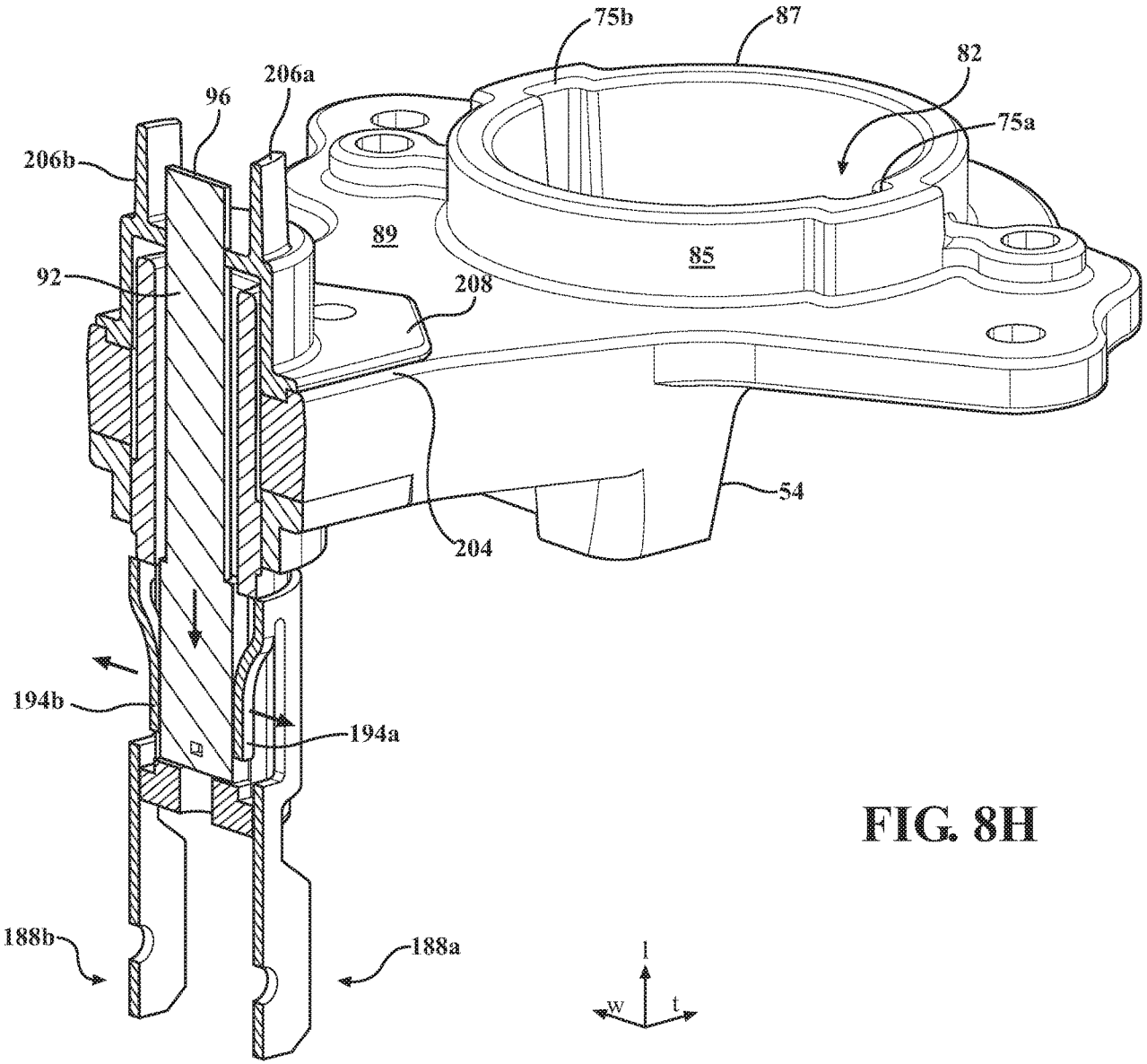
FIG. 8H is a cross-sectional view of an eleventh example of a burner assembly comprising a hot surface igniter in which the burner assembly of FIGS. 8A-8G has been modified to include protective fins on the cap as viewed along the igniter thickness axis t.
Figure 8I:
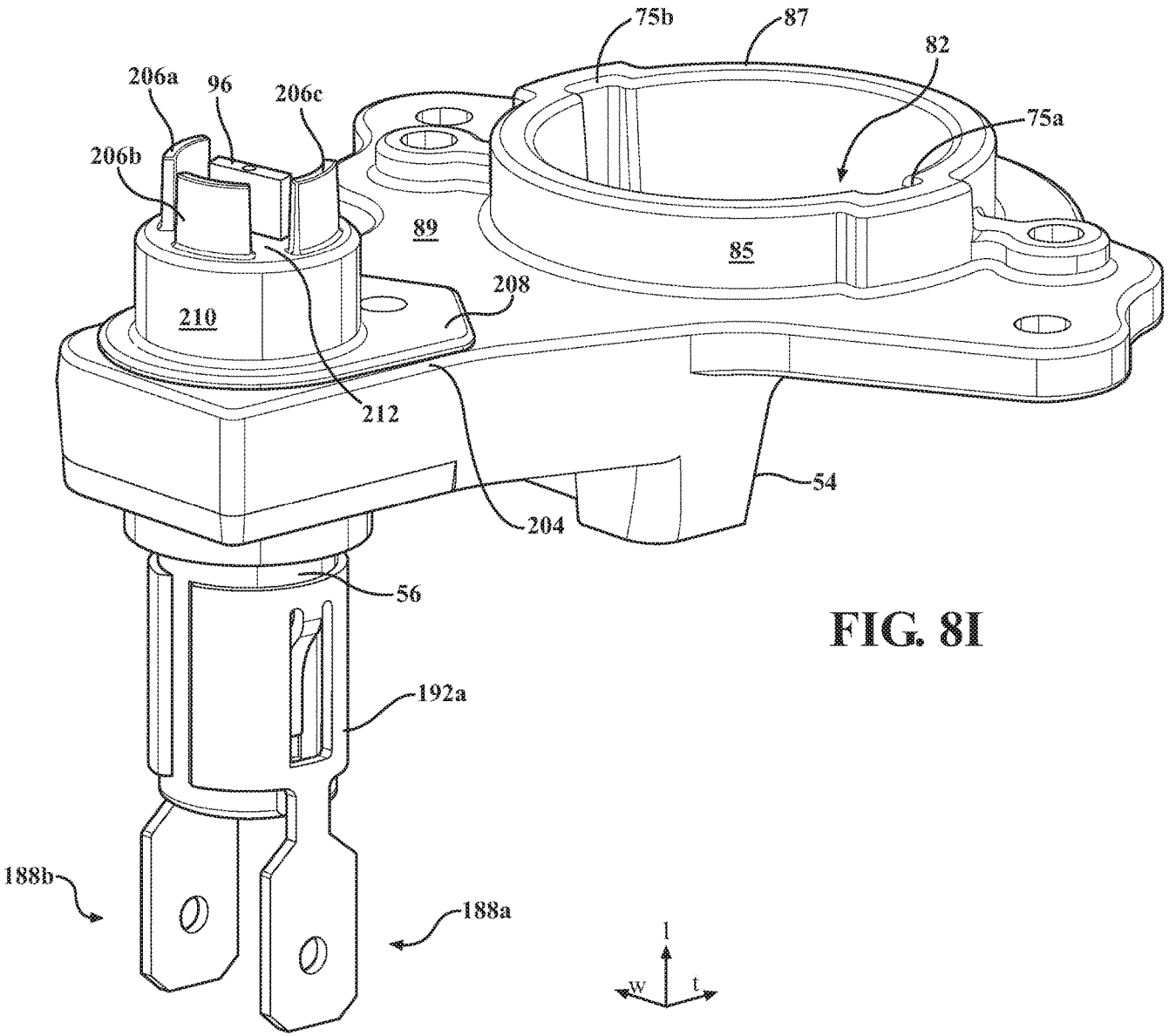
FIG. 8I is a perspective view of a burner assembly of FIG. 8H.

As shown in FIGS. 8C and 8E, the insulator 180 is press fit to a connecting plate 186 which is attached to the underside of the orifice holder 54 (FIG. 8E). Cap 198 is provided and is positioned over the distal end of igniter body 92 and insulator 180 to allow a small distal section proximate distal end 96 of igniter body 92 to extend distally from top surface 200 of the cap 198. Cap 198 also includes a flange 202 that facilitates attachment of the cap 198 to the upper surface of orifice holder 54 (FIG. 8E). The burner assembly 50 of FIGS. 8H and 8I is similar to that of FIGS. 8A-8G, except that cap 210 includes a plurality of protective fins 206*a*-206*c* extending distally from top surface 212 along the igniter length axis l. The fins extend distally beyond the distal end 96 of the igniter body 92 and are spaced apart circumferentially from one another. Fins 206*a* and 206*c* are spaced apart diametrically from one another. Fin 206*b* does not have a diametric counterpart to leave an opening aligned with a major facet of igniter body 92 and igniter gas port 104 in crown 52.

Figure 9B:
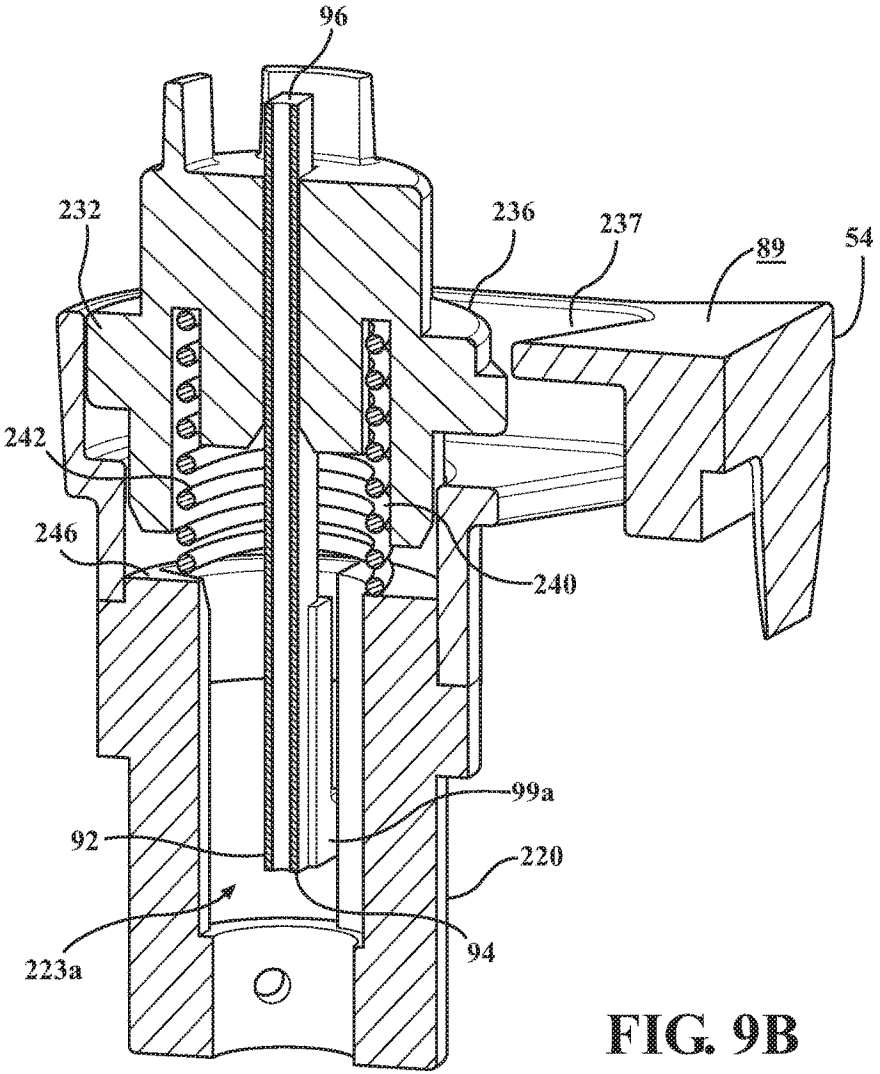
FIG. 9B is a cross-sectional view of the burner assembly of FIG. 9A viewed along the igniter width axis w.
Figure 9A:
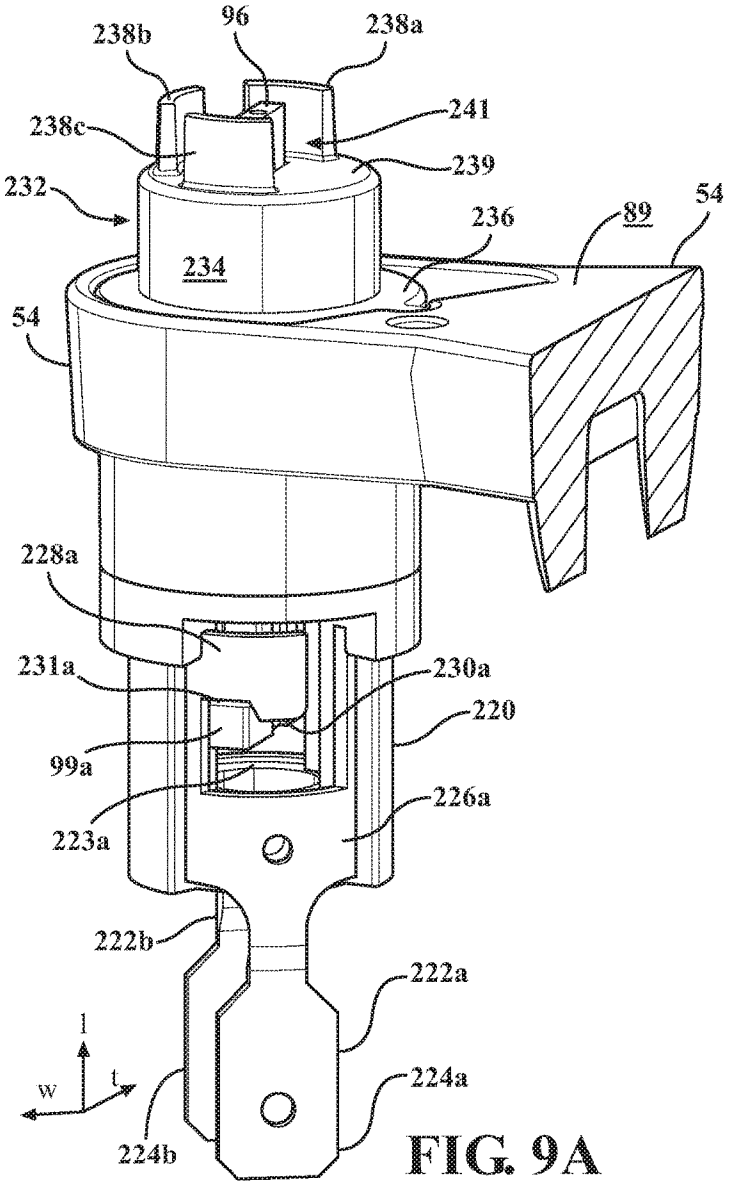
FIG. 9A is a side elevational view of a twelfth example of a burner assembly comprising a hot surface igniter in which the igniter is inserted and rotated into an insulator to make selective electrical contact with a power supply.

In accordance with certain examples herein, a burner assembly 50 is provided in which the igniter 90 is pressed in the proximal direction along its length axis l and rotated to selectively and electrically connect the igniter 90 to a power source. Referring to FIGS. 9A and 9B igniter 90 is as described previously except that connectors 74*a* and 74*b* are not provided and external leads 98*a* and 98*b* are configured with radially extending projections 99*a* and 99*b* (not shown). Insulator 220 is generally cylindrical but includes a pair of diametrically opposed openings 223*a* and 223*b* (not shown). Connector 222*a* includes a distal section 226*a* with a distal arm 228*a* that extends circumferentially and which includes a shoulder 230*a* adjacent a recessed electrical engagement surface 231*a*. Proximal terminal 224*a* is also provided for connection to a power source. Connector 226*b* includes corresponding features. The insulator 220 is recessed at the location where the distal section 226*a* mates with it so that the distal arm 228*a* is radially inward of the outer surface of the insulator 220. A cap 232 is provided which snugly receives igniter body 92.

Cap 232 includes protective fins 238*a*-238*c* which extend distally beyond the distal end 96 of the igniter body 92 from the cap upper surface 239 and which are spaced apart circumferentially around the cap 232. The fins also define an opening 241 that is aligned with a major facet of the igniter and the igniter gas port 104 of the crown 52.

Cap 232 includes a spring recess 240 (FIG. 9B) which is an annular space configured to receive spring 242. In its relaxed state spring 242 extends proximally away from the proximal end of the cap 232. Insulator 220 is fixedly attached to orifice holder 54. To install the igniter 90, the cap 232 with the igniter inserted and attached to it is inserted into the orifice holder opening 237 so that spring 242 abuttingly engages distally facing surface 246 of the distal end of insulator 220. The igniter 90 is inserted to so that the projections 99*a* and 99*b* on the igniter external leads 98*a* and 98*b* are circumferentially away from connector shoulders 230*a* and 230*b* (respectively). The cap 232 is then depressed in the proximal direction along the igniter length axis l until the projections 99*a* (FIG. 9A) and 99*b* (not shown) are proximal of the connector shoulders 230*a* and 230*b* (respectively). The cap 232 is then rotated in the plane parallel to the thickness and width of the igniter 90 until the projections 99*a* and 99*b* are underneath the recesses defined by electrical engagement surfaces 231*a* and 231*b*. The cap 232 is then released, and the biasing force of spring 242 drives the projections 99*a* and 99*b* upward along the igniter length axis l and into abutting engagement (and electrical contact) with the electrical engagement surfaces 231*a* and 231*b* (respectively). Cap 232 includes a cylindrical body 234 and a projection tab on flange 236 which abuttingly engages a portion of the orifice holder extending over the 237 to restrain the distal movement of the cap 232 when it is in the correct position with the an exposed major facet of the igniter body 92.

The burner assembly 50 of FIGS. 9C-9G is similar to that of FIGS. 9A-9B. However, the insulator 250 is not configured to snugly receive igniter body 92. Insulator 250 has a proximal end 252 and a distal end 254 spaced apart along the igniter length axis l. Insulator 250 also includes a cavity 251 (FIG. 9G) that receives igniter 90. Insulator 250 includes openings 256*a* (FIG. 9C) and 256*b* (not shown) which are diametrically opposite one another and into which the igniter external lead projections 97*a* and 97*b* extend to engage the connectors 262*a* and 262*b* (not shown).

Igniter 90 includes external leads 98*a* and 98*b* (FIG. 9F) with projections 97*a* and 97*b* that extend away from igniter body 92 along the igniter width axis w. Connectors 262*a* (FIG. 9E) and 262*b* (not shown) include a proximal end 268*a* and a distal end 270*a* spaced apart along the igniter length axis l and comprise a proximal terminal 266*a* and a distal section 264*a*. Distal section 264*a* includes a distal arm 272*a* with a shoulder 274*a* and an electrical engagement surface 276*a* that defines a recess. The connector 262*a* is attached to the insulator 250 so that the electrical engagement surface 276*a* and shoulder 274*a* are aligned with the insulator opening 256.

Figure 9F:
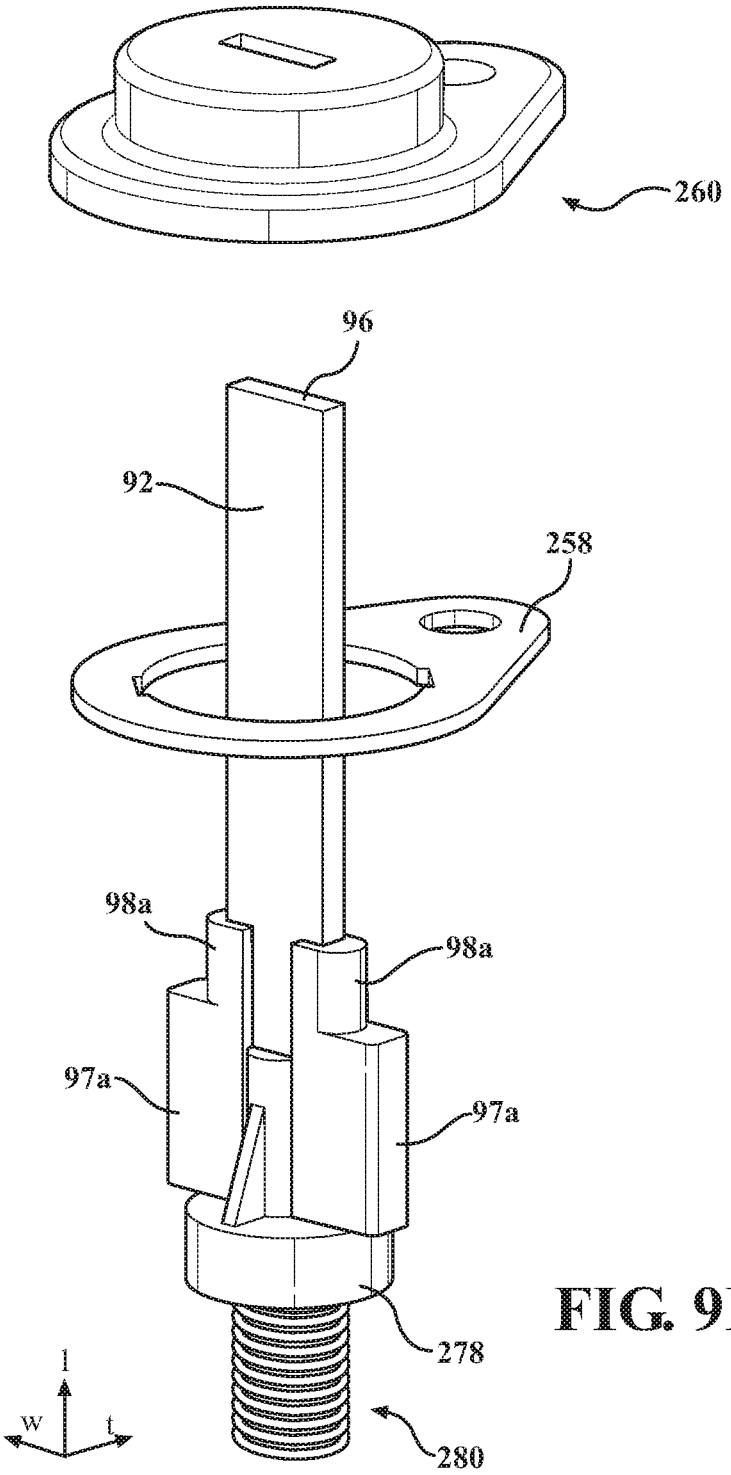
FIG. 9F is an exploded view of the hot surface igniter of the burner assembly of FIG. 9G showing the relationship between the igniter, retaining plate, and cap.
Figure 9G:
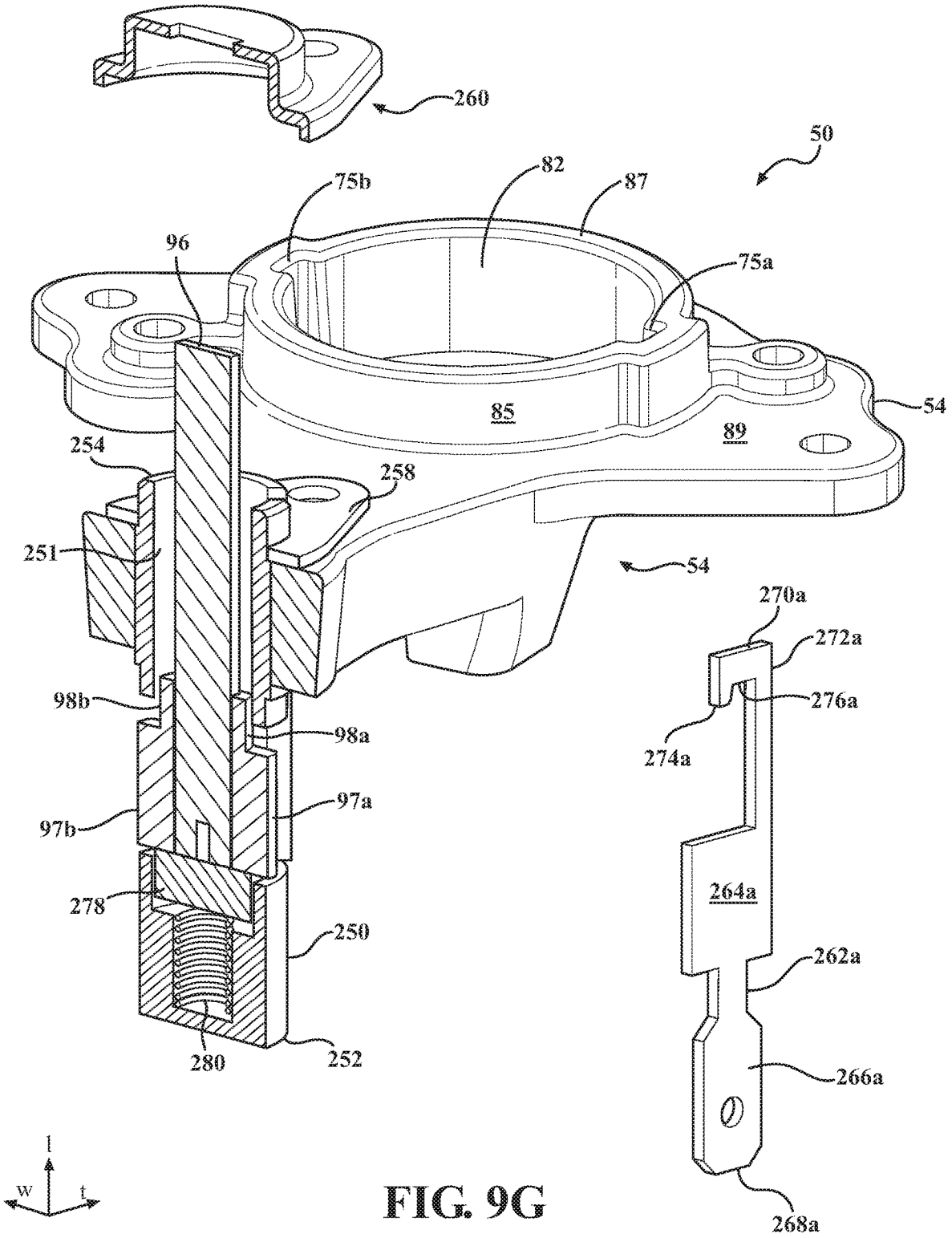
FIG. 9G is a perspective view of the burner assembly of FIG. 9C showing the hot surface igniter in a cross-sectional view taken along the igniter thickness axis.
Figure 10A:
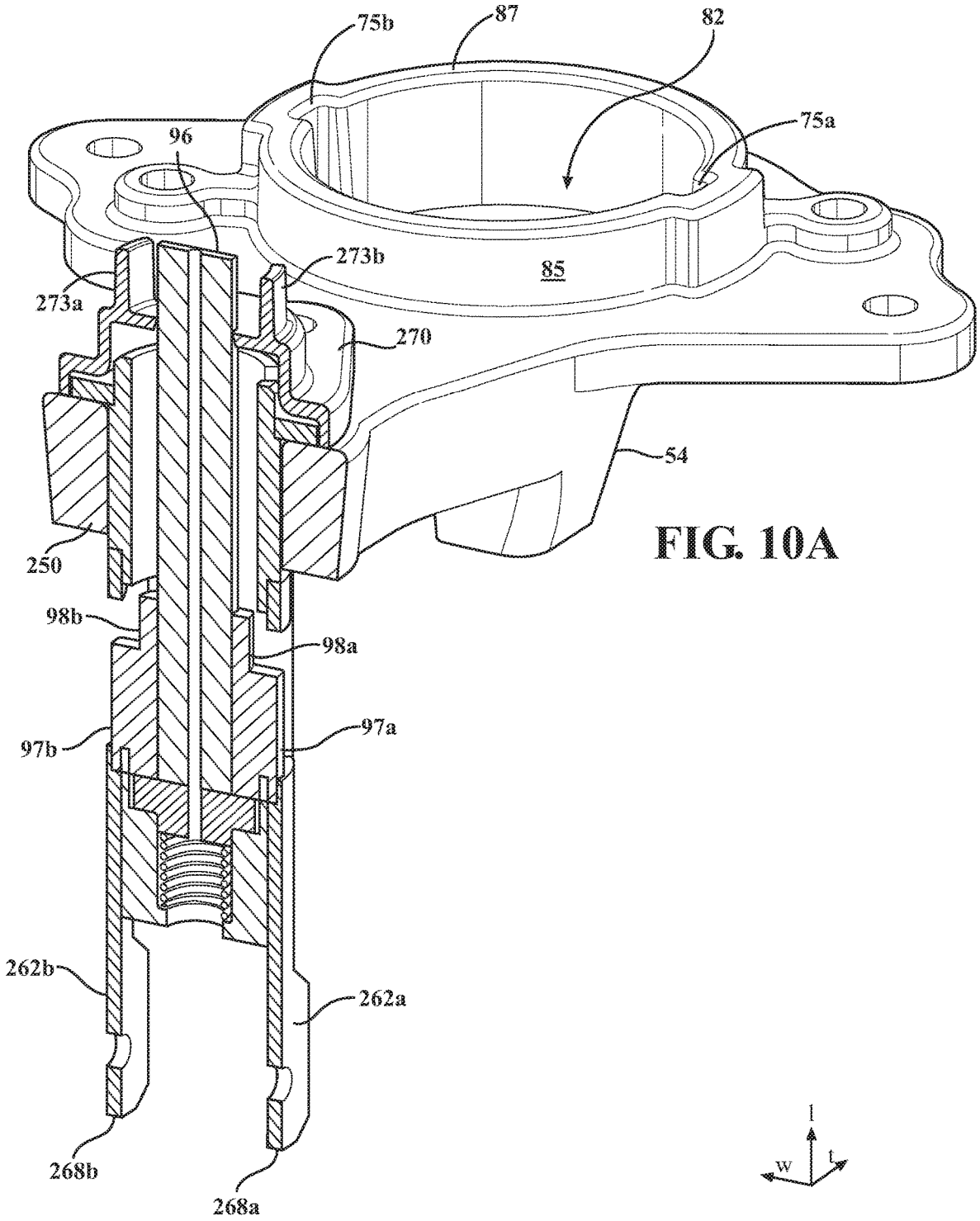
FIG. 10A is an fourteenth example of a burner assembly comprising a hot surface igniter which the burner assembly of FIG. 9C-9G has been modified to include a cap with protective fins in which the igniter assembly is shown in a cross-section viewed along igniter thickness axis t.
Figure 10B:
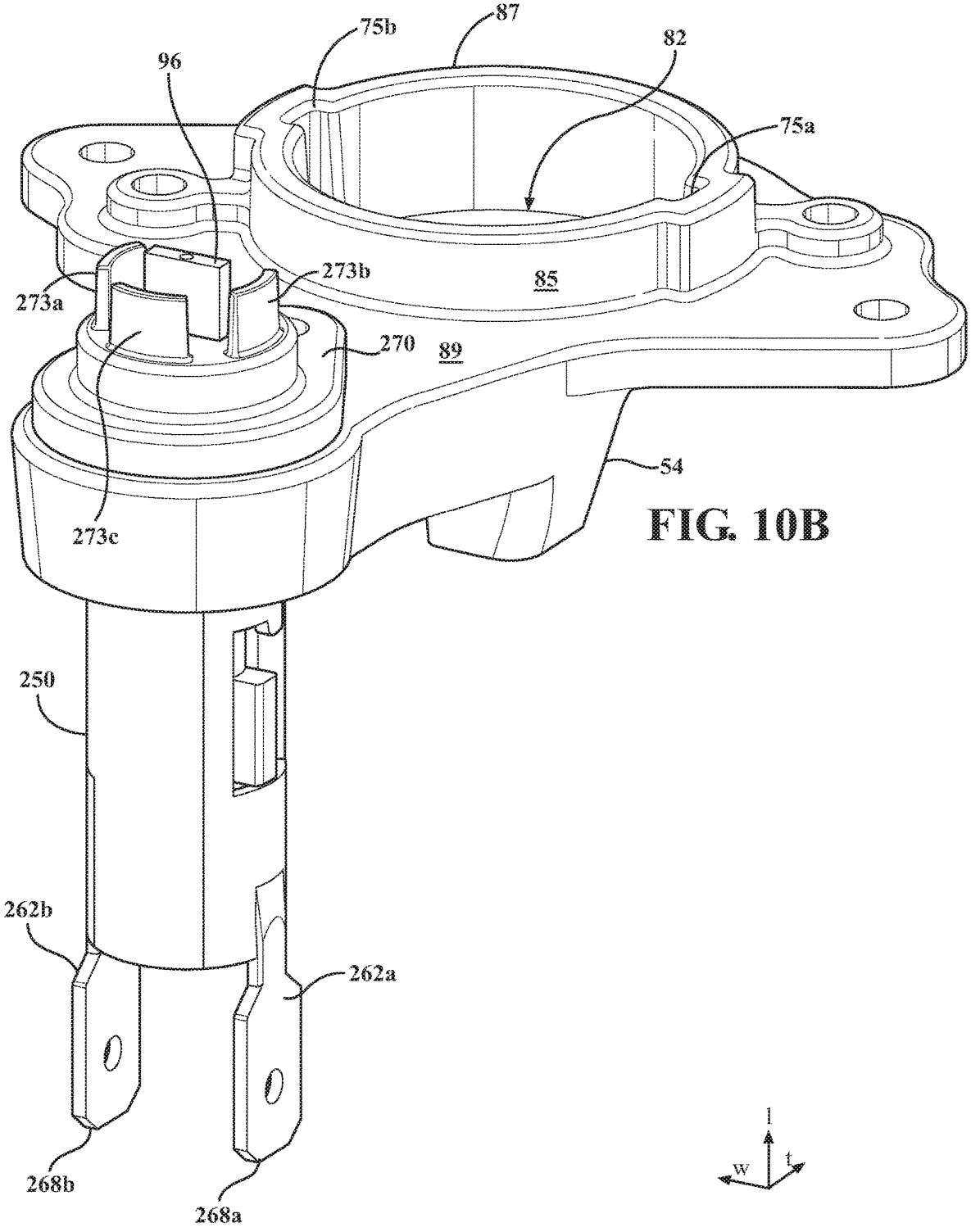
FIG. 10B is a perspective view of the burner assembly of FIG. 10A.

The proximal end 94 of the igniter body 92 is attached to a dowel 278 (FIG. 9F). The dowel 259 abuttingly engages a spring 280 (FIG. 9G) located in a spring recess at the proximal end of insulator 250. To electrically connect the igniter to a power source, it is inserted in the proximal direction along the igniter length axis l against the biasing force of spring 280. The igniter 90 is inserted until the distal most surfaces of the external lead projections 97*a* and 97*b* clear the shoulders 274*a* and 274*b* (not shown) of their respective connectors 262*a* and 262*b* (not shown). The igniter is then rotated in the plane defined by the igniter width and thickness axes (w and t) until the projections 97*a* and 97*b* are aligned with the electrical engagement surfaces 276*a* and 276*b* and then released. The biasing force of spring 280 then drives the external lead projections 97*a* and 97*b* into engagement with the corresponding electrical engagement surfaces 272*a* and 272*b*. Connecting plate 258 secures the insulator 250 to the orifice holder 54 and cap 260 fits over the distal end of the igniter 90 so that distal igniter end 96 projects distally from the cap 260. The burner assembly 50 of FIGS. 10A and 10B is similar to that of FIGS. 9C-9G except that the cap includes distally extending projective fins 273*a*-273*c* configured like the fins 238*a*-238*c* of cap 232.

Figure 11A:
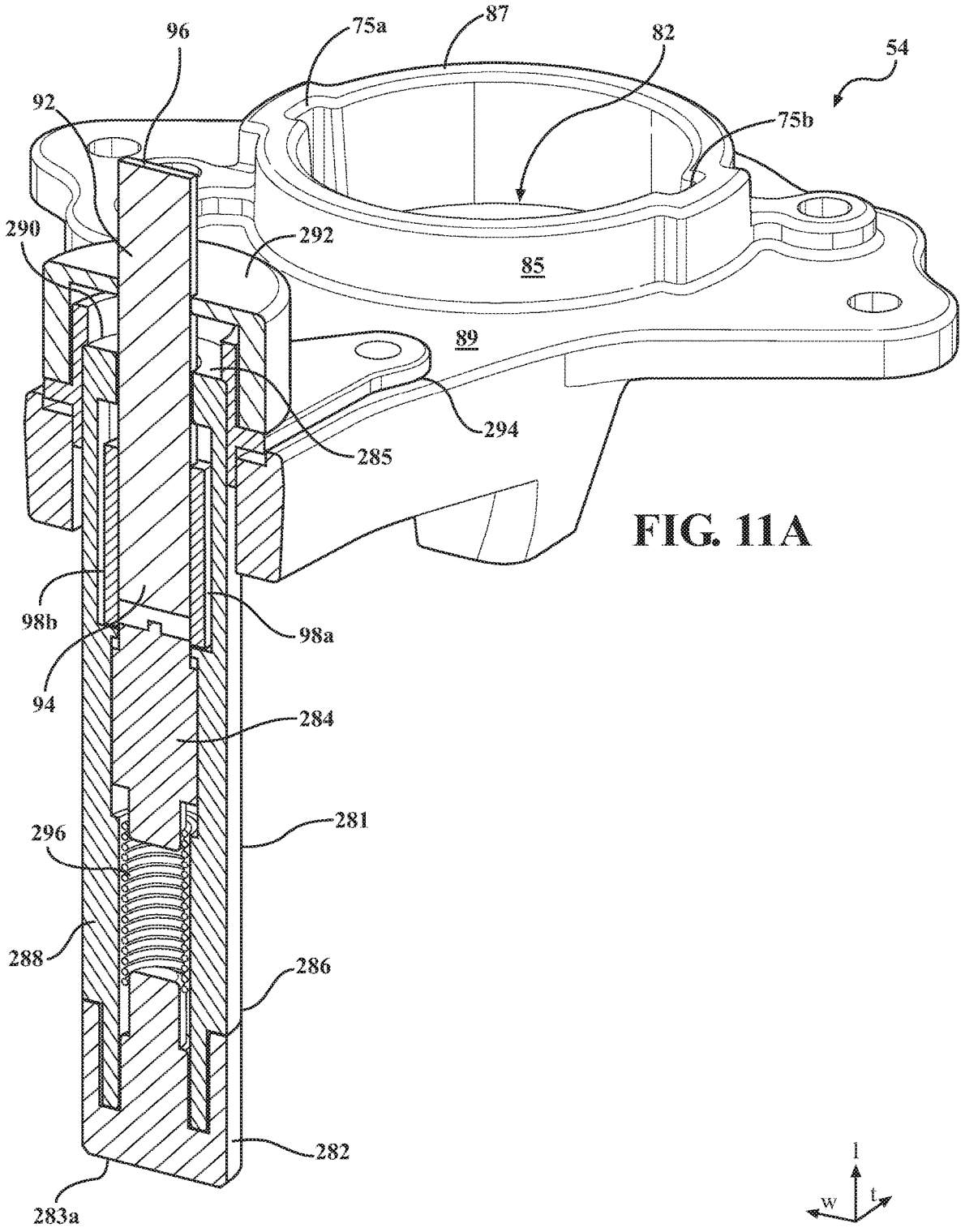
FIG. 11A is a fifteenth example of a burner assembly comprising a hot surface igniter in which the igniter is inserted and rotated to make selective electrical contact with a power source in which the igniter assembly is viewed along the igniter thickness axis t.
Figure 11B:
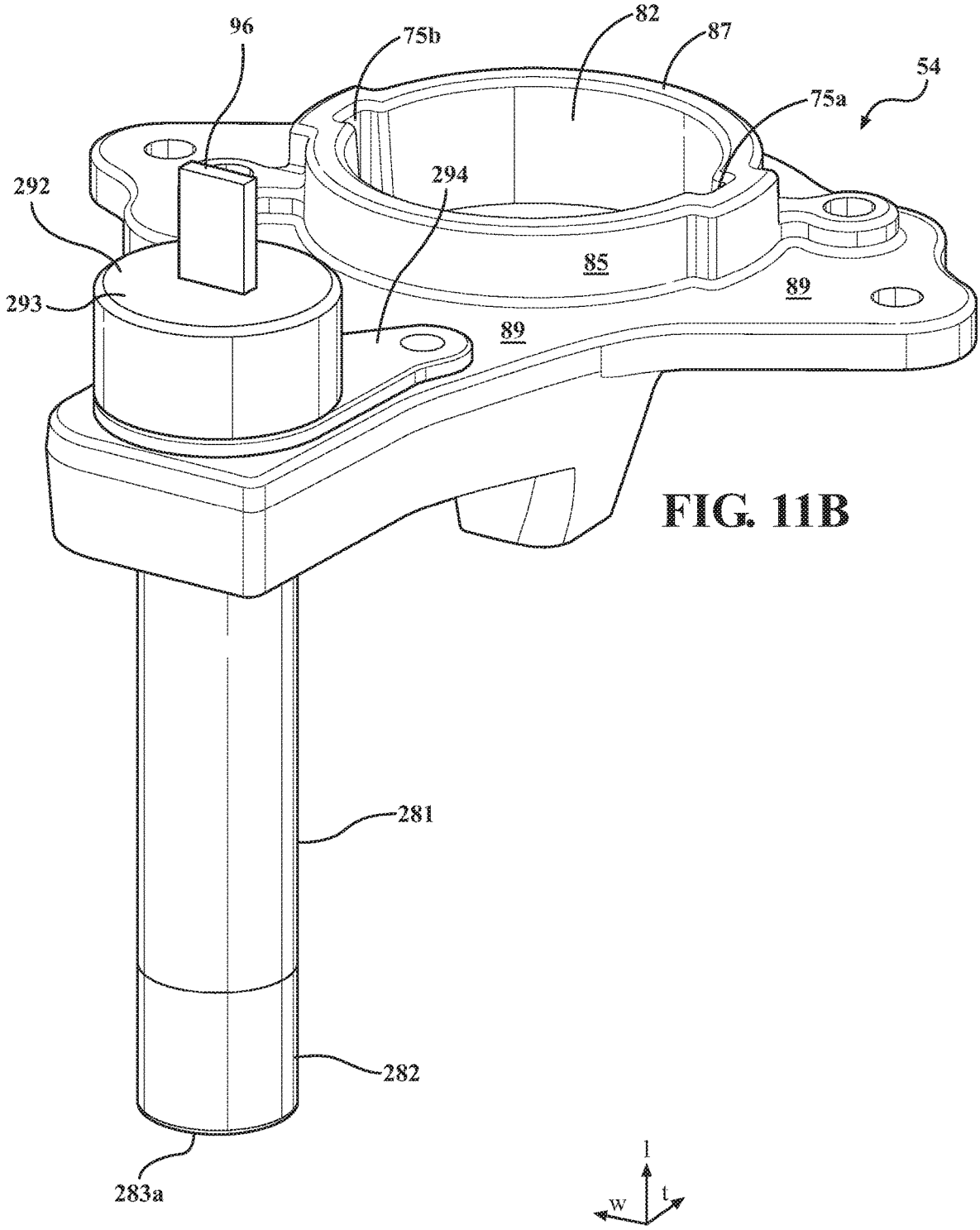
FIG. 11B is a perspective view of the burner assembly of FIG. 11A.

Referring to FIGS. 11A-11B another example of a burner assembly 50 comprising a hot surface igniter 90 is depicted. The igniter 90 includes external leads 98*a* and 98*b* but does not include the connectors 74*a* and 74*b*. The proximal end 94 of the igniter body 92 rests on a floating dowel 284 which in turn is attached to a biasing spring 296. Although not depicted connectors would be provided which are suitable for the type of insertion and rotation electrical connection in the examples of FIGS. 9A-10B. Insulator 281 is comprised of two shells 288 and 286 which are joined together by proximal cap 283 and distal cap 285. Metal ring 294 secures the housing to the orifice holder 54 and protective cap 292 fits over the distal end 96 of the igniter body 92 so that distal end 96 extends distally from the top surface 293 of cap 292.

Figure 12A:
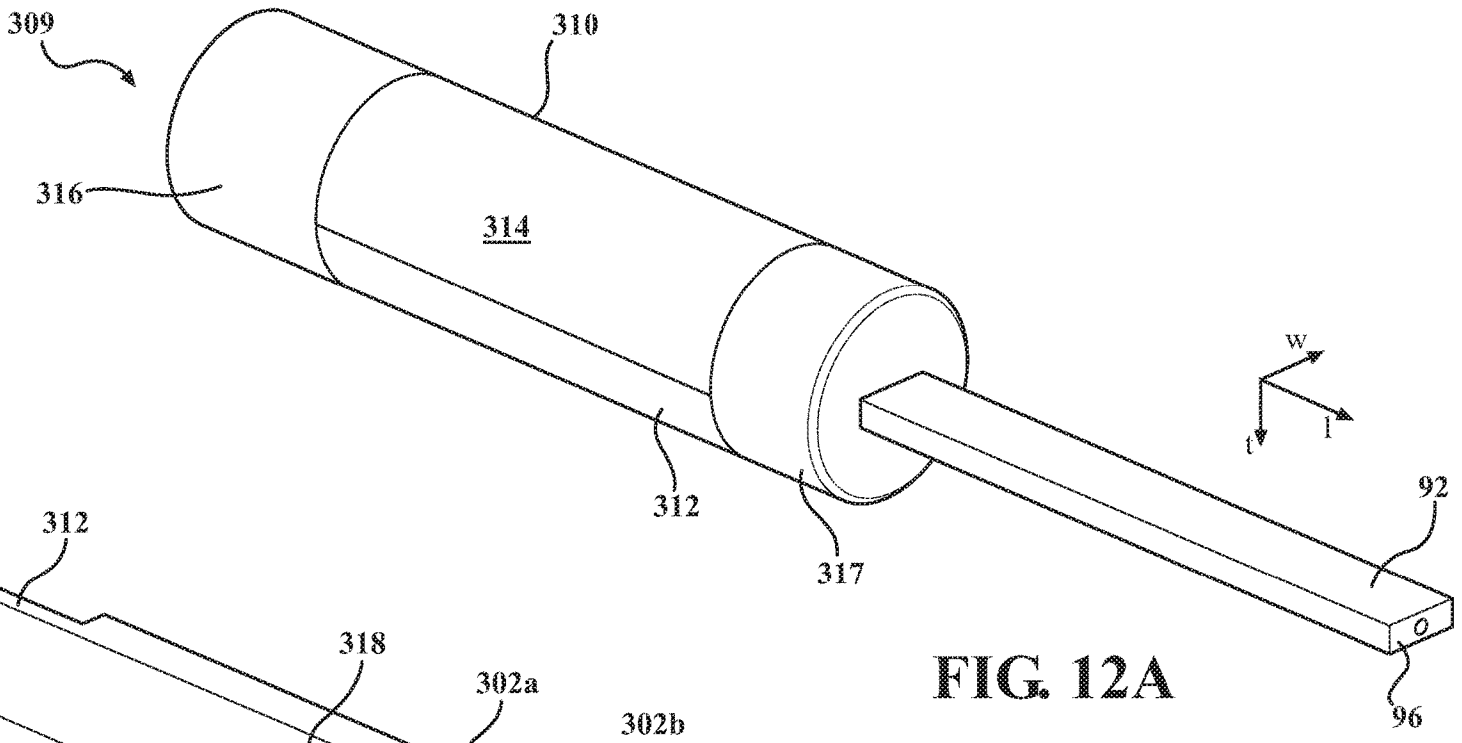
FIG. 12A is a perspective view of a hot surface igniter assembly in which the igniter is snap-fit into an insulator.
Figure 12B:
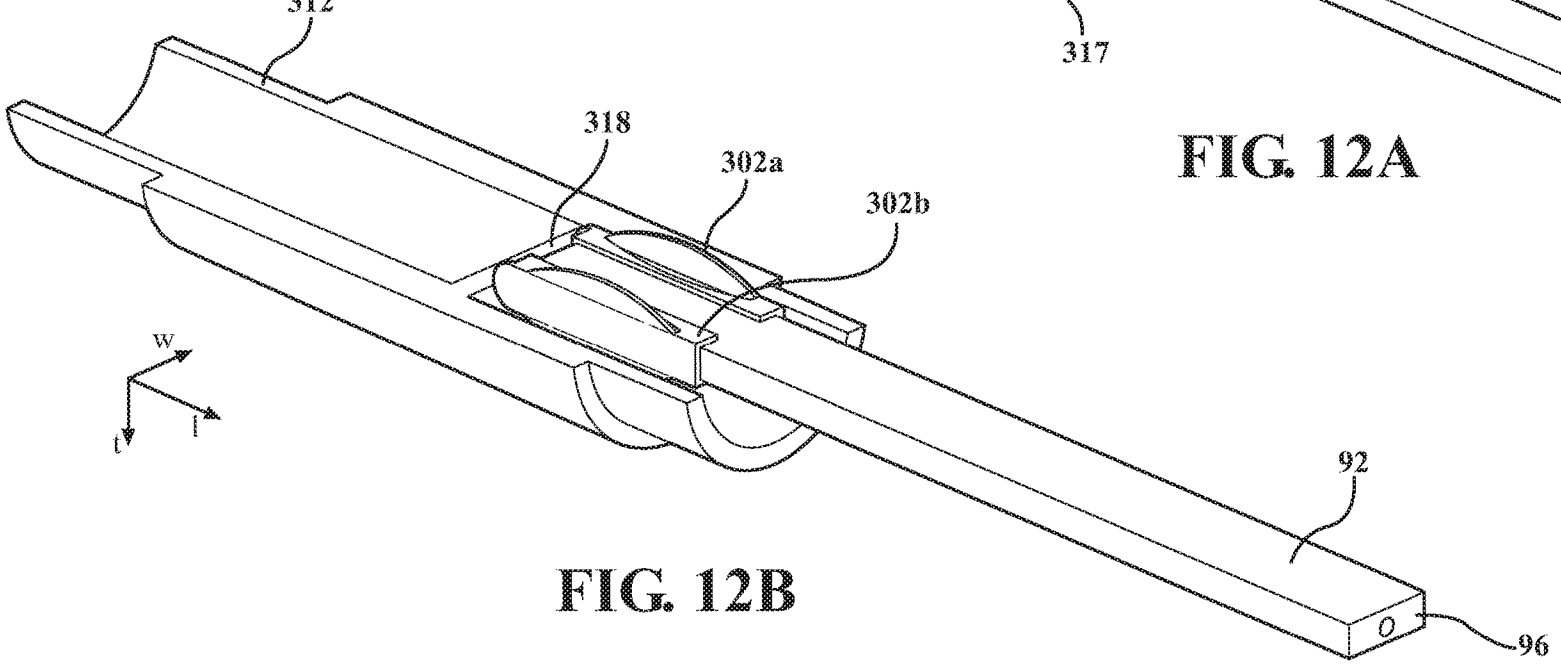
FIG. 12B is cross-sectional view of the igniter assembly of FIG. 12A viewed along the igniter thickness axis t.

Referring to FIGS. 12A-12H additional examples of hot surface igniter assemblies are shown. Referring to FIGS. 12A and 12B, igniter assembly 309 includes an igniter 90 comprising a ceramic body 92 of the type described previously and a distal end 96. External leads 300*a* and 300*b* are provided and are configured for snap fit insertion into insulator 310. Insulator 310 is preferably electrically and thermally insulating and may be made of a refractory material, including ceramic materials such as alumina, steatite, and cordierite. Insulator 310 comprises first shell 312 and second shell 314 which mate and are held together by end caps 316 and 317. Shell 312 includes a stop surface 318 that limits the insertion of igniter 90 into insulator 310. Although not shown, means are preferably provided to electrically connect the external leads 300*a* and 300*b* to a source of power.

Figure 12C:
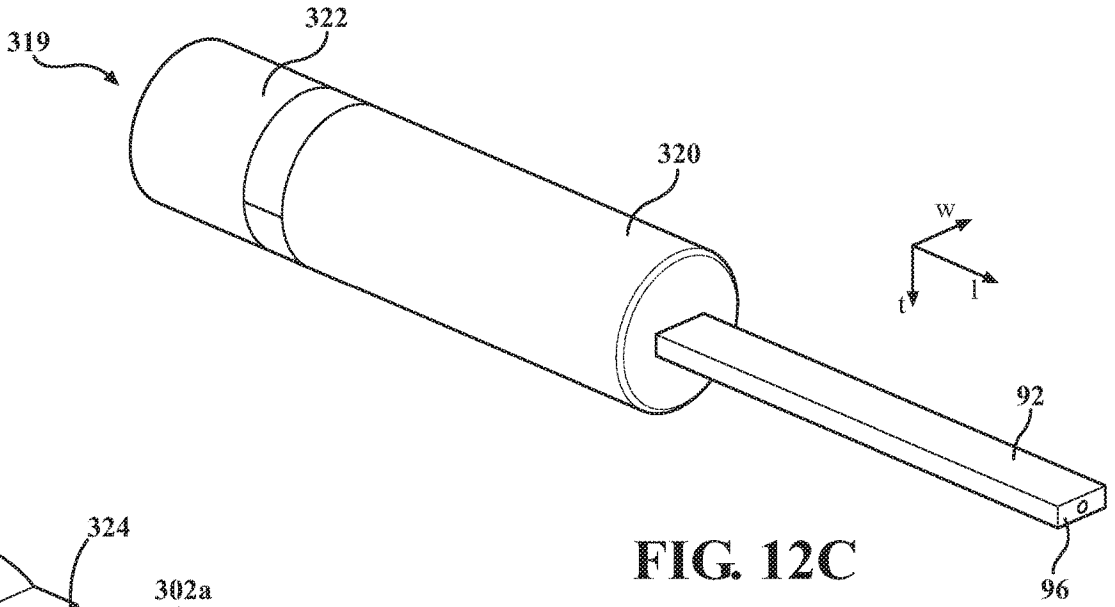
FIG. 12C is a perspective view of a hot surface igniter assembly in which the igniter is snap-fit into the insulator in which the igniter terminals have a profiled contour along the igniter length axis l when viewed along the igniter width axis w.
Figure 12D:
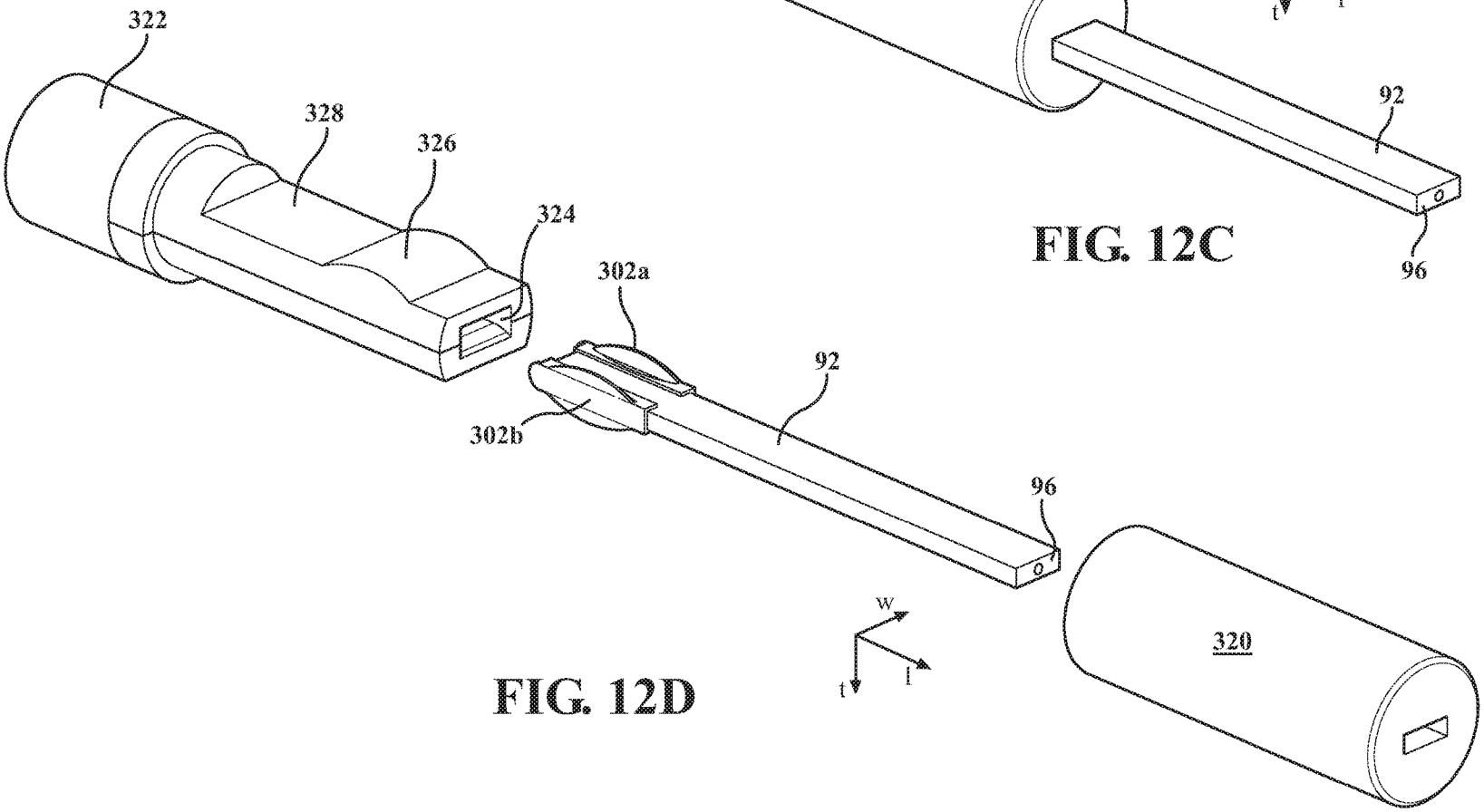
FIG. 12D is an exploded view of the igniter assembly of FIG. 12C.
Figure 12E:
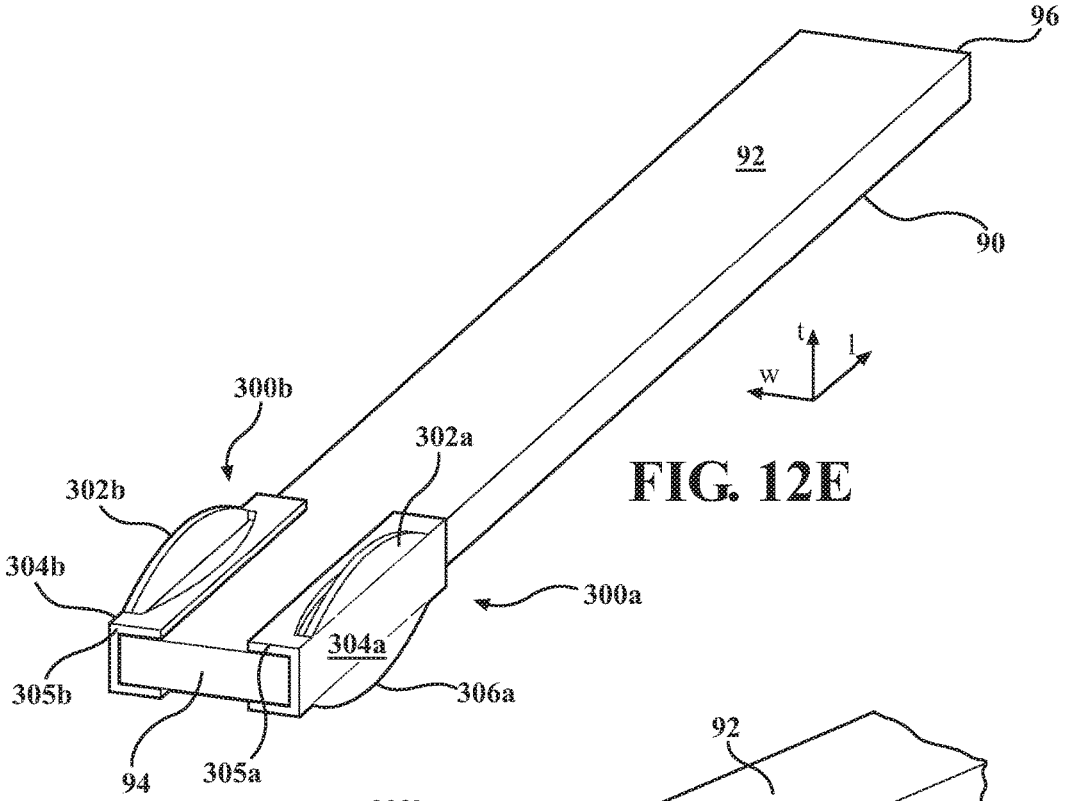
FIG. 12E is a perspective view of a hot surface igniter having terminals with a contoured profile along igniter length axis l.
Figure 12F:
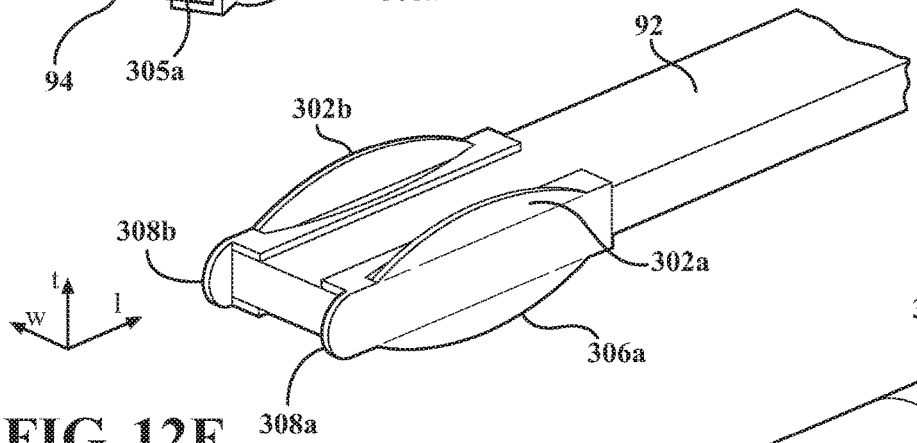
FIG. 12F is a close-up view of the proximal end of the hot surface igniter of FIG. 12F in which the terminals have been modified to include proximally extending, rounded projections.
Figure 12G:
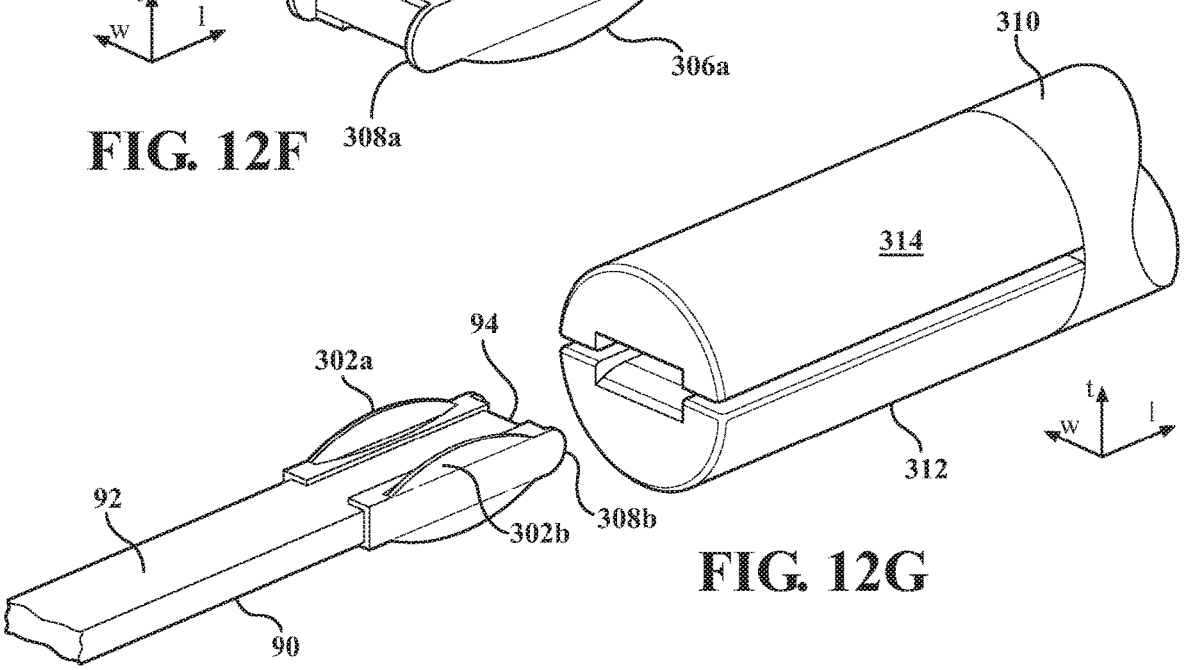
FIG. 12G is an exploded view of a hot surface igniter assembly using the igniter of FIG. 12G.

Two alternate versions of leads 300*a* and 300*b* are shown in FIGS. 12E and 12G. Each lead 300*a* and 300*b* has a contoured profile defined by corresponding fold up ears 304*a* and 304*b*. When viewed along the width dimension of the igniter, the profiles of the upper surface 302*a* and lower surface 306*a* are non-linear along the length axis l and bulge away from the igniter body 92. Upper surface 302*b* and lower surface 306*b* of external lead 300*b* are configured similarly. In the example of FIG. 12E, the proximal most ends of the external leads 300*a* and 300*b* are flat. However, in FIG. 12B curved protrusions 308*a* and 308*b* are provided. FIG. 12G shows the igniter 90 with the modified external leads 300*a* and 300*b* of FIG. 12F prior to being inserted into the insulator 310. As best seen in FIG. 12F, the external leads 300*a* and 300*b* also include connecting portions 305*a* and 305*b* which are electrically connected to the conductive ink terminals embedded in igniter body 92, as further described below.

FIGS. 12C and 12D show a modified version of FIGS. 12A and 12B in which an extended cap member 320 fits over a contoured body 326 which is shaped to conform to the profile of the external leads 300*a* and 300*b* for a closer fit with insulator 310. The profiled surfaces of the ears 304*a* and 304*b* cause opening 324 to deflect during insertion of the igniter for a better flexing.

Figure 12H:
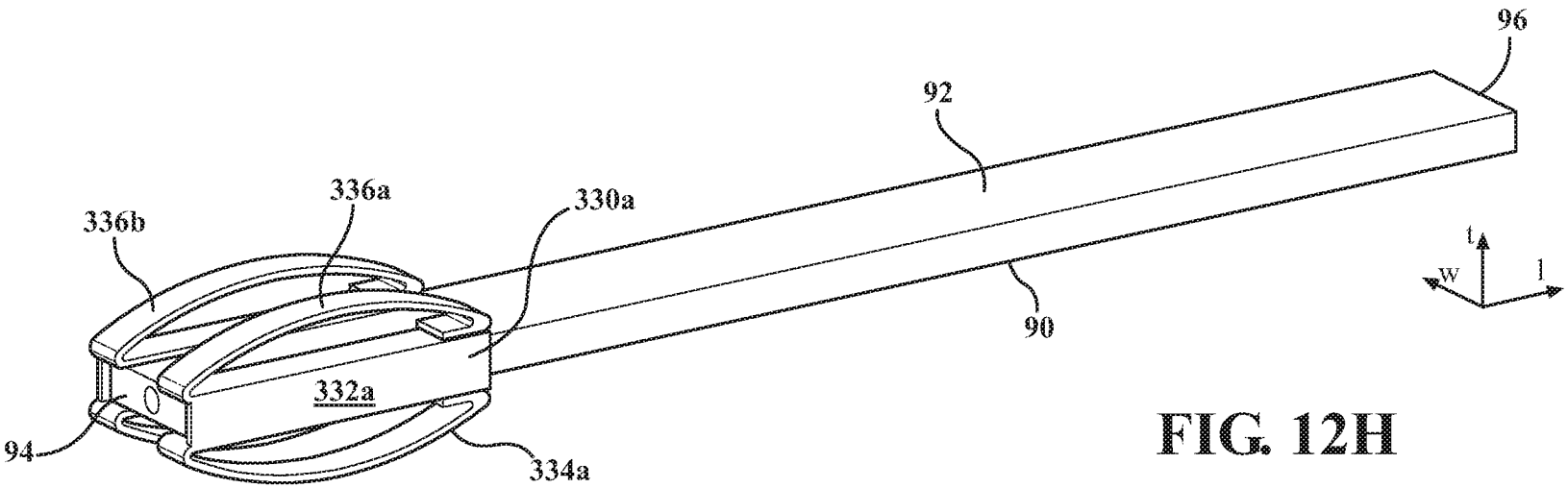
FIG. 12H is a perspective view of a hot surface igniter comprising terminals that have resilient engagement surfaces that deflect along the igniter thickness axis t.

FIG. 12H shows a modified set of external leads 330*a* and 330*b* in which spring members 334*a*/334*b* and 336*a*/334*b* deflect along the igniter thickness axis t during insertion into an insulator housing.

Figure 13A:
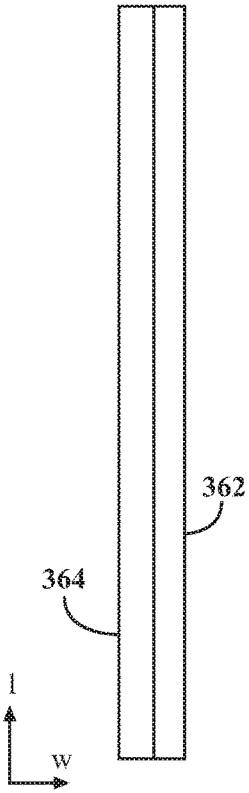
FIG. 13A is a side view of an exemplary hot surface igniter for use in the burner assemblies described herein.
Figure 13B:
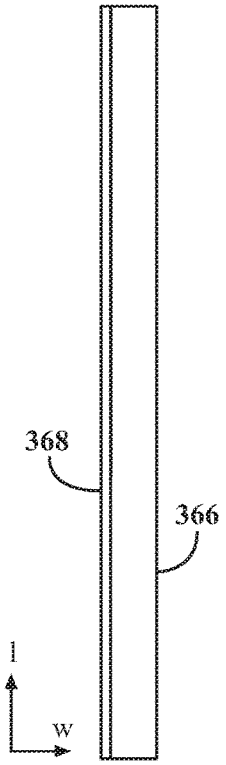
FIG. 13B is a modified example of the hot surface igniter of FIG. 13A in which the tiles have different thicknesses.

Referring to FIGS. 13A and 13B two alternate sintered hot surface igniter profiles are provided. In the symmetrical example of FIG. 13A, two ceramic tiles 362 and 364 are of equal thickness, and a conductive ink circuit is screen printed on one of the two facing surfaces of the tiles 363 and 364.

In the asymmetric example of FIG. 13B, ceramic tiles 368 and 366 are of different thicknesses. The thicker tile 366 provides greater structural integrity to the igniter 90. The thinner tile 368 provides a shorter path for heat conduction for the exposed major facet of ceramic body 92 and provides the "hot" surface that would preferably face the igniter gas port 104 when the igniter is installed in a burner. In both cases the ceramic bodies preferably comprise silicon nitride and a rare earth oxide sintering aid, wherein the rare earth element is one or more of ytterbium, yttrium, scandium, and lanthanum. The sintering aids may be provided as co-dopants selected from the foregoing rare earth oxides and one or more of silicon, alumina, silicon dioxide, and magnesium oxide may also be provided. A sintering aid protective agent is also preferably included which also enhances densification. A preferred sintering aid protective agent is molybdenum disilicide. The rare earth oxide sintering aid (with or without the co-dopant) is preferably present in an amount ranging from about 2 to about 15 percent by weight of the ceramic body, more preferably from about 8 to about 14 percent by weight, and still more preferably from about 12 to about 14 percent by weight. Molybdenum disilicide is preferably present in an amount ranging from about 3 to about 7 percent, more preferably from about 4 to about 7 percent, and still more preferably from about 5.5 to about 6.5 percent by weight of the ceramic body. The balance is silicon nitride.

Ink compositions suitable for forming the conductive circuit component 340 of the igniter 90 preferably comprise tungsten carbide in an amount ranging from about 20 to about 80 percent, preferably from about 30 percent to about 80 percent, and more preferably from about 70 to about 75 percent by weight of the ink. Silicon nitride is preferably provided in an amount ranging from about 15 to about 40 percent, preferably from about 15 to about 30 percent, and more preferably from about 18 to about 25 percent by weight of the ink. The same sintering aids or co-dopants described above for the ceramic body are also preferably included in an amount ranging from about 0.02 to about 6 percent, preferably from about 1 to about 5 percent, and more preferably from about 2 to about 4 percent by weight of the ink. Silicon carbide may also be provided in amounts ranging from zero to about 6 percent by weight of the ink. The roles of the sintering aids are described in H. Kelmm, "Silicon Nitride for High-Temperature Applications," *J. Am. Ceram. Soc.*, 93[6] at 1501-1522 (2010), the entire contents of which are hereby incorporated by reference.

In FIG. 13B the combined thickness of both tiles 362 and 364 along the thickness axis in certain examples is preferably no more than about 0.04 inches, still more preferably no more than about 0.03 inches, and still more preferably no more than about 0.02 inches.

In the case of the asymmetric example of FIG. 13B, the thinner tile 368 preferably has a thickness of no more than about 0.02 inches, more preferably no more than about 0.018 inches, and still more preferably no more than about 0.016 inches. In the same or additional examples, the thickness of the thicker tile 366 is preferably no more than about 0.06 inches, more preferably no more than about 0.05 inches, and still more preferably no more than about 0.045 inches.

Figure 13C:
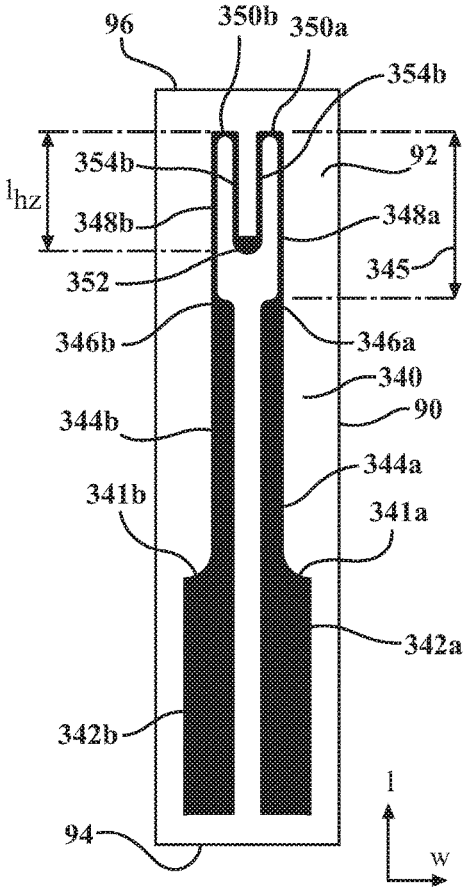
FIG. 13C is a top plan view of a cross-section of a hot surface igniter in accordance with the present disclosure as viewed along the igniter thickness axis t.

Referring to FIG. 13C an example of a printed ink circuit 340 for use with the hot surface igniters described herein is depicted. The ink is preferably applied by screen printing to a major facet of one of the ceramic tiles before sintering. Ink jet technologies may also be used to print the conductive ink circuit 340 onto one of the ceramic tiles. The conductive ink circuit comprises terminals 342*a* and 342*b* which are connected to external leads such as external leads 98*a* and 98*b* described previously. Leads 344*a* and 344*b* are connected to the terminals 342*a* and 342*b*, respectively. The leads 344*a* and 344*b* are in turn connected to the resistive heating circuit 345 which comprises a conductive ink pattern configured to yield resistive heating when a potential difference is applied across terminals 342*a* and 342*b*. The resistive heating circuit 345 is shown in more detail in FIG. 13D. As shown in the figure, the resistive heating circuit comprises legs 348*a*, 348*b*, 354*a* and 354*b* which each have lengths along the igniter length axis l and widths along the igniter width axis w. The legs 348*a*, 348*b*, 354*a* and 354*b* are spaced apart along the igniter width axis w. The entire resistive heating circuit 345 preferably has a substantially constant thickness along the igniter thickness axis t. The resistive heating circuit is also defined by a heating zone length $l_{hz}$, which is measured from the proximal edge of connection 352 to the distal edges of connections 350*a* and 350*b*. The heating zone is the area of maximum heat generation. The heating zone length $l_{hz}$ is from 10 to 40 percent, preferably from 15-35 percent, and more preferably from 19-31 percent, of the length of the entire conductive circuit 340.

The legs are connected by connections 350*a*, 350*b*, and 352. At the connections, the ink pattern changes direction from running parallel to the igniter length axis l to running parallel to the igniter width axis w. In certain cooktop applications, it has been found that utilizing a conductive ink width in the connections 350*a*, 350*b*, and 352 that is wider (along the length axis l) than the width of the conductive ink pattern in the legs 348*a*, 348*b*, 354*a* and 354*b* (along the width axis w) beneficially reduces the resistance in the connections 350*a*, 350*b*, and 352 and lowers the temperature in legs 354*a* and 354*b* which reduces the propensity for thermal degradation of the resistive heating circuit 345. In preferred examples, the connections 350*a*, 350*b*, and 352 include ink widths that are double the width in the legs 348*a*, 348*b*, 354*a* and 354*b*.

Compared to many conventional conductive ink patterns, the leads 344*a* and 344*b* make a more abrupt transition to the resistive heating circuit 345. Referring to FIG. 13C, transition regions 346*a* and 346*b* are regions of diminishing ink width along the igniter width w axis when transitioning from leads 344*a* and 344*b* to legs 348*a* and 348*b*. In the example of FIG. 13C, the width of the igniter leads 344*a* and 344*b* along the igniter length axis l varies along no more than 10 percent of the length of the leads 344*a* and 344*b* along the length axis l, starting with the end of terminal transition sections 341*a* and 341*b*, which are concave regions.

Figure 13D:
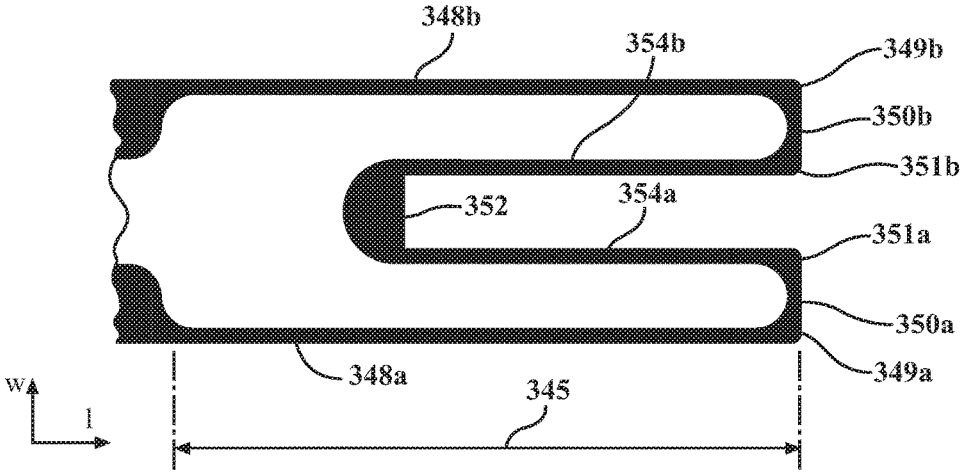
FIG. 13D is a top plan view of the distal end of the hot surface igniter of FIG. 13C used to illustrate the conductive ink thicknesses at the connector segments.

In addition to the ink width increase in the connections 350*a*, 350*b*, and 352, the connections preferably include corners 349*a* and 349*b* that are substantially right angles. In many conventional ink patterns, the ink pattern is rounded when transitioning from the legs 348*a* and 348*b* to their respective connections 350*a* and 350*b*. However, in certain preferred examples, and as illustrated in FIG. 13D, the transition is sharp and defined by right angles in the outer contour of the ink pattern at corners 349*a* and 349*b*.

An exemplary method of making the hot surface igniters 90 will now be described. In a first powder processing step, ceramic powders comprising the compounds used to form the igniter body 92 and deionized water are weighed out in accordance with their desired weight percentages and added to ajar mill with an alumina medium. The jar mill is sealed, and the powders are rolled to create a homogenous mixture. The mixture is then screened through a fine mesh screen to remove any large, hard agglomerate. Binder emulsions are further added to form the final slurry. The slurry is then tape cast or flocculated and poured onto a plaster bat to reduce the moisture content to 18-20 percent in preparation for roll calendaring.

Next a forming method is used to form a flat tape from the slurry. Several methods may be used, including tape casting, roll compaction, and extrusion. Tiles are then cut into small squares and laser marked to facilitate alignment for screen printing and dicing. The tiles are then screen printed with the conductive ink composition and allowed to dry. The screen printed tiles are then laminated with a blank cover tile (i.e., a ceramic tile 362 or 364 in FIG. 13A without the screen printed circuit) in preparation for binder burnout. The tiles 362 and 364 are referred to as "green" (unsintered) tiles at this point.

The green tiles are burned out in air at a prescribed temperature based on the organic powder used in the powder preparation process. Approximately 60-85% of the binder is removed. The remaining binder is necessary to provide handling strength.

A hot pressing sintering step is then performed in which the tiles are loaded into a hot press die, which is loaded into a controlled atmosphere furnace. The air in the furnace is evacuated and replaced with nitrogen to provide an inert environment free of oxygen. The furnace is typically vacuumed down and back filled with nitrogen three times. The furnace is left under vacuum, and power is supplied to the furnace. A continuous vacuum is pulled on the furnace until the temperature reaches 1100° C. to aid in removal of the remaining organics. At this time the furnace is back filled with nitrogen and pressure is applied to the parts via a hydraulic ram. The pressure is slowly increased over time until the desired pressure is reached. Pressure is held until the completion of the sintering soak carried out at 1780° C. for 80 minutes. The temperature is controlled until a prescribed time at which point the pressure on the ram is released and the power to the furnace is removed. When the parts are cooled they are removed from the furnace and cleaned up in preparation for a dicing operation. During dicing, the individual elements are diced out of tile using a diamond dicing saw. Laser marks from the lamination process are used to define were the dicing saw cuts should be made. Following the hot press sintering step, the igniters 112 are more than 90 percent dense, preferably more than 95 percent dense, and still more preferably more than 98 percent dense.

Alloy 42 is brazed onto the elements using a Ti—Cu—Ag braze paste to form the external leads 98*a* and 98*b* (FIG. 1B). The brazed igniter elements are assembled into a ceramic insulator 56 formed from a suitable ceramic such as alumina, steatite, or cordierite. The elements are connected to the insulator using a ceramic potting cement. Wire or connectors 74*a* and 74*b* may or may not be attached depending on design.

In accordance with another aspect of the present disclosure, the burner assemblies herein may be used with an ignition control scheme that avoids prolonged energization of the igniter 90. In accordance with this aspect, a burner assembly 50 of the type described previously is provided. The igniter 90 is selectively connected to a source of power to heat the igniter 90 when desired. A user control (e.g., a cooktop knob) is provided, and when the user is performing an ignition actuation operation on the user control, the hot surface igniter 90 is energized, and when the user is not performing the ignition actuation operation control, the hot surface igniter 90 is de-energized. In certain examples, the user control is operatively connected to a switch that selectively places the hot surface igniter 90 in electrical communication with the power source during the ignition actuation operation. The ignition actuation operation may involve turning the cooktop knob to a "light" setting or pushing the knob in and holding it. In certain examples, the user control is operable both to ignite the igniter 90 and to supply cooking gas to the burner assembly 50.

In accordance with another aspect of the present disclosure, the burner assemblies described herein may be used with a simmer control scheme. In such examples, the cooking gas supplied to the burner assembly 50 is pulse-width-modulated. For example, cooking gas may be supplied to the burner for a first time period and then ceased for another time period in an alternating sequence. In such examples, the igniter 90 is preferably energized during the first time period only.

Another benefit of hot surface igniters is that the resistivity of the conductive ink circuits is temperature dependent. This temperature dependence may be used to determine whether a flame is present. In the absence of a flame, the temperature of the igniter will drop to an extent indicated by the resistance of the conductive ink circuit. For example, a separate conductive ink circuit comprising a resistive heating portion may be provided on igniter 90 and used to determine if a flame is present by measuring the resistance and/or a change in the resistance of the circuit. Alternatively, a separate igniter body may be provided in the same insulator or an adjacent one and used to sense the presence of a flame. In additional examples, the resistive heating circuit 345 may also be used to determine if a flame is present by measuring and/or sensing its resistance and/or change in resistance when it is not being energized to generate heat. In certain examples, a control system may be provided which shuts of the flow of cooking gas when no flame is detected.

Example

A hot surface igniter with the symmetric profile of FIG. 13A is provided. The igniter comprises two ceramic tiles 362 and 364 formed from silicon nitride, ytterbium oxide, and molybdenum disilicide. The amount of ytterbium oxide is from about 2 to about 15 percent by weight of the igniter body, and the amount of molybdenum disilicide is from about 3 to about 7 percent by weight. The balance of the tile ingredients comprises silicon nitride. The igniter is formed using the exemplary method of formation described above (e.g., powder processing, forming a powder compact, lamination, binder burn out, hot press sintering, dicing, brazing, and assembling).

A conductive ink pattern such as the pattern 340 depicted in FIG. 13C is screen printed on one of the tiles 362 and 364 and sandwiched there between. The conductive ink comprises from about 20 to about 30 percent tungsten carbide, from about 15 to about 40 percent silicon nitride, and from about 0.02 to about 5 percent ytterbium oxide. Silicon carbide may also be provided in an amount ranging from zero to about 6 percent by weight. The igniter body total thickness along the thickness axis t is about 0.016 inches.

Figure 14:
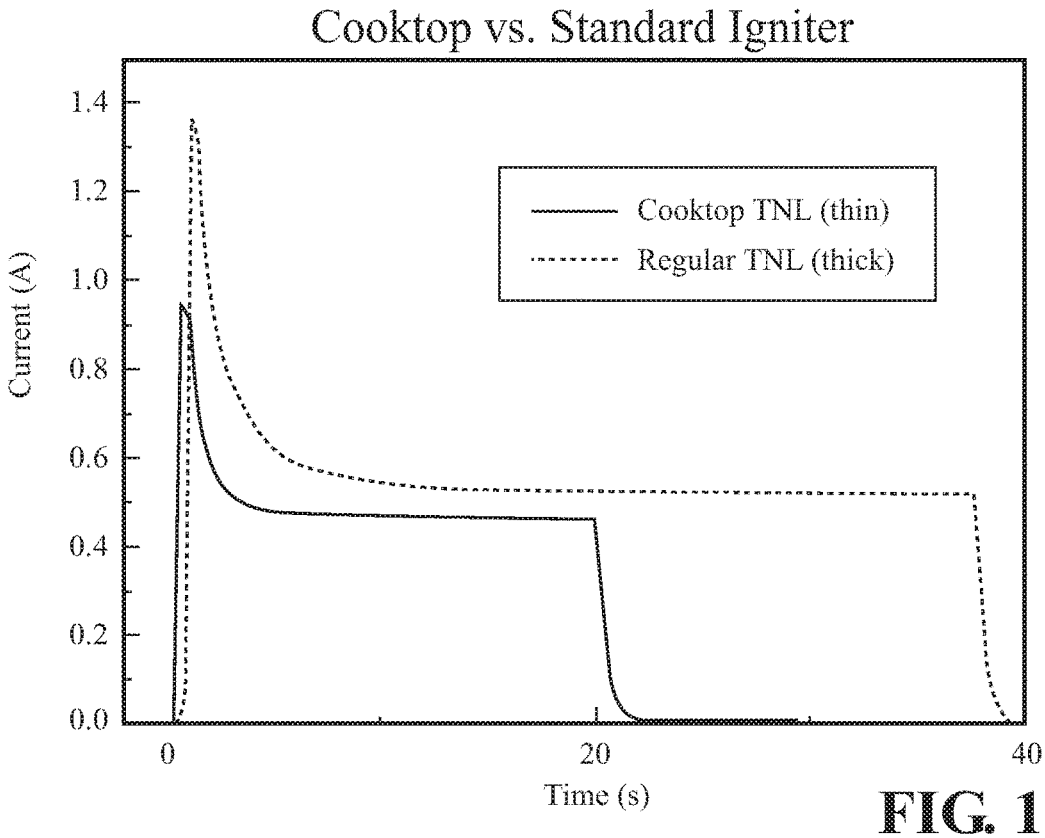
FIG. 14 is a plot of igniter temperature versus time for a hot surface igniter in accordance with the present disclosure and a thicker comparative igniter.
Figure 15:
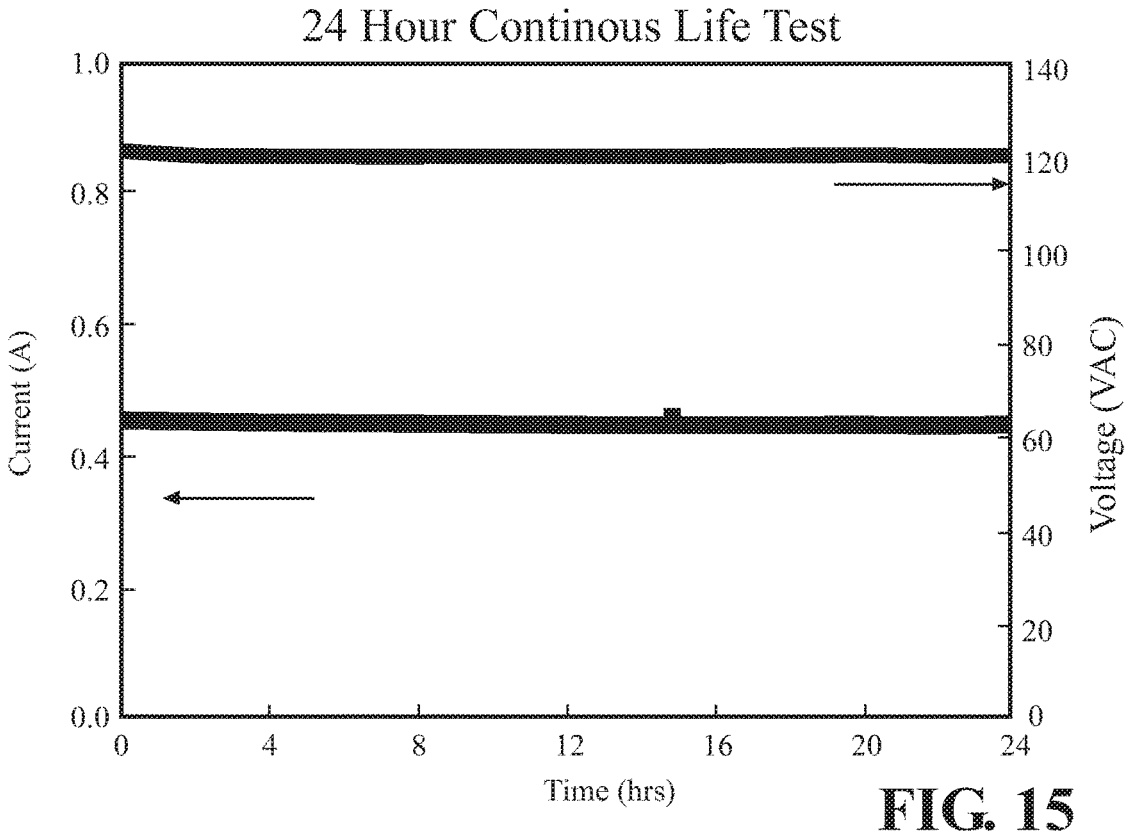
FIG. 15 is a plot of voltage and current versus time for an igniter in accordance with the present disclosure.

A comparative igniter is fabricated similarly except that the total igniter body thickness is 0.053 inches. A 120V AC energy source is connected to each igniter and activated. Referring to FIG. 14, the thicker igniter (upper trace) shows a greater "in-rush" current that is almost 40 percent higher than the peak current of the thinner igniter. The thinner igniter reaches steady state in about 2.5 seconds, while the thicker igniter takes about 10 seconds to achieve steady state. Thus, silicon nitride igniters with the thickness profiles described herein achieve steady state more quickly and more stably than thicker igniters. In certain cooktop applications, the igniters have target life of 5000 seconds (about 1.4 hours) during which they are energized. Referring to FIG. 15, voltage and current data are shown for the thinner igniter. As the figure indicates, a steady potential difference of 120V AC is applied to the igniter. At failure, current would cease to flow through the igniter. However, FIG. 15 shows that the thinner igniter did not fail even after 24 hours of continual operation.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of sensing the presence of a gas flame in a burner, comprising:

providing a hot surface igniter comprising a resistive heating circuit;

providing a resistive temperature sensing circuit;

determining one selected from the group consisting of a resistance of the resistive temperature sensing circuit and a change in resistance of the resistive temperature sensing circuit, and determining whether a gas flame is present in the burner based on the one selected from the group consisting of a resistance and a change in resistance, wherein the hot surface igniter further comprises the temperature sensing circuit.

2. The method of claim 1, wherein the hot surface igniter comprises a ceramic body comprising silicon nitride and the resistive heating circuit is embedded in the ceramic body.

3. A method of sensing the presence of a gas flame in a burner, comprising:

providing a hot surface igniter comprising a resistive heating circuit;

providing a resistive temperature sensing circuit;

determining one selected from the group consisting of a resistance of the resistive temperature sensing circuit and a change in resistance of the resistive temperature sensing circuit, and determining whether a gas flame is present in the burner based on the one selected from the group consisting of a resistance and a change in resistance, wherein the hot surface igniter comprises a first ceramic body, and the resistive heating circuit is embedded in the first ceramic body, and wherein the resistive temperature circuit is embedded in a second ceramic body.

4. The method of claim 3, wherein the hot surface igniter, and the second ceramic body are disposed in an insulator.

5. The method of claim 1, further comprising ceasing a flow of gas to the burner when a gas flame is determined not to be present.

6. The method of claim 3, wherein the first ceramic body comprises silicon nitride.

7. The method of claim 3, further comprising ceasing a flow of gas to the burner when a gas flame is determined not to be present.

8. The method of claim 1, wherein the one selected from the group consisting of a resistance of the resistive temperature sensing circuit and a change in resistance of the resistive temperature sensing circuit is the resistance of the resistive temperature sensing circuit.

9. The method of claim 1, wherein the one selected from the group consisting of a resistance of the resistive temperature sensing circuit and a change in resistance of the resistive temperature sensing circuit is the change in resistance of the resistive temperature sensing circuit.

10. The method of claim 3, wherein the one selected from the group consisting of a resistance of the resistive temperature sensing circuit and a change in resistance of the resistive temperature sensing circuit is the resistance of the resistive temperature sensing circuit.

11. The method of claim 3, wherein the one selected from the group consisting of a resistance of the resistive temperature sensing circuit and a change in resistance of the resistive temperature sensing circuit is the change in resistance of the resistive temperature sensing circuit.

12. The method of claim 1 wherein the burner is a cooktop burner, and the gas is cooking gas.

13. The method of claim 3 wherein the burner is a cooktop burner, and the gas is a cooking gas.

* * * * *